US008564625B2

(12) United States Patent
Kimura

(10) Patent No.: US 8,564,625 B2
(45) Date of Patent: Oct. 22, 2013

(54) DISPLAY DEVICE AND METHOD OF DRIVING THEREOF

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 908 days.

(21) Appl. No.: 11/567,033

(22) Filed: Dec. 5, 2006

(65) Prior Publication Data

US 2007/0132792 A1 Jun. 14, 2007

(30) Foreign Application Priority Data

Dec. 9, 2005 (JP) ..... 2005-356277

(51) Int. Cl.
*G09G 5/10* (2006.01)

(52) U.S. Cl.
USPC ..... 345/690; 345/60; 345/63; 345/76; 345/82; 345/89

(58) Field of Classification Search
USPC ..... 345/60, 61, 63, 64, 68, 72, 76–78, 345/82–83, 89, 690; 315/169.3, 169.4
See application file for complete search history.

(56) References Cited

U.S. PATENT DOCUMENTS 6,014,258 A * 1/2000 Naka et al. ..... 359/618
6,222,512 B1 4/2001 Tajima et al.
6,249,265 B1 * 6/2001 Tajima et al. ..... 345/63
6,292,159 B1 9/2001 Someya et al.
6,344,839 B1 2/2002 Denda et al.
6,417,835 B1 7/2002 Otobe et al.
6,448,960 B1 9/2002 Shigeta
6,693,607 B1 * 2/2004 Lee et al. ..... 345/60
7,623,091 B2 * 11/2009 Shishido et al. ..... 345/60
2001/0022565 A1 9/2001 Kimura
2005/0116914 A1 6/2005 Nagao et al.
2005/0205880 A1 9/2005 Anzai et al.
2005/0259121 A1 11/2005 Miyagawa
2006/0139265 A1 6/2006 Kimura (Continued)

FOREIGN PATENT DOCUMENTS

EP 0 837 441 A1 4/1998
JP 07-049663 2/1995

(Continued)

OTHER PUBLICATIONS

Machine Translation of JP-11231830.*

*Primary Examiner* — Jason Mandeville
(74) *Attorney, Agent, or Firm* — Fish & Richardson P.C.

(57) ABSTRACT

It is an object of the present invention to provide a display device and a method of driving the display device that can reduce pseudo contours while suppressing the number of sub-frames as much as possible. In the display device, where one frame is divided into a plurality of sub-frames to display a gray scale, the plurality of sub-frames have M (M is an integer number of greater than or equal to 2) regular sub-frames which is necessary for displaying predetermined gray scales and further an N (N is a natural number) additive sub-frame; and at least two sub-frame lighting patterns of a first sub-frame lighting pattern, where only the regular sub-frames are used, and a second sub-frame lighting pattern, where the additive sub-frames and the regular sub-frames are used, are provided at least for one gray scale of the predetermined gray scales.

14 Claims, 34 Drawing Sheets

(56) References Cited

U.S. PATENT DOCUMENTS

| | | | | |
|---|---|---|---|---|
| 2006/0158399 | A1 | 7/2006 | Kimura et al. | |
| 2006/0232600 | A1* | 10/2006 | Kimura et al. | 345/605 |
| 2006/0232601 | A1* | 10/2006 | Kimura et al. | 345/605 |
| 2006/0244391 | A1* | 11/2006 | Shishido et al. | 315/169.3 |
| 2007/0171241 | A1* | 7/2007 | Kimura | 345/690 |

FOREIGN PATENT DOCUMENTS

| | | | |
|---|---|---|---|
| JP | 07-175439 | | 7/1995 |
| JP | 08-278767 | A | 10/1996 |
| JP | 09-034399 | | 2/1997 |
| JP | 2639311 | B2 | 8/1997 |
| JP | 10-307561 | A | 11/1998 |
| JP | 11-038932 | A | 2/1999 |
| JP | 2903984 | B2 | 6/1999 |
| JP | 11231830 | A * | 8/1999 |
| JP | 11-288240 | A | 10/1999 |
| JP | 3075335 | B2 | 8/2000 |
| JP | 2001-324958 | A | 11/2001 |
| JP | 3322809 | B2 | 9/2002 |
| JP | 3489884 | B2 | 1/2004 |
| JP | 3585369 | B2 | 11/2004 |

* cited by examiner

FIG. 1

| lighting period / gray scale | SF1 | SF2 | SF3 | SF4 | SF5 | SF6 |
|---|---|---|---|---|---|---|
| | 1 | 2 | 4 | 8 | 16 | 1 |
| 0 | × | × | × | × | × | × |
| 1 | ○ | × | × | × | × | × |
| 2 | × | ○ | × | × | × | × |
| 3 | ○ | ○ | × | × | × | × |
| 4 | × | × | ○ | × | × | × |
| 4′ | ○ | ○ | × | × | × | ○ |
| 5 | ○ | × | ○ | × | × | × |
| 6 | × | ○ | ○ | × | × | × |
| 7 | ○ | ○ | ○ | × | × | × |
| 8 | × | × | × | ○ | × | × |
| 8′ | ○ | ○ | ○ | × | × | ○ |
| 9 | ○ | × | × | ○ | × | × |
| 10 | × | ○ | × | ○ | × | × |
| 11 | ○ | ○ | × | ○ | × | × |
| 12 | × | × | ○ | ○ | × | × |
| 12′ | ○ | ○ | × | ○ | × | ○ |
| 13 | ○ | × | ○ | ○ | × | × |
| 14 | × | ○ | ○ | ○ | × | × |
| 15 | ○ | ○ | ○ | ○ | × | × |
| 16 | × | × | × | × | ○ | × |
| 16′ | ○ | ○ | ○ | ○ | × | ○ |
| 17 | ○ | × | × | × | ○ | × |
| 18 | × | ○ | × | × | ○ | × |
| 19 | ○ | ○ | × | × | ○ | × |
| 20 | × | × | ○ | × | ○ | × |
| 20′ | ○ | ○ | × | × | ○ | ○ |
| 21 | ○ | × | ○ | × | ○ | × |
| 22 | × | ○ | ○ | × | ○ | × |
| 23 | ○ | ○ | ○ | × | ○ | × |
| 24 | × | × | × | ○ | ○ | × |
| 24′ | ○ | ○ | ○ | × | ○ | ○ |
| 25 | ○ | × | × | ○ | ○ | × |
| 26 | × | ○ | × | ○ | ○ | × |
| 27 | ○ | ○ | × | ○ | ○ | × |
| 28 | × | × | ○ | ○ | ○ | × |
| 28′ | ○ | ○ | × | ○ | ○ | ○ |
| 29 | ○ | × | ○ | ○ | ○ | × |
| 30 | × | ○ | ○ | ○ | ○ | × |
| 31 | ○ | ○ | ○ | ○ | ○ | × |

○: lighting
×: non-lighting

FIG. 2

| lighting period / gray scale | SF1 | SF2 | SF3 | SF4 | SF5 | SF6 | SF7 |
|---|---|---|---|---|---|---|---|
| | 1 | 2 | 4 | 8 | 16 | 32 | 1 |
| 0 | × | × | × | × | × | × | × |
| 1 | ○ | × | × | × | × | × | × |
| 2 | × | ○ | × | × | × | × | × |
| 3 | ○ | ○ | × | × | × | × | × |
| 4 | × | × | ○ | × | × | × | × |
| 4' | ○ | ○ | × | × | × | × | ○ |
| 5 | ○ | × | ○ | × | × | × | × |
| 6 | × | ○ | ○ | × | × | × | × |
| 7 | ○ | ○ | ○ | × | × | × | × |
| 8 | × | × | × | ○ | × | × | × |
| 8' | ○ | ○ | ○ | × | × | × | ○ |
| 9 | ○ | × | × | ○ | × | × | × |
| 10 | × | ○ | × | ○ | × | × | × |
| 11 | ○ | ○ | × | ○ | × | × | × |
| 12 | × | × | ○ | ○ | × | × | × |
| 13 | ○ | × | ○ | ○ | × | × | × |
| 14 | × | ○ | ○ | ○ | × | × | × |
| 15 | ○ | ○ | ○ | ○ | × | × | × |
| 16 | × | × | × | × | ○ | × | × |
| 16' | ○ | ○ | ○ | ○ | × | × | ○ |
| 17 | ○ | × | × | × | ○ | × | × |
| 18 | × | ○ | × | × | ○ | × | × |
| 19 | ○ | ○ | × | × | ○ | × | × |
| 20 | × | × | ○ | × | ○ | × | × |
| 21 | ○ | × | ○ | × | ○ | × | × |
| 22 | × | ○ | ○ | × | ○ | × | × |
| 23 | ○ | ○ | ○ | × | ○ | × | × |
| 24 | × | × | × | ○ | ○ | × | × |
| 25 | ○ | × | × | × | ○ | × | × |
| 26 | × | ○ | × | × | ○ | × | × |
| 27 | ○ | ○ | × | × | ○ | × | × |
| 28 | × | × | ○ | × | ○ | × | × |
| 29 | ○ | × | ○ | × | ○ | × | × |
| 30 | × | ○ | ○ | × | ○ | × | × |
| 31 | ○ | ○ | ○ | × | ○ | × | × |
| 32 | × | × | × | × | × | ○ | × |
| 32' | ○ | ○ | ○ | ○ | ○ | × | ○ |
| 33 | ○ | × | × | × | × | ○ | × |
| 34 | × | ○ | × | × | × | ○ | × |
| 35 | ○ | ○ | × | × | × | ○ | × |
| 36 | × | × | ○ | × | × | ○ | × |
| 37 | ○ | × | ○ | × | × | ○ | × |
| 38 | × | ○ | ○ | × | × | ○ | × |
| 39 | ○ | ○ | ○ | × | × | ○ | × |
| 40 | × | × | × | ○ | × | ○ | × |
| 41 | ○ | × | × | ○ | × | ○ | × |
| 42 | × | ○ | × | ○ | × | ○ | × |
| 43 | ○ | ○ | × | ○ | × | ○ | × |
| 44 | × | × | ○ | ○ | × | ○ | × |
| 45 | ○ | × | ○ | ○ | × | ○ | × |
| 46 | × | ○ | ○ | ○ | × | ○ | × |
| 47 | ○ | ○ | ○ | ○ | × | ○ | × |
| 48 | × | × | × | × | ○ | ○ | × |
| 49 | ○ | × | × | × | ○ | ○ | × |
| 50 | × | ○ | × | × | ○ | ○ | × |
| 51 | ○ | ○ | × | × | ○ | ○ | × |
| 52 | × | × | ○ | × | ○ | ○ | × |
| 53 | ○ | × | ○ | × | ○ | ○ | × |
| 54 | × | ○ | ○ | × | ○ | ○ | × |
| 55 | ○ | ○ | ○ | × | ○ | ○ | × |
| 56 | × | × | × | ○ | ○ | ○ | × |
| 57 | ○ | × | × | ○ | ○ | ○ | × |
| 58 | × | ○ | × | ○ | ○ | ○ | × |
| 59 | ○ | ○ | × | ○ | ○ | ○ | × |
| 60 | × | × | ○ | ○ | ○ | ○ | × |
| 61 | ○ | × | ○ | ○ | ○ | ○ | × |
| 62 | × | ○ | ○ | ○ | ○ | ○ | × |
| 63 | ○ | ○ | ○ | ○ | ○ | ○ | × |

FIG. 3

| gray scale \ lighting period | SF1 | SF2 | SF3 | SF4 | SF5 | SF6 | SF7 |
|---|---|---|---|---|---|---|---|
| | 1 | 2 | 4 | 8 | 16 | 1 | 1 |
| 0 | × | × | × | × | × | × | × |
| 1 | ○ | × | × | × | × | × | × |
| 2 | × | ○ | × | × | × | × | × |
| 3 | ○ | ○ | × | × | × | × | × |
| 4 | × | × | ○ | × | × | × | × |
| 4′ | ○ | ○ | × | × | × | ○ | × |
| 5 | ○ | × | ○ | × | × | × | × |
| 5′ | ○ | ○ | × | × | × | ○ | ○ |
| 6 | × | ○ | ○ | × | × | × | × |
| 7 | ○ | ○ | ○ | × | × | × | × |
| 8 | × | × | × | ○ | × | × | × |
| 8′ | ○ | ○ | ○ | × | × | ○ | × |
| 9 | ○ | × | × | ○ | × | × | × |
| 9′ | ○ | ○ | ○ | × | × | ○ | ○ |
| 10 | × | ○ | × | ○ | × | × | × |
| 11 | ○ | ○ | × | ○ | × | × | × |
| 12 | × | × | ○ | ○ | × | × | × |
| 12′ | ○ | ○ | × | ○ | × | ○ | × |
| 13 | ○ | × | ○ | ○ | × | × | × |
| 13′ | ○ | ○ | × | ○ | × | ○ | ○ |
| 14 | × | ○ | ○ | ○ | × | × | × |
| 15 | ○ | ○ | ○ | ○ | × | × | × |
| 16 | × | × | × | × | ○ | × | × |
| 16′ | ○ | ○ | ○ | ○ | × | ○ | × |
| 17 | ○ | × | × | × | ○ | × | × |
| 17′ | ○ | ○ | ○ | ○ | × | ○ | ○ |
| 18 | × | ○ | × | × | ○ | × | × |
| 19 | ○ | ○ | × | × | ○ | × | × |
| 20 | × | × | ○ | × | ○ | × | × |
| 20′ | ○ | ○ | × | × | ○ | ○ | × |
| 21 | ○ | × | ○ | × | ○ | × | × |
| 21′ | ○ | ○ | × | × | ○ | ○ | ○ |
| 22 | × | ○ | ○ | × | ○ | × | × |
| 23 | ○ | ○ | ○ | × | ○ | × | × |
| 24 | × | × | × | ○ | ○ | × | × |
| 24′ | ○ | ○ | ○ | × | ○ | ○ | × |
| 25 | ○ | × | × | ○ | ○ | × | × |
| 25′ | ○ | ○ | ○ | × | ○ | ○ | ○ |
| 26 | × | ○ | × | ○ | ○ | × | × |
| 27 | ○ | ○ | × | ○ | ○ | × | × |
| 28 | × | × | ○ | ○ | ○ | × | × |
| 28′ | ○ | ○ | × | ○ | ○ | ○ | × |
| 29 | ○ | × | ○ | ○ | ○ | × | × |
| 29′ | ○ | ○ | × | ○ | ○ | ○ | ○ |
| 30 | × | ○ | ○ | ○ | ○ | × | × |
| 31 | ○ | ○ | ○ | ○ | ○ | × | × |

FIG. 4

| lighting period / gray scale | SF1 | SF2 | SF3 | SF4 | SF5 | SF6 | SF7 |
|---|---|---|---|---|---|---|---|
| | 1 | 2 | 4 | 8 | 16 | 1 | 2 |
| 0 | × | × | × | × | × | × | × |
| 1 | ○ | × | × | × | × | × | × |
| 2 | × | ○ | × | × | × | × | × |
| 3 | ○ | ○ | × | × | × | × | × |
| 4 | × | × | ○ | × | × | × | × |
| 4′ | ○ | ○ | × | × | × | ○ | × |
| 5 | ○ | × | ○ | × | × | × | × |
| 5′ | ○ | ○ | × | × | × | × | ○ |
| 6 | × | ○ | ○ | × | × | × | × |
| 6′ | ○ | ○ | × | × | × | ○ | ○ |
| 7 | ○ | ○ | ○ | × | × | × | × |
| 8 | × | × | × | ○ | × | × | × |
| 8′ | ○ | ○ | ○ | × | × | ○ | × |
| 9 | ○ | × | × | ○ | × | × | × |
| 9′ | ○ | ○ | ○ | × | × | × | ○ |
| 10 | × | ○ | × | ○ | × | × | × |
| 10′ | ○ | ○ | ○ | × | × | ○ | ○ |
| 11 | ○ | ○ | × | ○ | × | × | × |
| 12 | × | × | ○ | ○ | × | × | × |
| 12′ | ○ | ○ | × | ○ | × | ○ | × |
| 13 | ○ | × | ○ | ○ | × | × | × |
| 13′ | ○ | ○ | × | ○ | × | × | ○ |
| 14 | × | ○ | ○ | ○ | × | × | × |
| 14′ | ○ | ○ | × | ○ | × | ○ | ○ |
| 15 | ○ | ○ | ○ | ○ | × | × | × |
| 16 | × | × | × | × | ○ | × | × |
| 16′ | ○ | ○ | ○ | ○ | × | ○ | × |
| 17 | ○ | × | × | × | ○ | × | × |
| 17′ | ○ | ○ | ○ | ○ | × | × | ○ |
| 18 | × | ○ | × | × | ○ | × | × |
| 18′ | ○ | ○ | ○ | ○ | × | ○ | ○ |
| 19 | ○ | ○ | × | × | ○ | × | × |
| 20 | × | × | ○ | × | ○ | × | × |
| 20′ | ○ | ○ | × | × | ○ | ○ | × |
| 21 | ○ | × | ○ | × | ○ | × | × |
| 21′ | ○ | ○ | × | × | ○ | × | ○ |
| 22 | × | ○ | ○ | × | ○ | × | × |
| 22′ | ○ | ○ | × | × | ○ | ○ | ○ |
| 23 | ○ | ○ | ○ | × | ○ | × | × |
| 24 | × | × | × | ○ | ○ | × | × |
| 24′ | ○ | ○ | ○ | × | ○ | ○ | × |
| 25 | ○ | × | × | ○ | ○ | × | × |
| 25′ | ○ | ○ | ○ | × | ○ | × | ○ |
| 26 | × | ○ | × | ○ | ○ | × | × |
| 26′ | ○ | ○ | ○ | × | ○ | ○ | ○ |
| 27 | ○ | ○ | × | ○ | ○ | × | × |
| 28 | × | × | ○ | ○ | ○ | × | × |
| 28′ | ○ | ○ | × | ○ | ○ | ○ | × |
| 29 | ○ | × | ○ | × | ○ | × | × |
| 29′ | ○ | ○ | × | ○ | ○ | ○ | ○ |
| 30 | × | ○ | ○ | ○ | ○ | × | × |
| 30′ | ○ | ○ | × | × | ○ | ○ | ○ |
| 31 | ○ | ○ | ○ | ○ | ○ | × | × |

FIG. 5

| lighting period / gray scale | SF1 | SF2 | SF3 | SF4 | SF5 | SF6 | SF7 | SF8 |
|---|---|---|---|---|---|---|---|---|
| | 1 | 2 | 4 | 8 | 16 | 1 | 2 | 3 |
| 0 | × | × | × | × | × | × | × | × |
| 1 | ○ | × | × | × | × | × | × | × |
| 2 | × | ○ | × | × | × | × | × | × |
| 3 | ○ | ○ | × | × | × | × | × | × |
| 4 | × | × | ○ | × | × | × | × | × |
| 4′ | ○ | ○ | × | × | × | ○ | × | × |
| 5 | ○ | × | ○ | × | × | × | × | × |
| 5′ | ○ | ○ | × | × | × | × | ○ | × |
| 6 | × | ○ | ○ | × | × | × | × | × |
| 6′ | ○ | ○ | × | × | × | ○ | ○ | × |
| 7 | ○ | ○ | ○ | × | × | × | × | × |
| 7′ | ○ | ○ | × | × | × | ○ | × | ○ |
| 8 | × | × | × | ○ | × | × | × | × |
| 8′ | ○ | ○ | ○ | × | × | ○ | × | × |
| 9 | ○ | × | × | ○ | × | × | × | × |
| 9′ | ○ | ○ | ○ | × | × | × | ○ | × |
| 10 | × | ○ | × | ○ | × | × | × | × |
| 10′ | ○ | ○ | ○ | × | × | ○ | ○ | × |
| 11 | ○ | ○ | × | ○ | × | × | × | × |
| 11′ | ○ | ○ | ○ | × | × | ○ | × | ○ |
| 12 | × | × | ○ | ○ | × | × | × | × |
| 12′ | ○ | ○ | × | ○ | × | ○ | × | × |
| 13 | ○ | × | ○ | ○ | × | × | × | × |
| 13′ | ○ | ○ | × | ○ | × | × | ○ | × |
| 14 | × | ○ | ○ | ○ | × | × | × | × |
| 14′ | ○ | ○ | × | ○ | × | ○ | ○ | × |
| 15 | ○ | ○ | ○ | ○ | × | × | × | × |
| 15′ | ○ | ○ | × | ○ | × | ○ | × | ○ |
| 16 | × | × | × | × | ○ | × | × | × |
| 16′ | ○ | ○ | ○ | ○ | × | ○ | × | × |
| 17 | ○ | × | × | × | ○ | × | × | × |
| 17′ | ○ | ○ | ○ | ○ | × | × | ○ | × |
| 18 | × | ○ | × | × | ○ | × | × | × |
| 18′ | ○ | ○ | ○ | ○ | × | ○ | ○ | × |
| 19 | ○ | ○ | × | × | ○ | × | × | × |
| 19′ | ○ | ○ | ○ | ○ | × | ○ | × | ○ |
| 20 | × | × | ○ | × | ○ | × | × | × |
| 20′ | ○ | ○ | × | × | ○ | ○ | × | × |
| 21 | ○ | × | ○ | × | ○ | × | × | × |
| 21′ | ○ | ○ | × | × | ○ | × | ○ | × |
| 22 | × | ○ | ○ | × | ○ | × | × | × |
| 22′ | ○ | ○ | × | × | ○ | ○ | ○ | × |
| 23 | ○ | ○ | ○ | × | ○ | × | × | × |
| 23′ | ○ | ○ | × | × | ○ | ○ | × | ○ |
| 24 | × | × | × | ○ | ○ | × | × | × |
| 24′ | ○ | ○ | ○ | × | ○ | ○ | × | × |
| 25 | ○ | × | × | ○ | ○ | × | × | × |
| 25′ | ○ | ○ | ○ | × | ○ | × | ○ | × |
| 26 | × | ○ | × | ○ | ○ | × | × | × |
| 26′ | ○ | ○ | ○ | × | ○ | ○ | ○ | × |
| 27 | ○ | ○ | × | ○ | ○ | × | × | × |
| 27′ | ○ | ○ | ○ | × | ○ | ○ | × | ○ |
| 28 | × | × | ○ | ○ | ○ | × | × | × |
| 28′ | ○ | ○ | × | ○ | ○ | ○ | × | × |
| 29 | ○ | × | ○ | ○ | ○ | × | × | × |
| 29′ | ○ | ○ | × | ○ | ○ | × | ○ | × |
| 30 | × | ○ | ○ | ○ | ○ | × | × | × |
| 30′ | ○ | ○ | × | ○ | ○ | ○ | ○ | × |
| 31 | ○ | ○ | ○ | ○ | ○ | × | × | × |
| 31′ | ○ | ○ | × | ○ | ○ | ○ | × | ○ |

FIG. 6

| lighting period / gray scale | SF1 | SF2 | SF3 | SF4 | SF5 | SF6 | SF7 | SF8 | SF9 | SF10 |
|---|---|---|---|---|---|---|---|---|---|---|
| | 4 | 4 | 4 | 4 | 4 | 4 | 4 | 1 | 2 | 1 |
| 0 | × | × | × | × | × | × | × | × | × | × |
| 1 | × | × | × | × | × | × | × | ○ | × | × |
| 2 | × | × | × | × | × | × | × | × | ○ | × |
| 3 | × | × | × | × | × | × | × | ○ | ○ | × |
| 4 | ○ | × | × | × | × | × | × | × | × | × |
| 4′ | × | × | × | × | × | × | × | ○ | ○ | ○ |
| 5 | ○ | × | × | × | × | × | × | ○ | × | × |
| 6 | ○ | × | × | × | × | × | × | × | ○ | × |
| 7 | ○ | × | × | × | × | × | × | ○ | ○ | × |
| 8 | ○ | ○ | × | × | × | × | × | × | × | × |
| 8′ | ○ | × | × | × | × | × | × | ○ | ○ | ○ |
| 9 | ○ | ○ | × | × | × | × | × | ○ | × | × |
| 10 | ○ | ○ | × | × | × | × | × | × | ○ | × |
| 11 | ○ | ○ | × | × | × | × | × | ○ | ○ | × |
| 12 | ○ | ○ | ○ | × | × | × | × | × | × | × |
| 12′ | ○ | ○ | × | × | × | × | × | ○ | ○ | ○ |
| 13 | ○ | ○ | ○ | × | × | × | × | ○ | × | × |
| 14 | ○ | ○ | ○ | × | × | × | × | × | ○ | × |
| 15 | ○ | ○ | ○ | × | × | × | × | ○ | ○ | × |
| 16 | ○ | ○ | ○ | ○ | × | × | × | × | × | × |
| 16′ | ○ | ○ | ○ | × | × | × | × | ○ | ○ | ○ |
| 17 | ○ | ○ | ○ | ○ | × | × | × | ○ | × | × |
| 18 | ○ | ○ | ○ | ○ | × | × | × | × | ○ | × |
| 19 | ○ | ○ | ○ | ○ | × | × | × | ○ | ○ | × |
| 20 | ○ | ○ | ○ | ○ | ○ | × | × | × | × | × |
| 20′ | ○ | ○ | ○ | ○ | × | × | × | ○ | ○ | ○ |
| 21 | ○ | ○ | ○ | ○ | ○ | × | × | ○ | × | × |
| 22 | ○ | ○ | ○ | ○ | ○ | × | × | × | ○ | × |
| 23 | ○ | ○ | ○ | ○ | ○ | × | × | ○ | ○ | × |
| 24 | ○ | ○ | ○ | ○ | ○ | ○ | × | × | × | × |
| 24′ | ○ | ○ | ○ | ○ | ○ | × | × | ○ | ○ | ○ |
| 25 | ○ | ○ | ○ | ○ | ○ | ○ | × | ○ | × | × |
| 26 | ○ | ○ | ○ | ○ | ○ | ○ | × | × | ○ | × |
| 27 | ○ | ○ | ○ | ○ | ○ | ○ | × | ○ | ○ | × |
| 28 | ○ | ○ | ○ | ○ | ○ | ○ | ○ | × | × | × |
| 28′ | ○ | ○ | ○ | ○ | ○ | ○ | × | ○ | ○ | ○ |
| 29 | ○ | ○ | ○ | ○ | ○ | ○ | ○ | ○ | × | × |
| 30 | ○ | ○ | ○ | ○ | ○ | ○ | ○ | × | ○ | × |
| 31 | ○ | ○ | ○ | ○ | ○ | ○ | ○ | ○ | ○ | × |

FIG. 7

| lighting period / gray scale | SF1 | SF2 | SF3 | SF4 | SF5 | SF6 | SF7 | SF8 | SF9 | SF10 | SF11 |
|---|---|---|---|---|---|---|---|---|---|---|---|
| | 4 | 4 | 4 | 4 | 4 | 4 | 4 | 1 | 2 | 1 | 1 |
| 0 | × | × | × | × | × | × | × | × | × | × | × |
| 1 | × | × | × | × | × | × | × | ○ | × | × | × |
| 2 | × | × | × | × | × | × | × | × | ○ | × | × |
| 3 | × | × | × | × | × | × | × | ○ | ○ | × | × |
| 4 | ○ | × | × | × | × | × | × | × | × | × | × |
| 4′ | × | × | × | × | × | × | × | ○ | ○ | ○ | × |
| 5 | ○ | × | × | × | × | × | × | ○ | × | × | × |
| 5′ | × | × | × | × | × | × | × | ○ | ○ | ○ | ○ |
| 6 | ○ | × | × | × | × | × | × | × | ○ | × | × |
| 7 | ○ | × | × | × | × | × | × | ○ | ○ | × | × |
| 8 | ○ | ○ | × | × | × | × | × | × | × | × | × |
| 8′ | ○ | × | × | × | × | × | × | ○ | ○ | ○ | × |
| 9 | ○ | ○ | × | × | × | × | × | ○ | × | × | × |
| 9′ | ○ | × | × | × | × | × | × | ○ | ○ | ○ | ○ |
| 10 | ○ | ○ | × | × | × | × | × | × | ○ | × | × |
| 11 | ○ | ○ | × | × | × | × | × | ○ | ○ | × | × |
| 12 | ○ | ○ | ○ | × | × | × | × | × | × | × | × |
| 12′ | ○ | ○ | × | × | × | × | × | ○ | ○ | ○ | × |
| 13 | ○ | ○ | ○ | × | × | × | × | ○ | × | × | × |
| 13′ | ○ | ○ | × | × | × | × | × | ○ | ○ | ○ | ○ |
| 14 | ○ | ○ | ○ | × | × | × | × | × | ○ | × | × |
| 15 | ○ | ○ | ○ | × | × | × | × | ○ | ○ | × | × |
| 16 | ○ | ○ | ○ | ○ | × | × | × | × | × | × | × |
| 16′ | ○ | ○ | ○ | × | × | × | × | ○ | ○ | ○ | × |
| 17 | ○ | ○ | ○ | ○ | × | × | × | ○ | × | × | × |
| 17′ | ○ | ○ | ○ | × | × | × | × | ○ | ○ | ○ | ○ |
| 18 | ○ | ○ | ○ | ○ | × | × | × | × | ○ | × | × |
| 19 | ○ | ○ | ○ | ○ | × | × | × | ○ | ○ | × | × |
| 20 | ○ | ○ | ○ | ○ | ○ | × | × | × | × | × | × |
| 20′ | ○ | ○ | ○ | ○ | × | × | × | ○ | ○ | ○ | × |
| 21 | ○ | ○ | ○ | ○ | ○ | × | × | ○ | × | × | × |
| 21′ | ○ | ○ | ○ | ○ | × | × | × | ○ | ○ | ○ | ○ |
| 22 | ○ | ○ | ○ | ○ | ○ | × | × | × | ○ | × | × |
| 23 | ○ | ○ | ○ | ○ | ○ | × | × | ○ | ○ | × | × |
| 24 | ○ | ○ | ○ | ○ | ○ | ○ | × | × | × | × | × |
| 24′ | ○ | ○ | ○ | ○ | ○ | × | × | ○ | ○ | ○ | × |
| 25 | ○ | ○ | ○ | ○ | ○ | ○ | × | ○ | × | × | × |
| 25′ | ○ | ○ | ○ | ○ | ○ | × | × | ○ | ○ | ○ | ○ |
| 26 | ○ | ○ | ○ | ○ | ○ | ○ | × | × | ○ | × | × |
| 27 | ○ | ○ | ○ | ○ | ○ | ○ | × | ○ | ○ | × | × |
| 28 | ○ | ○ | ○ | ○ | ○ | ○ | ○ | × | × | × | × |
| 28′ | ○ | ○ | ○ | ○ | ○ | ○ | × | ○ | ○ | ○ | × |
| 29 | ○ | ○ | ○ | ○ | ○ | ○ | ○ | ○ | × | × | × |
| 29′ | ○ | ○ | ○ | ○ | ○ | ○ | × | ○ | ○ | ○ | ○ |
| 30 | ○ | ○ | ○ | ○ | ○ | ○ | ○ | × | ○ | × | × |
| 31 | ○ | ○ | ○ | ○ | ○ | ○ | ○ | ○ | ○ | × | × |

FIG. 8

| lighting period / gray scale | SF1 | SF2 | SF3 | SF4 | SF5 | SF6 | SF7 | SF8 | SF9 | SF10 | SF11 |
|---|---|---|---|---|---|---|---|---|---|---|---|
| | 4 | 4 | 4 | 4 | 4 | 4 | 4 | 1 | 2 | 1 | 2 |
| 0 | × | × | × | × | × | × | × | × | × | × | × |
| 1 | × | × | × | × | × | × | × | ○ | × | × | × |
| 2 | × | × | × | × | × | × | × | × | ○ | × | × |
| 3 | × | × | × | × | × | × | × | ○ | ○ | × | × |
| 4 | ○ | × | × | × | × | × | × | × | × | × | × |
| 4′ | × | × | × | × | × | × | × | ○ | ○ | ○ | × |
| 5 | ○ | × | × | × | × | × | × | ○ | × | × | × |
| 5′ | × | × | × | × | × | × | × | ○ | ○ | × | ○ |
| 6 | ○ | × | × | × | × | × | × | × | ○ | × | × |
| 6′ | × | × | × | × | × | × | × | ○ | ○ | ○ | ○ |
| 7 | ○ | × | × | × | × | × | × | ○ | ○ | × | × |
| 8 | ○ | ○ | × | × | × | × | × | × | × | × | × |
| 8′ | ○ | × | × | × | × | × | × | ○ | ○ | ○ | × |
| 9 | ○ | ○ | × | × | × | × | × | ○ | × | × | × |
| 9′ | ○ | × | × | × | × | × | × | ○ | ○ | × | ○ |
| 10 | ○ | ○ | × | × | × | × | × | × | ○ | × | × |
| 10′ | ○ | × | × | × | × | × | × | ○ | ○ | ○ | ○ |
| 11 | ○ | ○ | × | × | × | × | × | ○ | ○ | × | × |
| 12 | ○ | ○ | ○ | × | × | × | × | × | × | × | × |
| 12′ | ○ | ○ | × | × | × | × | × | ○ | ○ | ○ | × |
| 13 | ○ | ○ | ○ | × | × | × | × | ○ | × | × | × |
| 13′ | ○ | ○ | × | × | × | × | × | ○ | ○ | × | ○ |
| 14 | ○ | ○ | ○ | × | × | × | × | × | ○ | × | × |
| 14′ | ○ | ○ | × | × | × | × | × | ○ | ○ | ○ | ○ |
| 15 | ○ | ○ | ○ | × | × | × | × | ○ | ○ | × | × |
| 16 | ○ | ○ | ○ | ○ | × | × | × | × | × | × | × |
| 16′ | ○ | ○ | ○ | × | × | × | × | ○ | ○ | ○ | × |
| 17 | ○ | ○ | ○ | ○ | × | × | × | ○ | × | × | × |
| 17′ | ○ | ○ | ○ | × | × | × | × | ○ | ○ | × | ○ |
| 18 | ○ | ○ | ○ | ○ | × | × | × | × | ○ | × | × |
| 18′ | ○ | ○ | ○ | × | × | × | × | ○ | ○ | ○ | ○ |
| 19 | ○ | ○ | ○ | ○ | × | × | × | ○ | ○ | × | × |
| 20 | ○ | ○ | ○ | ○ | ○ | × | × | × | × | × | × |
| 20′ | ○ | ○ | ○ | ○ | × | × | × | ○ | ○ | ○ | × |
| 21 | ○ | ○ | ○ | ○ | ○ | × | × | ○ | × | × | × |
| 21′ | ○ | ○ | ○ | ○ | × | × | × | ○ | ○ | × | ○ |
| 22 | ○ | ○ | ○ | ○ | ○ | × | × | × | ○ | × | × |
| 22′ | ○ | ○ | ○ | ○ | × | × | × | ○ | ○ | ○ | ○ |
| 23 | ○ | ○ | ○ | ○ | ○ | × | × | ○ | ○ | × | × |
| 24 | ○ | ○ | ○ | ○ | ○ | ○ | × | × | × | × | × |
| 24′ | ○ | ○ | ○ | ○ | ○ | × | × | ○ | ○ | ○ | × |
| 25 | ○ | ○ | ○ | ○ | ○ | ○ | × | ○ | × | × | × |
| 25′ | ○ | ○ | ○ | ○ | ○ | × | × | ○ | ○ | × | ○ |
| 26 | ○ | ○ | ○ | ○ | ○ | ○ | × | × | ○ | × | × |
| 26′ | ○ | ○ | ○ | ○ | ○ | × | × | ○ | ○ | ○ | ○ |
| 27 | ○ | ○ | ○ | ○ | ○ | ○ | × | ○ | ○ | × | × |
| 28 | ○ | ○ | ○ | ○ | ○ | ○ | ○ | × | × | × | × |
| 28′ | ○ | ○ | ○ | ○ | ○ | ○ | × | ○ | ○ | ○ | × |
| 29 | ○ | ○ | ○ | ○ | ○ | ○ | ○ | ○ | × | × | × |
| 29′ | ○ | ○ | ○ | ○ | ○ | ○ | × | ○ | ○ | × | ○ |
| 30 | ○ | ○ | ○ | ○ | ○ | ○ | ○ | × | ○ | × | × |
| 30′ | ○ | ○ | ○ | ○ | ○ | ○ | × | ○ | ○ | ○ | ○ |
| 31 | ○ | ○ | ○ | ○ | ○ | ○ | ○ | ○ | ○ | × | × |

FIG. 9

| lighting period / gray scale | SF1 | SF2 | SF3 | SF4 | SF5 | SF6 | SF7 | SF8 | SF9 | SF10 | SF11 |
|---|---|---|---|---|---|---|---|---|---|---|---|
| | 4 | 4 | 4 | 4 | 4 | 4 | 4 | 1 | 1 | 1 | 1 |
| 0 | × | × | × | × | × | × | × | × | × | × | × |
| 1 | × | × | × | × | × | × | × | ○ | × | × | × |
| 2 | × | × | × | × | × | × | × | ○ | ○ | × | × |
| 3 | × | × | × | × | × | × | × | ○ | ○ | ○ | × |
| 4 | ○ | × | × | × | × | × | × | × | × | × | × |
| 4′ | × | × | × | × | × | × | × | ○ | ○ | ○ | ○ |
| 5 | ○ | × | × | × | × | × | × | ○ | × | × | × |
| 6 | ○ | × | × | × | × | × | × | ○ | ○ | × | × |
| 7 | ○ | × | × | × | × | × | × | ○ | ○ | ○ | × |
| 8 | ○ | ○ | × | × | × | × | × | × | × | × | × |
| 8′ | ○ | × | × | × | × | × | × | ○ | ○ | ○ | ○ |
| 9 | ○ | ○ | × | × | × | × | × | ○ | × | × | × |
| 10 | ○ | ○ | × | × | × | × | × | ○ | ○ | × | × |
| 11 | ○ | ○ | × | × | × | × | × | ○ | ○ | ○ | × |
| 12 | ○ | ○ | ○ | × | × | × | × | × | × | × | × |
| 12′ | ○ | ○ | × | × | × | × | × | ○ | ○ | ○ | ○ |
| 13 | ○ | ○ | ○ | × | × | × | × | ○ | × | × | × |
| 14 | ○ | ○ | ○ | × | × | × | × | ○ | ○ | × | × |
| 15 | ○ | ○ | ○ | × | × | × | × | ○ | ○ | ○ | × |
| 16 | ○ | ○ | ○ | ○ | × | × | × | × | × | × | × |
| 16′ | ○ | ○ | ○ | × | × | × | × | ○ | ○ | ○ | ○ |
| 17 | ○ | ○ | ○ | ○ | × | × | × | ○ | × | × | × |
| 18 | ○ | ○ | ○ | ○ | × | × | × | ○ | ○ | × | × |
| 19 | ○ | ○ | ○ | ○ | × | × | × | ○ | ○ | ○ | × |
| 20 | ○ | ○ | ○ | ○ | ○ | × | × | × | × | × | × |
| 20′ | ○ | ○ | ○ | ○ | × | × | × | ○ | ○ | ○ | ○ |
| 21 | ○ | ○ | ○ | ○ | ○ | × | × | ○ | × | × | × |
| 22 | ○ | ○ | ○ | ○ | ○ | × | × | ○ | ○ | × | × |
| 23 | ○ | ○ | ○ | ○ | ○ | × | × | ○ | ○ | ○ | × |
| 24 | ○ | ○ | ○ | ○ | ○ | ○ | × | × | × | × | × |
| 24′ | ○ | ○ | ○ | ○ | ○ | × | × | ○ | ○ | ○ | ○ |
| 25 | ○ | ○ | ○ | ○ | ○ | ○ | × | ○ | × | × | × |
| 26 | ○ | ○ | ○ | ○ | ○ | ○ | × | ○ | ○ | × | × |
| 27 | ○ | ○ | ○ | ○ | ○ | ○ | × | ○ | ○ | ○ | × |
| 28 | ○ | ○ | ○ | ○ | ○ | ○ | ○ | × | × | × | × |
| 28′ | ○ | ○ | ○ | ○ | ○ | ○ | × | ○ | ○ | ○ | ○ |
| 29 | ○ | ○ | ○ | ○ | ○ | ○ | ○ | ○ | × | × | × |
| 30 | ○ | ○ | ○ | ○ | ○ | ○ | ○ | ○ | ○ | × | × |
| 31 | ○ | ○ | ○ | ○ | ○ | ○ | ○ | ○ | ○ | ○ | × |

FIG. 10

| lighting period / gray scale | | SF1 | SF2 | SF3 | SF4 | SF5 | SF6 | SF7 |
|---|---|---|---|---|---|---|---|---|
| | | 1 | 2 | 4 | 8 | 16 | 32 | 1 |
| 6bit | 5bit | | | | | | | |
| 0 | 0 | × | × | × | × | × | × | × |
| 1 | 1 | ○ | × | × | × | × | × | × |
| 2 | 2 | × | ○ | × | × | × | × | × |
| 3 | 3 | ○ | ○ | × | × | × | × | × |
| 4 | 4 | × | × | ○ | × | × | × | × |
| 4′ | 4′ | ○ | ○ | × | × | × | × | ○ |
| 5 | 5 | ○ | × | ○ | × | × | × | × |
| 6 | 6 | × | ○ | ○ | × | × | × | × |
| 7 | 7 | ○ | ○ | ○ | × | × | × | × |
| 8 | 8 | × | × | × | ○ | × | × | × |
| 8′ | 8′ | ○ | ○ | ○ | × | × | × | ○ |
| 9 | 9 | ○ | × | × | ○ | × | × | × |
| 10 | 10 | × | ○ | × | ○ | × | × | × |
| 11 | 11 | ○ | ○ | × | ○ | × | × | × |
| 12 | 12 | × | × | ○ | ○ | × | × | × |
| 12′ | 12′ | ○ | ○ | × | ○ | × | × | ○ |
| 13 | | ○ | × | ○ | ○ | × | × | × |
| 14 | 13 | × | ○ | ○ | ○ | × | × | × |
| 15 | | ○ | ○ | ○ | ○ | × | × | × |
| 16 | 14 | × | × | × | × | ○ | × | × |
| 16′ | 14′ | ○ | ○ | ○ | ○ | × | × | ○ |
| 17 | | ○ | × | × | × | ○ | × | × |
| 18 | 15 | × | ○ | × | × | ○ | × | × |
| 19 | | ○ | ○ | × | × | ○ | × | × |
| 20 | 16 | × | × | ○ | × | ○ | × | × |
| 20′ | 16′ | ○ | ○ | × | × | ○ | × | ○ |
| 21 | | ○ | × | ○ | × | ○ | × | × |
| 22 | 17 | × | ○ | ○ | × | ○ | × | × |
| 23 | | ○ | ○ | ○ | × | ○ | × | × |
| 24 | 18 | × | × | × | ○ | ○ | × | × |
| 24′ | 18′ | ○ | ○ | ○ | × | ○ | × | ○ |
| 25 | | ○ | × | × | ○ | ○ | × | × |
| 26 | 19 | × | ○ | × | ○ | ○ | × | × |
| 27 | | ○ | ○ | × | ○ | ○ | × | × |
| 28 | 20 | × | × | ○ | ○ | ○ | × | × |
| 20′ | 20′ | ○ | ○ | × | ○ | ○ | × | ○ |
| 29 | | ○ | × | ○ | ○ | ○ | × | × |
| 30 | 21 | × | ○ | ○ | ○ | ○ | × | × |
| 31 | | ○ | ○ | ○ | ○ | ○ | × | × |
| 32 | 22 | × | × | × | × | × | ○ | × |
| 32′ | 22′ | ○ | ○ | ○ | ○ | ○ | × | ○ |
| 33 | | ○ | × | × | × | × | ○ | × |
| 34 | | × | ○ | × | × | × | ○ | × |
| 35 | 23 | ○ | ○ | × | × | × | ○ | × |
| 36 | | × | × | ○ | × | × | ○ | × |
| 37 | | ○ | × | ○ | × | × | ○ | × |
| 38 | 24 | × | ○ | ○ | × | × | ○ | × |
| 39 | | ○ | ○ | ○ | × | × | ○ | × |
| 40 | | × | × | × | ○ | × | ○ | × |
| 41 | 25 | ○ | × | × | ○ | × | ○ | × |
| 42 | | × | ○ | × | ○ | × | ○ | × |
| 43 | | ○ | ○ | × | ○ | × | ○ | × |
| 44 | 26 | × | × | ○ | ○ | × | ○ | × |
| 44′ | 26′ | ○ | ○ | × | ○ | × | ○ | ○ |
| 45 | | ○ | × | ○ | ○ | × | ○ | × |
| 46 | | × | ○ | ○ | ○ | × | ○ | × |
| 47 | 27 | ○ | ○ | ○ | ○ | × | ○ | × |
| 48 | | × | × | × | × | ○ | ○ | × |
| 49 | | ○ | × | × | × | ○ | ○ | × |
| 50 | | × | ○ | × | × | ○ | ○ | × |
| 51 | 28 | ○ | ○ | × | × | ○ | ○ | × |
| 52 | | × | × | ○ | × | ○ | ○ | × |
| 53 | | ○ | × | ○ | × | ○ | ○ | × |
| 54 | | × | ○ | ○ | × | ○ | ○ | × |
| 55 | 29 | ○ | ○ | ○ | × | ○ | ○ | × |
| 56 | | × | × | × | ○ | ○ | ○ | × |
| 57 | | ○ | × | × | ○ | ○ | ○ | × |
| 58 | | × | ○ | × | ○ | ○ | ○ | × |
| 59 | 30 | ○ | ○ | × | ○ | ○ | ○ | × |
| 60 | | × | × | ○ | ○ | ○ | ○ | × |
| 61 | | ○ | × | ○ | ○ | ○ | ○ | × |
| 62 | | × | ○ | ○ | ○ | ○ | ○ | × |
| 63 | 31 | ○ | ○ | ○ | ○ | ○ | ○ | × |

FIG. 11

| Gray scale | Lighting period | SF1 | SF2 | SF3 | SF4 | SF5 | SF6 | SF7 | SF8 | SF9 | SF10 | SF11 |
|---|---|---|---|---|---|---|---|---|---|---|---|---|
| | | 8 | 8 | 8 | 8 | 8 | 8 | 8 | 1 | 2 | 4 | 1 |
| 6bit | 5bit | | | | | | | | | | | |
| 0 | 0 | × | × | × | × | × | × | × | × | × | × | × |
| 1 | 1 | × | × | × | × | × | × | × | ○ | × | × | × |
| 2 | 2 | × | × | × | × | × | × | × | × | ○ | × | × |
| 3 | 3 | × | × | × | × | × | × | × | ○ | ○ | × | × |
| 4 | 4 | × | × | × | × | × | × | × | × | × | ○ | × |
| 4′ | 4′ | × | × | × | × | × | × | × | ○ | ○ | × | ○ |
| 5 | 5 | × | × | × | × | × | × | × | ○ | × | ○ | × |
| 6 | 6 | × | × | × | × | × | × | × | × | ○ | ○ | × |
| 7 | 7 | × | × | × | × | × | × | × | ○ | ○ | ○ | × |
| 8 | 8 | ○ | × | × | × | × | × | × | × | × | × | × |
| 8′ | 8′ | × | × | × | × | × | × | × | ○ | ○ | ○ | ○ |
| 9 | 9 | ○ | × | × | × | × | × | × | ○ | × | × | × |
| 10 | 10 | ○ | × | × | × | × | × | × | × | ○ | × | × |
| 11 | 11 | ○ | × | × | × | × | × | × | ○ | ○ | × | × |
| 12 | 12 | ○ | × | × | × | × | × | × | × | × | ○ | × |
| 12′ | 12′ | ○ | × | × | × | × | × | × | ○ | ○ | × | ○ |
| 13 | | ○ | × | × | × | × | × | × | ○ | × | ○ | × |
| 14 | 13 | ○ | × | × | × | × | × | × | × | ○ | ○ | × |
| 15 | | ○ | × | × | × | × | × | × | ○ | ○ | ○ | × |
| 16 | 14 | ○ | ○ | × | × | × | × | × | × | × | × | × |
| 16′ | 14′ | ○ | × | × | × | × | × | × | ○ | ○ | ○ | ○ |
| 17 | | ○ | ○ | × | × | × | × | × | ○ | × | × | × |
| 18 | 15 | ○ | ○ | × | × | × | × | × | × | ○ | × | × |
| 19 | | ○ | ○ | × | × | × | × | × | ○ | ○ | × | × |
| 20 | 16 | ○ | ○ | × | × | × | × | × | × | × | ○ | × |
| 20′ | 16′ | ○ | ○ | × | × | × | × | × | ○ | ○ | × | ○ |
| 21 | | ○ | ○ | × | × | × | × | × | ○ | × | ○ | × |
| 22 | 17 | ○ | ○ | × | × | × | × | × | × | ○ | ○ | × |
| 23 | | ○ | ○ | × | × | × | × | × | ○ | ○ | ○ | × |
| 24 | 18 | ○ | ○ | ○ | × | × | × | × | × | × | × | × |
| 24′ | 18′ | ○ | ○ | × | × | × | × | × | ○ | ○ | ○ | ○ |
| 25 | | ○ | ○ | ○ | × | × | × | × | ○ | × | × | × |
| 26 | 19 | ○ | ○ | ○ | × | × | × | × | × | ○ | × | × |
| 27 | | ○ | ○ | ○ | × | × | × | × | ○ | ○ | × | × |
| 28 | 20 | ○ | ○ | ○ | × | × | × | × | × | × | ○ | × |
| 28′ | 20′ | ○ | ○ | ○ | × | × | × | × | ○ | ○ | × | ○ |
| 29 | | ○ | ○ | ○ | × | × | × | × | ○ | × | ○ | × |
| 30 | 21 | ○ | ○ | ○ | × | × | × | × | × | ○ | ○ | × |
| 31 | | ○ | ○ | ○ | × | × | × | × | ○ | ○ | ○ | × |
| 32 | 22 | ○ | ○ | ○ | ○ | × | × | × | × | × | × | × |
| 32′ | 22′ | ○ | ○ | ○ | × | × | × | × | ○ | ○ | ○ | ○ |
| 33 | | ○ | ○ | ○ | ○ | × | × | × | ○ | × | × | × |
| 34 | | ○ | ○ | ○ | ○ | × | × | × | × | ○ | × | × |
| 35 | 23 | ○ | ○ | ○ | ○ | × | × | × | ○ | ○ | × | × |
| 36 | | ○ | ○ | ○ | ○ | × | × | × | × | × | ○ | × |
| 37 | | ○ | ○ | ○ | ○ | × | × | × | ○ | × | ○ | × |
| 38 | 24 | ○ | ○ | ○ | ○ | × | × | × | × | ○ | ○ | × |
| 39 | | ○ | ○ | ○ | ○ | × | × | × | ○ | ○ | ○ | × |
| 40 | | ○ | ○ | ○ | ○ | ○ | × | × | × | × | × | × |
| 41 | 25 | ○ | ○ | ○ | ○ | ○ | × | × | ○ | × | × | × |
| 42 | | ○ | ○ | ○ | ○ | ○ | × | × | × | ○ | × | × |
| 43 | | ○ | ○ | ○ | ○ | ○ | × | × | ○ | ○ | × | × |
| 44 | 26 | ○ | ○ | ○ | ○ | ○ | × | × | × | × | ○ | × |
| 44′ | 26′ | ○ | ○ | ○ | ○ | ○ | × | × | ○ | ○ | × | ○ |
| 45 | | ○ | ○ | ○ | ○ | ○ | × | × | ○ | × | ○ | × |
| 46 | | ○ | ○ | ○ | ○ | ○ | × | × | × | ○ | ○ | × |
| 47 | 27 | ○ | ○ | ○ | ○ | ○ | × | × | ○ | ○ | ○ | × |
| 48 | | ○ | ○ | ○ | ○ | ○ | ○ | × | × | × | × | × |
| 49 | | ○ | ○ | ○ | ○ | ○ | ○ | × | ○ | × | × | × |
| 50 | | ○ | ○ | ○ | ○ | ○ | ○ | × | × | ○ | × | × |
| 51 | 28 | ○ | ○ | ○ | ○ | ○ | ○ | × | ○ | ○ | × | × |
| 52 | | ○ | ○ | ○ | ○ | ○ | ○ | × | × | × | ○ | × |
| 53 | | ○ | ○ | ○ | ○ | ○ | ○ | × | ○ | × | ○ | × |
| 54 | | ○ | ○ | ○ | ○ | ○ | ○ | × | × | ○ | ○ | × |
| 55 | 29 | ○ | ○ | ○ | ○ | ○ | ○ | × | ○ | ○ | ○ | × |
| 56 | | ○ | ○ | ○ | ○ | ○ | ○ | ○ | × | × | × | × |
| 57 | | ○ | ○ | ○ | ○ | ○ | ○ | ○ | ○ | × | × | × |
| 58 | | ○ | ○ | ○ | ○ | ○ | ○ | ○ | × | ○ | × | × |
| 59 | 30 | ○ | ○ | ○ | ○ | ○ | ○ | ○ | ○ | ○ | × | × |
| 60 | | ○ | ○ | ○ | ○ | ○ | ○ | ○ | × | × | ○ | × |
| 61 | | ○ | ○ | ○ | ○ | ○ | ○ | ○ | ○ | × | ○ | × |
| 62 | | ○ | ○ | ○ | ○ | ○ | ○ | ○ | × | ○ | ○ | × |
| 63 | 31 | ○ | ○ | ○ | ○ | ○ | ○ | ○ | ○ | ○ | ○ | × |

FIG. 12

| | | | | | | | | | | |
|---|---|---|---|---|---|---|---|---|---|---|
| 1 | SF1 | SF2 | SF3 | SF4 | SF5 | SF6 | SF7 | SF8 | SF9 | SF10 |
| 2 | SF8 | SF9 | SF10 | SF1 | SF2 | SF3 | SF4 | SF5 | SF6 | SF7 |
| 3 | SF1 | SF2 | SF3 | SF4 | SF8 | SF9 | SF10 | SF6 | SF7 | SF5 |
| 4 | SF1 | SF2 | SF8 | SF3 | SF4 | SF9 | SF5 | SF6 | SF10 | SF7 |
| 5 | SF1 | SF2 | SF9 | SF3 | SF4 | SF8 | SF5 | SF6 | SF10 | SF7 |
| 6 | SF1 | SF5 | SF8 | SF2 | SF7 | SF9 | SF3 | SF6 | SF10 | SF4 |
| 7 | SF1 | SF5 | SF9 | SF2 | SF7 | SF8 | SF3 | SF6 | SF10 | SF4 |
| 8 | SF1 | SF2 | SF8 | SF3 | SF9 | SF4 | SF5 | SF6 | SF10 | SF7 |
| 9 | SF1 | SF2 | SF3 | SF4 | SF8 | SF9 | SF5 | SF6 | SF7 | SF10 |

FIG. 32 (PRIOR ART)

| lighting period / gray scale | SF1 | SF2 | SF3 | SF4 | SF5 |
|---|---|---|---|---|---|
| | 1 | 2 | 4 | 8 | 16 |
| 0 | × | × | × | × | × |
| 1 | O | × | × | × | × |
| 2 | × | O | × | × | × |
| 3 | O | O | × | × | × |
| 4 | × | × | O | × | × |
| 5 | O | × | O | × | × |
| 6 | × | O | O | × | × |
| 7 | O | O | O | × | × |
| 8 | × | × | × | O | × |
| 9 | O | × | × | O | × |
| 10 | × | O | × | O | × |
| 11 | O | O | × | O | × |
| 12 | × | × | O | O | × |
| 13 | O | × | O | O | × |
| 14 | × | O | O | O | × |
| 15 | O | O | O | O | × |
| 16 | × | × | × | × | O |
| 17 | O | × | × | × | O |
| 18 | × | O | × | × | O |
| 19 | O | O | × | × | O |
| 20 | × | × | O | × | O |
| 21 | O | × | O | × | O |
| 22 | × | O | O | × | O |
| 23 | O | O | O | × | O |
| 24 | × | × | × | O | O |
| 25 | O | × | × | O | O |
| 26 | × | O | × | O | O |
| 27 | O | O | × | O | O |
| 28 | × | × | O | O | O |
| 29 | O | × | O | O | O |
| 30 | × | O | O | O | O |
| 31 | O | O | O | O | O |

O: lighting
×: non-lighting

DISPLAY DEVICE AND METHOD OF DRIVING THEREOF

BACKGROUND OF THE INVENTION

1. Field of the Invention

The present invention relates to a display device and a method of driving thereof, in particular, a display device using a time gray scale method, and a method of driving thereof.

2. Description of the Related Art

In recent years, research and development of an active matrix display device using digital video signals have been actively carried out. There are, for example, a light receiving display device like a liquid crystal display (LCD) and a self-light-emitting display device like a plasma display in such an active matrix display device. As a light-emitting element used for the self-light-emitting display device, an organic light-emitting diode (OLED) has been attracting attention. The OLED is also referred to as an organic EL element, an electro luminescence (EL) element, or the like (a display using an EL element is referred to as an EL display). The self-light-emitting display device using the OLED or the like has advantages such as higher visibility of pixels than that of a liquid crystal display, and fast response without requiring a backlight. The luminance of the light-emitting element is controlled by the value of a current flowing through the light-emitting element.

It is known that a time gray scale method is used as a method for displaying gray scales with the use of digital video signals in such an active matrix display device.

The time gray scale method is a method for displaying a gray scale by controlling the length of a light-emitting period or the frequency of light emission. In other words, one frame period is divided into a plurality of sub-frame periods, each of which is weighted with respect to the frequency of light emission and a light-emitting period, and then the total weight (the sum of the frequency of light emission and the sum of the light-emitting period) is differentiated in each gray scale, thereby displaying a gray scale. As an example, FIG. 31 shows a case where one frame is divided into five sub-frames SF1 to SF5 so that the ratio of lighting periods of these sub-frames is weighted to be $2^0:2^1:2^2:2^3:2^4$. In addition, FIG. 32 shows a relation between lighting/non-lighting selective patterns of these sub-frames and gray scales. Note that lighting is shown as ○, and non-lighting is shown as × in Figures. As apparent from FIGS. 31 and 32, by controlling lighting/non-lighting of the sub-frames SF1 to SF5, 32 gray scales of 0 to 31 can be displayed (a gray scale of 1 represents a minimum unit of gray scale change). Since 1 bit is necessary to order lighting/non-lighting of each sub-frame, a 5-bit digital signal is necessary to control the five sub-frames SF1 to SF5. In general, by controlling M sub-frames which are weighted in accordance with a binary number (power of 2) with the use of M-bit digital video signals, display of $2^M$ gray scales (that is, 0 to $2^M-1$) can be performed. Note that, in this specification, a time gray scale method for performing grays scale display by using a plurality of sub-frames where almost different weightings are performed in such a manner (typically, in accordance with a binary digit) is referred to as a binary code time gray scale method. A digital signal bit which controls a sub-frame that is weighted large (for example, SF5) is referred to as a high-order bit, and a digital signal bit which controls a sub-frame that is weighted small (for example, SF1) is referred to as a low-order bit. Note that the sub-frames may not necessarily be weighted in accordance with a binary number and not all sub-frames have to be weighted differently. The weighting (a lighting period or the frequency of flickering) of one sub-frame may be less than or equal to a value of the total weightings of the sub-frames of which weighting is smaller (that is, a lower-order weighting), to which 1 is added. For example, when the length ratio of a lighting period of each sub-frame is regarded as 1:1:2:3, all gray scales of from 0 to 7 can be displayed continuously.

In the display device using such a binary code time gray scale method, a pseudo contour may be perceived at a portion where the gray scale changes smoothly originally without generating a boundary, when displaying a moving image. It is known that a pseudo contour likely to be generated when pixels, of which lighting patterns differs largely like a case where one adjacent pixel has a gray scale of 15 and the other has a gray scale of 16, are adjacent to each other. In addition, a pseudo contour can be perceived also in a case where one of adjacent pixels has a gray scale of multiples of 4 (for example, 4, 8, or 16) and the other has a gray scale smaller by 1 (for example, 3, 7, or 15). In order to reduce such a pseudo contour, various countermeasures have been proposed (see References 1 to 8: Japanese Patent No. 2903984, Japanese Patent No. 3075335, Japanese Patent No. 2639311, Japanese Patent No. 3322809, Japanese Published Patent Application No. H10-307561, Japanese Patent No. 3585369, Japanese Patent No. 3489884, and Japanese Published Patent Application No. 2001-324958).

For example, Reference 2 discloses that 7 sub-frames having almost the same weighting (high-order sub-frames) is controlled with high-order 7 bits of a 12-bit digital signal that displays gray scales, and a plurality of sub-frames of which weightings are performed in accordance with a binary digit is controlled with the other 5 low-order bits, for example. Here, the seven high-order sub-frames are continuously provided in one frame period, and the high-order sub-frames are sequentially lighted cumulatively as the gray scales increase. In other words, the high-order sub-frames that are lighted with small gray scales are lighted also with large gray scales. Such a gray scale method is referred to as an overlapping time gray scale method. In other words, it can be said that Reference 2 discloses the combination of the overlapping time gray scale method using high-order bits and the binary code time gray scale method using low-order bits.

SUMMARY OF THE INVENTION

As described above, various methods for reducing pseudo contours have been proposed; however, the effect of reducing pseudo contours is not sufficient yet.

For example, FIG. 33 shows, with the use of the invention described in Reference 2 for displaying 32 gray scales, a case of displaying a gray scale of 15 and a gray scale of 16 in adjacent pixel A and pixel B, respectively. In FIG. 33, sub-frames SF1 to SF7 each have the same weighting (4), which is used for the overlapping time gray scale method, and sub-frames SF8 and SF9 each have a weighting in accordance with a binary number (1:2), which is used for the binary code time gray scale method (in this specification, such sub-frames are referred to as binary code sub-frames). As shown in FIG. 33, the sub-frames SF1 to SF3, SF8, and SF9 are lighted in the pixel A where a gray scale of 15 is displayed, and the sub-frames SF1 to SF4 are lighted in the pixel B where a gray scale of 16 is displayed. At this time, if eyes do not move from one pixel to the other pixel, a gray scale of 15 (4+4+4+1+2) is perceived in the pixel A, whereas a gray scale of 16 (4+4+4+4) is perceived in the pixel B; therefore, a pseudo contour is not generated.

On the other hand, it is assumed that eyes move from the pixel A to the pixel B or from the pixel B to the pixel A. Such a case is shown in FIG. 34. In this case, eyes sometimes sense the gray scale to be 12 (4+4+4), and sometimes sense the gray scale to be 19 (4+4+4+4+1+2) in accordance with eyes' movement. Originally, the eyes are expected to sense the gray scales to be 15 and 16; however, they sense the gray scales to be approximately 12 to 19. As a result, a pseudo contour is generated, despite the improvement thereof compared with the case of the binary code time gray scale method alone.

When the number of sub-frames that are used for the overlapping time gray scale method is increased and a lighting period of each sub-frame is shortened (that is, each weighting is made small), pseudo contours can be reduced. However, when the number of sub-frames is increased, the number of bits of a digital signal for controlling the sub-frames is also increased. Therefore, there is a problem that the size of a device gets larger, and a high frequency increase the power consumption.

In view of these problems, it is a main object of the present invention to provide a display device and a method of driving thereof that can reduce pseudo contours while suppressing the number of sub-frames as much as possible.

In order to solve the above problems, according to the present invention, a display device is provided, where one frame is divided into a plurality of sub-frames to display a gray scale, where the plurality of sub-frames have M (M is an integer number of greater than or equal to 2) regular sub-frames which are necessary for displaying predetermined gray scales and an N (N is a natural number) additive sub-frame; and where at least two sub-frame lighting patterns of a first sub-frame lighting pattern, where only the regular sub-frames are used, and a second sub-frame lighting pattern, where the additive sub-frames and the regular sub-frames are used, are provided at least for one gray scale of the predetermined gray scales.

The gray scale where the at least two sub-frame lighting patterns are provided may be a gray scale where a sub-frame lighting pattern changes largely between a gray scale in a case where the additive sub-frame is not used and the adjacent gray scale.

According to a preferred embodiment of the present invention, the M regular sub-frames can include r (r is an integer number that satisfies $2 \leq r \leq M$) binary code sub-frames which have a different weighting with each other and are used for a binary code time gray scale method, and the gray scale where the at least two sub-frame lighting patterns are provided can include a gray scale which is displayed only by a sub-frame of a largest weighting in a case where the additive sub-frame is not used. Here, a weighting refers to a relative luminance with respect to a sub-frame corresponding to a minimum luminance, which is determined by a lighting period or the frequency of flickering of each sub-frame. Note that weighting of the binary code sub-frames are preferably performed in accordance with a binary number; however, the sub-frames may not necessarily be weighted in accordance with a binary number. The weighting (a lighting period or the frequency of flickering) of one sub-frame may be less than or equal to a value of the total weightings of the sub-frames of which weighting is smaller (that is, a lower-order weighting), to which 1 is added. Accordingly, all gray scales can be displayed continuously.

According to another preferred embodiment of the present invention, the M regular sub-frames can include t (t is an integer number that satisfies $2 \leq t \leq M$) overlapping sub-frames which are used for an overlapping time gray scale method, and the gray scale where the at least two sub-frame lighting patterns are provided can include a gray scale where an overlapping sub-frame, which is lighted, is increased by one, as compared with a gray scale which is smaller by one, in a case where the additive sub-frame is not used. Accordingly, for example, in a case where t overlapping sub-frames each have a weighting of 4, one of the t sub-frames is additionally lighted as the gray scales are increased by four when the additive sub-frame is not used. Therefore, at least two sub-frame lighting patterns of a lighting pattern, where only the regular sub-frames are used, and a lighting pattern, where the additive sub-frames are used, are provided for the gray scales of multiples of 4. Note that the overlapping sub-frames have almost the same weightings in general; however, it is possible that the overlapping sub-frames have the different weightings.

According to a preferred embodiment of the present invention, the M regular sub-frames can include three sub-frames having weightings of 1, 2, and 4, and the gray scale where the at least two sub-frame lighting patterns are provided can include a gray scale of multiples of 4. The gray scale where the at least two sub-frame lighting patterns are provided can further include a gray scale of multiples of 4 to which 1 is added or a gray scale of multiples of 4 to which 2 is added. The at least two sub-frame lighting patterns can also be provided for all gray scales of greater than or equal to 4.

Preferably, at least one of the N additive sub-frames has a same weighting as that of a sub-frame having a minimum weighting in the M regular sub-frames.

In addition, the number N of the additive sub-frames can be greater than or equal to 2. In this case, the two or more additive sub-frames can include sub-frames of different weightings, and/or sub-frames of the same weightings.

Moreover, preferably, the display device is an EL display, a plasma display, a digital micromirror device (DMD), a field emission display (FED), a surface-conduction electron-emitter display (SED), or a ferroelectric liquid crystal display.

According to the present invention, a frame period has one or a plurality of additive sub-frames in addition to regular sub-frames for displaying desired gray scales, and a plurality of sub-frame lighting patterns is provided for a desired gray scale by using the additive sub-frames. Therefore, pseudo contours can be reduced by selectively switching the plurality of sub-frame lighting patterns depending on a gray scale of an adjacent pixel, or the like.

BRIEF DESCRIPTION OF DRAWINGS

In the accompanying drawing:

FIG. 1 is a diagram explaining a driving method of a display device based on a preferred embodiment of the present invention;

FIG. 2 is a diagram explaining a driving method of a display device based on a preferred embodiment of the present invention;

FIG. 3 is a diagram explaining a driving method of a display device based on a preferred embodiment of the present invention;

FIG. 4 is a diagram explaining a driving method of a display device based on a preferred embodiment of the present invention;

FIG. 5 is a diagram explaining a driving method of a display device based on a preferred embodiment of the present invention;

FIG. 6 is a diagram explaining a driving method of a display device based on a preferred embodiment of the present invention;

FIG. 7 is a diagram explaining a driving method of a display device based on a preferred embodiment of the present invention;

FIG. 8 is a diagram explaining a driving method of a display device based on a preferred embodiment of the present invention;

FIG. 9 is a diagram explaining a driving method of a display device based on a preferred embodiment of the present invention;

FIG. 10 is a diagram explaining a driving method of a display device based on a preferred embodiment of the present invention;

FIG. 11 is a diagram explaining a driving method of a display device based on a preferred embodiment of the present invention;

FIG. 12 is a diagram explaining a structure of a driving method of a display device of the present invention;

FIG. 32 is a diagram explaining a driving method of a conventional display device;

DETAILED DESCRIPTION OF THE INVENTION

Figure 13:
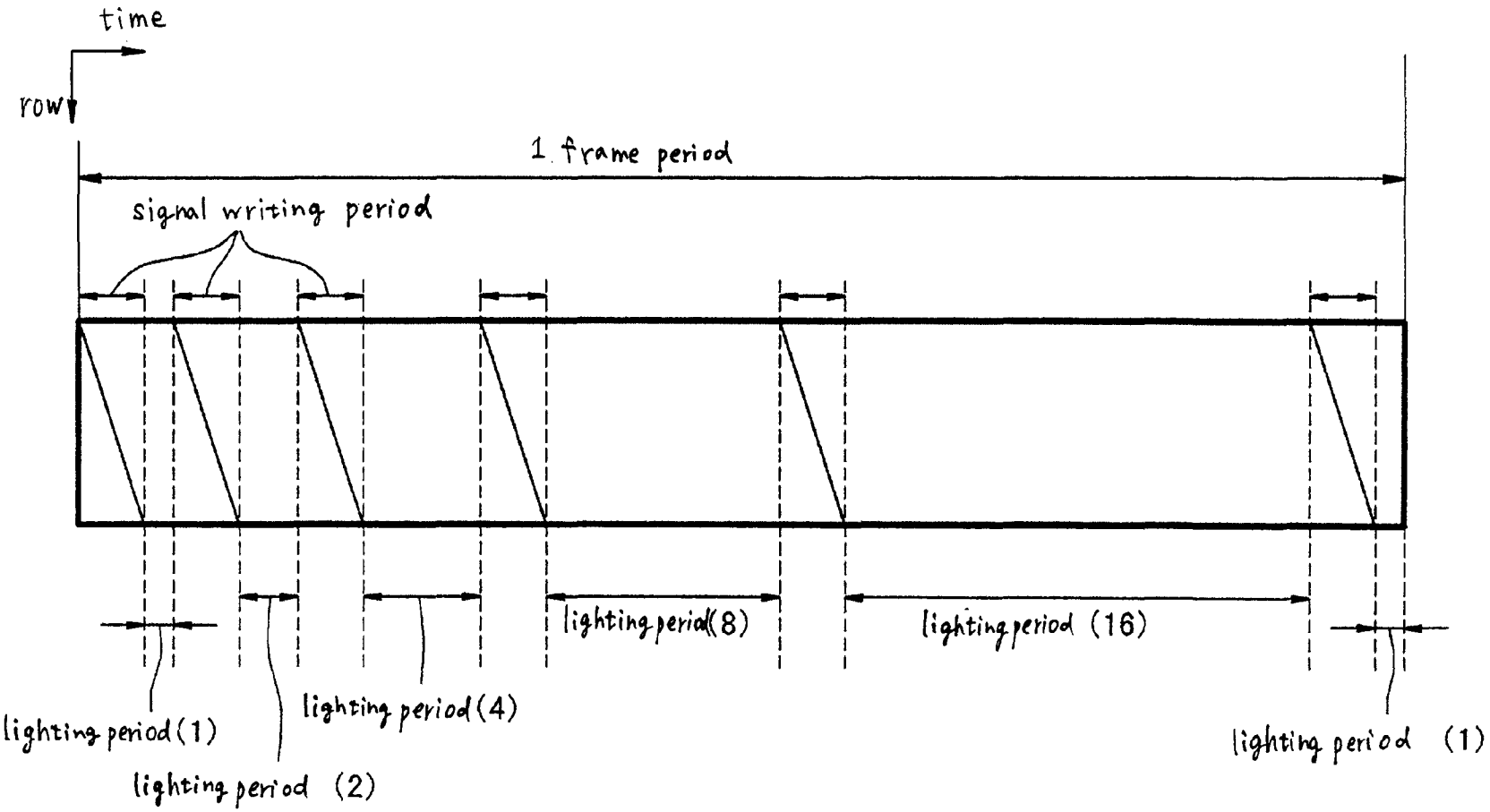
FIG. 13 is a diagram explaining a structure of a driving method of a display device of the present invention.

Embodiment modes of the present invention will be explained hereinafter with reference to the accompanying drawings. However, it is to be easily understood that various changes and modifications will be apparent to those skilled in the art. Therefore, unless such changes and modifications depart from the purport and the scope of the present invention, they should be construed as being included therein.

(Embodiment Mode 1)

FIG. 1 shows a diagram of a lighting pattern of a sub-frame based on a preferred embodiment of the present invention. As with a conventional example, this embodiment has five sub-frames SF1 to SF5 that each have a weighting in accordance with a binary number, with which 32 ($2^5$) gray scales of gray scales of 0 to 31 are displayed, and each of which is driven with a binary code time gray scale method. Such a sub-frame that is necessary for displaying a predetermined gray scale is referred to as a regular sub-frame. In an embodiment of FIG. 1, it is necessary to light all of the regular sub-frames SF1 to SF5 in displaying the maximum gray scale of 31 among predetermined gray scales. As with a conventional example, also in the embodiment of FIG. 1, various gray scales can be displayed by selectively lighting the regular sub-frames SF1 to SF5. Note that the lighting order of the regular sub-frames in one frame can take various modes, that is, the order may be from a small weighting to a large weighting, or the reverse; random; or may be changed per one frame. For example, the sub-frame SF5 having the maximum weighting may be divided into two or more, and the divided sub-frames may be provided apart from each other within one frame period (see Reference 1: Japanese Patent No.: 2903984).

According to the present invention, an additive sub-frame SF6 is provided in addition to the regular sub-frames SF1 to SF5, and consequently, one frame includes the six sub-frames. Since a bit for driving the additive sub-frame SF6 (an additive bit) is necessary in addition to five bits for driving the regular sub-frames SF1 to SF5, a digital signal that defines a luminance in one frame of each pixel is 6 bits. Note that the number of the regular sub-frames is not limited to five and M (M is an integer number of greater than or equal to 2) regular sub-frames can be included. In addition, the number of the additive sub-frames is not limited to one and N (N is an arbitrary natural number) additive sub-frame can be included. In the embodiment of FIG. 1, the additive sub-frame SF6 has the same weighting (1) as that of the sub-frame SF1 having the minimum weighting (1) among the regular sub-frames. Accordingly, gray scales of multiples of 4 (that is, gray scales of 4, 8, 12, 16, 20, 24, and 28) can each set a sub-frame lighting pattern which is similar to a lighting pattern of a sub-frame which is smaller by one gray scale by using the additive sub-frame SF6. For example, a gray scale of 4 can be displayed by two sub-frame lighting patterns: a sub-frame lighting pattern (4), where only the sub-frame SF3 is lighted without lighting the additive sub-frame SF6, and a sub-frame lighting pattern (4'), where the sub-frames SF1, SF2, and the additive sub-frame SF6 are lighted with the SF6 lighted. Here, the sub-frame lighting pattern (4') using the additive sub-frame SF6 is similar to a sub-frame lighting pattern of a gray scale of 3 which is smaller by one gray scale. A gray scale of 8 can be displayed by two sub-frame lighting patters: a sub-frame lighting pattern (8), where only the sub-frame SF4 is lighted without lighting the additive sub-frame SF6, and a sub-frame lighting pattern (8'), where the sub-frames SF1, SF2, SF3, and the additive sub-frame SF6 are lighted with the SF6 lighted. Here, the sub-frame lighting pattern (8') using the additive sub-frame SF6 is similar to a sub-frame lighting pattern of a gray scale of 7 which is smaller by one gray scale. The same can be said for other gray scales of multiples of 4.

Accordingly, for example, in a case where a certain pixel A displays a gray scale of 16 when a certain pixel B adjacent to the pixel A displays a gray scale of 15 (the sub-frames SF1 to SF4 are lighted), as the sub-frames SF1 to SF4 and the additive sub-frame SF6 are lighted by using the additive sub-frame SF6 (that is, regarded as a lighting pattern 16'), a sub-frame lighting pattern similar to that of the gray scale of 15 is obtained; therefore, pseudo contours can be reduced. Similarly, as with other gray scales where two lighting patterns are provided, pseudo contours can be reduced by selecting a sub-frame lighting pattern depending on a gray scale of an adjacent pixel.

Note that, this embodiment mode is provided with the sub-frame lighting pattern using the additive sub-frame SF6 for each of a plurality of gray scales of multiples of 4 (4, 8, 12, 16, 20, 24, and 28). However, the sub-frame lighting pattern using the additive sub-frame SF6 may be provided only for a gray scale of 16 which is most likely to generate a pseudo contour (in general, a gray scale displayed by lighting only the regular sub-frame having the largest weighting in a case where the additive sub-frame is not used); thus, a predetermined effect of reducing pseudo contours can be obtained.

According to the present invention in such a manner, an N (one in the embodiment of FIG. 1) additive sub-frame is provided in addition to M (five in the embodiment of FIG. 1) regular sub-frames which are necessary for displaying predetermined gray scales; and at least two sub-frame lighting patterns of a first sub-frame lighting pattern using only the regular sub-frame and a second sub-frame lighting pattern using the additive sub-frame and the regular sub-frames are provided for at least one gray scale within predetermined gray scales, which are selectively used. Therefore, for example, one of the plurality of sub-frame lighting patterns can be selectively used so as to reduce pseudo contours as much as possible depending on a luminance of an adjacent pixel; thus, a profound effect of reducing pseudo contours can be obtained. The number of the sub-frames can be prevented from extremely increasing by reducing the number of the additive sub-frames to like 1 bit or 2 bits. Note that the sub-frame lighting pattern using only the regular sub-frame implies a sub-frame lighting pattern without lighting the additive sub-frame, and the sub-frame lighting pattern using the additive sub-frame and the regular sub-frame implies a sub-frame lighting pattern where at least one of the additive sub-frames and at least one of the regular sub-frames are lighted.

FIG. 2 shows another embodiment of a driving method of a display device using an additive sub-frame based on the present invention. The embodiment of FIG. 2 has six regular sub-frames SF1 to SF6 that each have a weighting in accordance with a binary number, with which 64 ($2^6$) gray scales of gray scales of 0 to 63 are displayed, and each of which is driven with a binary code time gray scale method; and one additive sub-frame SF7 having a weighting of 1. In this embodiment mode, gray scales of 4 ($2^2$), 8 ($2^3$), 16 ($2^4$), and 32 ($2^5$) are each provided with two sub-frame lighting patterns of a sub-frame lighting pattern using only the regular sub-frame and a sub-frame lighting pattern using the additive sub-frame and the regular sub-frames. Accordingly, in a case of displaying these gray scales in certain pixels, pseudo contours can be reduced by selecting the sub-frame lighting pattern depending on a gray scale of an adjacent pixel, for example. Note that, in general, when M regular sub-frames each have a weighting in accordance with a binary number and r (r and M are natural numbers that satisfy $2 \leq r \leq M$, and $r=M=6$ is set in the embodiment of FIG. 2) binary code sub-frames used for a binary code time gray scale method, a gray scale of $2^S$ (s is a natural number that satisfies $2 \leq s < r$) may be provided with at least the two sub-frame lighting pattern of the sub-frame lighting pattern using only the regular sub-frame and the sub-frame lighting pattern using the additive sub-frame and the regular sub-frames. Note that, also in the embodiment of FIG. 2, as with the embodiment of FIG. 1, naturally, it is also possible to provide gray scales of multiples of 4 with the two sub-frame lighting pattern of the sub-frame lighting pattern using only the regular sub-frame and the sub-frame lighting pattern using the additive sub-frame and the regular sub-frames.

FIG. 3 shows another embodiment of a driving method of a display device using an additive sub-frame based on the present invention. The embodiment of FIG. 3 is different from the embodiment of FIG. 1 in that two sub-frames SF6 and SF7 each having a weighting of 1 are used as additive sub-frames. In other words, in the embodiment of FIG. 3, the number N of additive sub-frames=2 is set. In such a manner, the number of additive sub-frames is not limited to 1. As shown in FIG. 3, in addition to gray scales of 4, 8, 12, 16, 20, 24, and 28, two sub-frame lighting patterns are allocated: a case where the additive sub-frames SF6 and SF7 are not used for each of gray scales of 5, 9, 13, 17, 21, 25, and 29 (that is 5, 9, 13, 17, 21, 25, and 29); and a case where the additive sub-frame SF6 and/or the additive sub-frame SF7 is used (that is 5', 9', 13', 17', 21', 25', and 29'). In general, the two sub-frame lighting patterns can be allocated for gray scales of multiples of 4 and gray scales of multiples of 4+1. Accordingly, for example, in a case where a certain pixel A displays a gray scale of 16 (or 17) when a certain pixel B adjacent to the pixel A displays a gray scale of 15 (gray scales of SF1 to SF4 are lighted), as the sub-frames SF1 to SF4 and the additive sub-frame SF6 (or the SF1 to SF4, SF6, and SF7) are lighted by using the additive sub-frame SF6, a sub-frame lighting pattern similar to that of the gray scale of 15 is obtained; therefore, pseudo contours can be reduced. In the embodiment of FIG. 3, the additive sub-frames SF6 and SF7 each have the same weighting and an overlapping time gray scale method is used (for example, as compared with a gray scale of 4' and a gray scale of 5', the additive sub-frame SF6 is lighted at the gray scale of 4' and the additive sub-frame SF7 is additionally lighted at the gray scale of 5', and consequently both the additive sub-frames SF6 and SF7 are lighted). Accordingly, pseudo contours due to these additive sub-frames are unlikely to be generated.

FIG. 4 shows another embodiment of a driving method of a display device using an additive sub-frame based on the present invention. In the embodiment of FIG. 4, a sub-frame SF6 having a weighting of 1 and a sub-frame SF7 having a weighting of 2 are used as additive sub-frames. In such a case of having a plurality of additive sub-frames, weightings thereof may be different. In such a case where the weightings of additive sub-frames are different, by combining the weightings, a large gray scale can be displayed with a few additive sub-frames (for example, since the two additive sub-frames have the same weighting of 1 in the embodiment of FIG. 3, three gray scales of 0, 1, and 2 can be displayed by the combination of these two additive sub-frames. However, since the two additive sub-frames have the different weightings of 1 and 2 in the embodiment of FIG. 4, four gray scales of 0, 1, 2, and 3 can be displayed by the combination of these two additive sub-frames.). As shown in FIG. 4, two sub-frame lighting patterns are allocated: a case where the additive sub-frames SF6 and SF7 are not used for each of gray scales of 4 to 6, 8 to 10, 12 to 14, 16 to 18, 20 to 22, 24 to 26, and 28 to 30 (that is 4 to 6, 8 to 10, 12 to 14, 16 to 18, 20 to 22, 24 to 26, and 28 to 30); and a case where the additive sub-frame SF6 and/or the additive sub-frame SF7 is used (that is 4' to 6', 8' to 10', 12' to 14', 16' to 18', 20' to 22', 24' to 26', and 28' to 30'). In general, the two sub-frame lighting patterns can be allocated for gray scales of multiples of 4, gray scales of multiples of 4+1, and gray scales of multiples of 4+2. Also in this case of displaying a gray scale having these two sub-frame lighting patterns in certain pixels, pseudo contours can be reduced by selecting the appropriate sub-frame lighting pattern in accordance with a sub-frame lighting pattern of an adjacent pixel.

FIG. 5 shows another embodiment of a driving method of a display device using an additive sub-frame based on the present invention. In the embodiment of FIG. 5, a sub-frame SF6 having a weighting of 1, a sub-frame SF7 having a weighting of 2, and a sub-frame SF8 having a weighting of 3 are used as additive sub-frames. In a case of having N (N is a natural number) additive sub-frames in general, the weightings of these sub-frames can be set as 1, 2, 3, . . . , and N. Since the embodiment of FIG. 5 has the three additive sub-frames SF6, SF7, and SF8 each having the weightings of 1, 2, and 3, eight gray scales of 0 to 7 can be displayed by combining these three additive sub-frames. As shown in FIG. 5, two sub-frame lighting patterns are allocated: a case where the additive sub-frames SF6, SF7, and SF8 are not used for each of gray scales of 4 to 31 (that is 4 to 31); and a case where the additive sub-frame SF6, the additive sub-frame SF7, and/or the additive sub-frame SF8 is used (that is 4' to 31'). In general, at least the two sub-frame lighting patterns can be allocated for each gray scale. Also in the embodiment of FIG. 5, in a case of displaying a gray scale having the two sub-frame lighting patterns in certain pixels, pseudo contours can be reduced by selecting the appropriate sub-frame lighting pattern in accordance with a sub-frame lighting pattern of an adjacent pixel.

Note that, in a case of having a plurality of additive sub-frames, weighting patters thereof are not limited to this embodiment mode and other patterns can also be applied. For example, in a case of having N additive sub-frames, weightings thereof may be one in accordance with a binary number like 1, 2, 4, 8, . . . , or $2^{N-1}$. Alternatively, the sub-frames, the number of which is arbitrary, of N additive sub-frames can each have a weighting of 1 like 1, 2, 2, 2, . . . ; 1, 1, 2, 2, 2, . . . ; or 1, 1 2, 2, 2, . . . , and the other additive sub-frames can each have a weighting of 2.

In addition, a sub-frame lighting pattern using an additive sub-frame is not limited to this embodiment mode. For example, in the embodiment of FIG. 3, the sub-frame lighting pattern using the additive sub-frame SF6 or SF7 is provided for each of gray scales 4, 5, 8, 9 12, 13, 16, 17, 20, 21, 24, 25, 28, and 29. However, the sub-frame lighting pattern using the additive sub-frames can be provided also for a gray scale other than the one shown in this embodiment mode like a case of displaying a gray scale of 3 by lighting the sub-frames SF1, SF6, and SF7, for example. Moreover, for example, in the embodiment of FIG. 3, total three sub-frame lighting patterns can also be provided when a gray scale is 4 by additionally providing a sub-frame lighting pattern that lights the sub-frames SF2, SF6, and SF7 for the gray scale of 4. In such a manner, the number of different sub-frame lighting patterns that can be allocated for a certain gray scale is not limited to 2. Further, as described above, a sub-frame lighting pattern of a gray scale having a plurality (two in the this embodiment mode) of sub-frame lighting patterns can be changed by each row, column, pixel, frame, or the like. Furthermore, a lighting position of an additive sub-frame in one frame may be the back, front, or middle of a regular sub-frame, or anywhere.

In this embodiment mode, the regular sub-frames SF1 to SF5 each has a weighting (a lighting period or the frequency of lighting) in accordance with a binary number, which is used for a binary code time gray scale method. However, the present invention can also be applied effectively in a case where some sub-frames are used for an overlapping time gray scale method. FIG. 6 shows such a preferred embodiment of the present invention.

The embodiment of FIG. 6 has seven sub-frames SF1 to SF7 each having the same weighting (4) and two sub-frames SF8 and SF9 having weightings (1 and 2) each in accordance with a binary number as regular sub-frames. The high-order seven sub-frames SF1 to SF7 are used for overlapping time gray scales (these are referred to as overlapping sub-frames). In other words, as gray scales increase by 4, the sub-frames are sequentially lighted cumulatively like SF1, SF2, SF3, . . . . The low-order two sub-frames are used for binary code time gray scales. Accordingly, 32 gray scales of 0 to 31 can be displayed by changing a lighting pattern of the regular sub-frames SF1 to SF9.

Further, the embodiment of FIG. 6 has an additive sub-frame SF10 having a weighting of 1 as an additive sub-frame. Accordingly, two sub-frame lighting patterns are allocated in gray scales of 4, 8, 12, 16, 20, 24, and 28 (that is, a gray scale where an overlapping sub-frame, which is lighted, is increased by 1, as compared with a gray scale which is smaller by one gray scale, in a case where the additive sub-frame SF10 is not used.): a case without using the additive sub-frame SF10 (that is 4, 8, 12, 16, 20, 24, and 28); and a case using the additive sub-frame SF 10 (that is 4', 8', 12', 16', 20', 24', and 28'). Accordingly, in a case of displaying a gray scale having a plurality of sub-frame lighting patterns (two in this example) in certain pixels, pseudo contours can be reduced by selecting the sub-frame lighting pattern in accordance with a sub-frame lighting pattern of an adjacent pixel. For example, in a case where a certain pixel A displays a gray scale of 16 when a certain pixel B adjacent to the pixel A displays a gray scale of 15 (the sub-frames SF1 to SF3, SF8, and SF9 are lighted), as the sub-frames SF1 to SF3, SF8, SF9, and the additive sub-frame SF10 are lighted by using the additive sub-frame SF10 (that is, regarded as a lighting pattern 16'), a sub-frame lighting pattern similar to that of the gray scale of 15 is obtained; therefore, pseudo contours can be reduced.

In general, in a case where M (M=9 is set in the embodiment of FIG. 6) regular sub-frames have t (t is an integer number that satisfies $2 \leq t < M$, and t=7 is set in the embodiment of FIG. 6) sub-frames (overlapping sub-frames) which are used for an overlapping time gray scale method, as described above, pseudo contours are likely to be generated in a gray scale where an overlapping sub-frame, which is lighted, is increased by 1, as compared with a gray scale which is smaller by one gray scale, in a case where the additive sub-frame is not used. Therefore, at least two sub-frame lighting patterns of a sub-frame lighting pattern using only the regular sub-frames and a sub-frame lighting pattern using the additive sub-frame and the regular sub-frames may be provided for such a gray scale. Accordingly, pseudo contours can be reduced by selectively switching at least the two sub-frame lighting patterns.

FIG. 7 shows further another preferred embodiment of the present invention. The embodiment of FIG. 7 is different from the embodiment of FIG. 6 in that two sub-frames SF10 and SF11 each having a weighting of 1 are used as additive sub-frames. In other words, in the embodiment of FIG. 7, the number N of additive sub-frames=2 is set. As shown in FIG. 7, two sub-frame lighting patterns are allocated: a case where the additive sub-frames SF10 and SF11 are not used for each of gray scales of 5, 9, 13, 17, 21, 25, and 29 (that is 5, 9, 13, 17, 21, 25, and 29) in addition to gray scales of 4, 8, 12, 16, 20, 24, and 28; and a case where the additive sub-frame SF10 and/or the additive sub-frame SF11 is used (that is 5', 9', 13', 17', 21', 25', and 29'). Accordingly, for example, in a case where a certain pixel A displays a gray scale of 16 (or 17) when a certain pixel B adjacent to the pixel A displays a gray scale of 15 (gray scales of SF1 to SF3, SF8, and SF9 are lighted), as the sub-frames SF1 to SF3 and the additive sub-frame SF10 (or the SF1 to SF3, SF10, and SF11) are lighted by using the additive sub-frames SF10 and SF11, a sub-frame lighting pattern similar to that of the gray scale of 15 is obtained; therefore, pseudo contours can be reduced. In addition, in the embodiment of FIG. 7, the additive sub-frames SF10 and SF11 each have the same weighting, and an overlapping time gray scale method is used (for example, as compared with a gray scale of 4' and a gray scale of 5', the additive sub-frame SF10 is lighted at the gray scale of 4' and the additive sub-frame SF11 is additionally lighted at the gray scale of 5', and consequently both the additive sub-frames SF10 and SF11 are lighted). Accordingly, pseudo contours due to these additive sub-frames are unlikely to be generated.

FIG. 8 shows further another preferred embodiment of the present invention. In the embodiment of FIG. 8, a sub-frame SF10 having a weighting of 1 and a sub-frame SF11 having a weighting of 2 are used as additive sub-frames. In such a case of having a plurality of additive sub-frames, weightings thereof may be different. In such a case where the weightings of additive sub-frames are different, a large gray scale can be displayed with a few additive sub-frames. As shown in FIG. 8, two sub-frame lighting patterns are allocated: a case where the additive sub-frames SF10 and SF11 are not used for each of gray scales of 4 to 6, 8 to 10, 12 to 14, 16 to 18, 20 to 22, 24 to 26, and 28 to 30 (that is 4 to 6, 8 to 10, 12 to 14, 16 to 18, 20 to 22, 24 to 26, and 28 to 30); and a case where the additive sub-frame SF10 and/or the additive sub-frame SF11 is used (that is 4' to 6', 8' to 10', 12' to 14', 16' to 18', 20' to 22', 24' to 26', and 28' to 30'). Also in this case of displaying a gray scale having these two sub-frame lighting patterns in certain pixels, pseudo contours can be reduced by selecting the appropriate sub-frame lighting pattern in accordance with a sub-frame lighting pattern of an adjacent pixel. Note that, also in a case of applying the present invention to an overlapping time gray scale method, the number of additive sub-frames is not limited to 1 or 2, and as described above, it is possible to have various patterns of weightings in a case of having a plurality of additive sub-frames besides those shown in FIGS. 8 and 9.

FIG. 9 shows further another preferred embodiment of the present invention. The embodiment of FIG. 9 is different from the embodiment of FIG. 6 in that there are four sub-frames SF8 to SF11 each having the same weighting (1) as low-order sub-frames, and an overlapping time gray scale method is used also for the low-order sub-frames (or low-order bits). As shown in FIG. 9, also in the embodiment of FIG. 9, two sub-frame lighting patterns are allocated in gray scales of 4, 8, 12, 16, 20, 24, and 28 (that is, multiples of 4 which is the weightings of the high-order overlapping sub-frames SF1 to SF7): a case without using additive sub-frames SF8 to SF11 (that is 4, 8, 12, 16, 20, 24, and 28) and a case using the additive sub-frames SF8 to SF11 (that is 4', 8', 12', 16', 20', 24', and 28'), and the embodiment of FIG. 9 has the same effect as the embodiment of FIG. 6.

As described above, according to the present invention, there is one or a plurality of additive sub-frames in addition to a regular sub-frame which is necessary for displaying a desired gray scale, and desired gray scales can be displayed with a plurality of sub-frame lighting patterns by using the additive sub-frames. Therefore, pseudo contours can be reduced by selectively switching the plurality of sub-frame lighting patterns depending on a gray scale of an adjacent pixel, or the like.

The above description is made on the case where a light-emitting period increases in linear proportion to a gray scale. Thus, next, description will be made on an embodiment applying the present invention to a case where a gamma correction is performed. The gamma correction is performed so that a light-emitting period increases nonlinearly as a gray scale increases. Even when a luminance increases in linear proportion, human eyes cannot sense that luminance increases in proportion. As a luminance increases, the difference of brightness is less visible to human eyes. Therefore, in order that the difference of brightness is visible to human eyes, it is required that a light-emitting period increases as a gray scale increases, that is, a gamma correction is performed.

As the simplest method, a larger number of bits (gray scales) than the number of bits (gray scales) to be actually displayed are prepared. For example, when 6 bits (64 gray scales) are displayed, 8 bits (256 gray scales) are actually prepared to be displayed. When actually performing the display, 6 bits (64 gray scales) are displayed so that the luminance of a gray scale has a non-linear shape. Accordingly, a gamma correction can be achieved.

As an example, FIGS. 10 and 11 each show a selecting method of sub-frames in the case where 5 bits (32 gray scales) are displayed by performing a gamma correction, while 6 bits (64 gray scales) are prepared to be displayed. An embodiment of FIG. 10 has sub-frames SF1 to SF6 each having a weighting in accordance with a binary number as regular sub-frames, which are capable of displaying 64 ($2^6$) gray scales of gray scales of 0 to 63 in 6-bit display by selectively lighting these sub-frames SF1 to SF6. An embodiment of FIG. 11 has seven high-order sub-frames SF1 to SF7 each having a weighting of 8 and three low-order sub-frames SF8 to SF10 having each of weightings in accordance with binary numbers (1, 2, and 4) as regular sub-frames, which are capable of displaying 64 ($2^6$) gray scales of gray scales of 0 to 63 by selectively lighting these sub-frames SF1 to SF10. By allocating these gray scales of 0 to 63 of 6-bit display for gray scales of 0 to 31 of 5-bit display, a gamma correction can be achieved in the 5-bit display. In other words, in FIGS. 10 and 11, gray scales of 0 to 12 in 5 bits are the same as those in 6 bits. However, as for a gray scale of 13 in 5 bits, to which a gamma correction has been performed, lighting is actually performed using a selecting method of sub-frames in a case of a gray scale of 14 in 6 bits. In the same manner, as for a gray scale of 14 in 5 bits, to which a gamma correction has been performed, a gray scale of 16 in 6 bits is actually displayed. As for a gray scale of 15 in 5 bits, to which a gamma correction has been performed, a gray scale of 18 in 6 bits is actually displayed. Thus, display may be performed depending on a table in which gray scales in 5 bits, to which a gamma correction has been performed, are related to gray scales in 6 bits. Accordingly, a gamma correction can be achieved.

Note that the table in which gray scales in 5 bits, to which a gamma correction is performed, are related to gray scales in 6 bits can be changed appropriately. Accordingly, by changing the table, the level of a gamma correction can be easily changed.

Moreover, the number of bits (for example, p bits, and p is a natural number here) prepared to be displayed and the number of bits (for example, q bits, and q is a natural number here) to be displayed after a gamma correction are not limited thereto. In the case where display is performed after a gamma correction, the number of bits p is desirably set as large as possible to display gray scales smoothly. Note that, when the number of p bits is too large, the number of p bits may adversely affect such that the number of sub-frames is too large. Therefore, a relation between the number of bits q and the number of bits p is desirably set to $q+2 \leq p \leq q+5$. Consequently, gray scales can be displayed smoothly without increasing the number of sub-frames too much.

Based on the present invention, the embodiment of FIG. 10 is provided with an additive sub-frame SF7 having a weighting of 1, and a sub-frame lighting pattern for lighting the additive sub-frame SF7 is provided for gray scales where one of 6 bits, which is multiples of 4, is in relation to one of 5 bits (that is, 5-bit gray scales of 4, 8, 12, 14, 16, 18, 20, 22 and 26). In addition, based on the present invention, the embodiment of FIG. 11 is provided with an additive sub-frame SF11 having a weighting of 1, and a sub-frame lighting pattern for lighting the additive sub-frame SF11 is provided for gray scales where one of 6 bits, which is multiples of 4, is in relation to one of 5 bits (that is, 6-bit gray scales of 4, 8, 12, 14, 16, 18, 20, 22 and 26). Accordingly, in a case of displaying these gray scales in certain pixels, pseudo contours can be reduced by appropriately selecting the sub-frame lighting pattern. In such a manner, the present invention can also be applied to the case where a gamma correction is performed.

The above description is made on the displaying method of gray scales, that is, the selecting method of sub-frames. Next, description will be made on the order that a sub-frame appears.

As an example, as for the case of FIG. 6, FIG. 12 shows pattern examples of the orders that sub-frames appear. Note that, in FIG. 12, the regular sub-frames SF8 and SF9 using a binary code time gray scale method, and the additive sub-frame SF10 are shown in shaded regions.

As a first pattern, sub-frames appear in the order of SF1, SF2, SF3, SF4, SF5, SF6, SF7, SF8, SF9, and SF10. The regular sub-frames SF8 and SF9 using a binary code time gray scale method, and the additive sub-frame SF10 are arranged adjacently at the end of one frame.

As a second pattern, sub-frames appear in the order of SF8, SF9, SF10, SF1, SF2, SF3, SF4, SF5, SF6, and SF7. The regular sub-frames SF8 and SF9 using a binary code time gray scale method, and the additive sub-frame SF10 are arranged adjacently at the top of one frame.

As a third pattern, sub-frames appear in the order of SF1, SF2, SF3, SF4, SF8, SF9, SF10, SF6, SF7, and SF5. The regular sub-frames SF8 and SF9 using a binary code time gray scale method, and the additive sub-frame SF10 are arranged adjacently in the middle of one frame.

As a fourth pattern, sub-frames appear in the order of SF1, SF2, SF8, SF3, SF4, SF9, SF5, SF6, SF10, and SF7. The regular sub-frames SF1 to SF7 using an overlapping time gray scale method are sequentially arranged. The regular sub-frames SF8 and SF9 using a binary code time gray scale method, and the additive sub-frame SF10 are also sequentially arranged. After two regular sub-frames using an overlapping time gray scale method are arranged, one regular sub-frame using a binary code time gray scale method or additive sub-frame is arranged.

As a fifth pattern, sub-frames appear in the order of SF1, SF2, SF9, SF3, SF4, SF8, SF5, SF6, SF10, and SF7. This pattern corresponds to the fourth pattern, where the regular sub-frames using a binary code time gray scale method and the additive sub-frame are arranged at random.

As a sixth pattern, sub-frames appear in the order of SF1, SF5, SF8, SF2, SF7, SF9, SF3, SF6, SF10, and SF4. This pattern corresponds to the fourth pattern, where the regular sub-frames using an overlapping time gray scale method are arranged at random.

As a seventh pattern, sub-frames appear in the order of SF1, SF5, SF9, SF2, SF7, SF8, SF3, SF6, SF10, and SF4. This pattern corresponds to the fourth pattern, where the regular sub-frames using an overlapping time gray scale method, the regular sub-frames using a binary code time gray scale method, and the additive sub-frame are arranged at random.

As an eighth pattern, sub-frames appear in the order of SF1, SF2, SF8, SF3, SF9, SF4, SF5, SF6, SF10, and SF7. In this pattern, after two regular sub-frames using an overlapping time gray scale method are arranged, one regular sub-frame using a binary code time gray scale method is arranged, one regular sub-frame using an overlapping time gray scale method is arranged, one regular sub-frame using a binary code time gray scale method is arranged, three regular sub-frames using an overlapping time gray scale method are arranged, one additive sub-frame is arranged, and one regular sub-frame using an overlapping time gray scale method is arranged.

As a ninth pattern, sub-frames appear in the order of SF1, SF2, SF3, SF4, SF8, SF9, SF5, SF6, SF7, and SF10. In this pattern, after four regular sub-frames using an overlapping time gray scale method are arranged, two regular sub-frames using a binary code time gray scale method are arranged, three regular sub-frames using an overlapping time gray scale method are arranged, and one additive sub-frame is arranged.

In such a manner, it is desirable to arrange the regular sub-frames using a binary code time gray scale method and the additive sub-frame among the regular sub-frames using an overlapping time gray scale method so that the sub-frames are evenly arranged. Consequently, pseudo contours can be reduced because of trick of eyesight.

Note that the order in which sub-frames appear may be changed depending on time. For example, the order in which sub-frames appear may be changed between the first frame and the second frame. In addition, the order in which sub-frames appear may be changed depending on place. For example, the order in which sub-frames appear may be changed between the pixel A and the pixel B. Moreover, the order in which sub-frames appear may be changed depending on time and place by combining these.

Note that, although a frame frequency of 60 Hz is generally used, the present invention is not limited thereto. Pseudo contours may be reduced by further increasing the frame frequency. For example, a display device may be operated at approximately 120 Hz that is twice as high as the normal frequency.

(Embodiment Mode 2)

In this embodiment mode, an example of a timing chart will be described. Although FIG. 1 is used as an example of a selecting method of sub-frames, the present invention is not limited thereto, and can easily be applied to other selecting method of sub-frames, other numbers of gray scales, or the like.

In addition, although the order in which sub-frames appear is SF1, SF2, SF3, SF4, SF5, and SF6 as an example, the present invention is not limited thereto and can easily be applied to other orders.

FIG. 13 shows a timing chart in a case where a period where signals are written to a pixel and a period where light is emitted are separated. First, signals for one screen are inputted to all pixels in a signal-writing period. During this period, pixels emit no light. After the signal-writing period, a light-emitting period starts and pixels emit light. The length of the light-emitting period at this time is 1. Next, a subsequent sub-frame starts and signals for one screen are inputted to all pixels in a signal-writing period. During this period, pixels emit no light. After the signal-writing period, a light-emitting period starts and pixels emit light. The length of the light-emitting period at this time is 2.

By repeating similar operations, the lengths of the light-emitting periods are arranged in the order of 1, 2, 4, 8, 16, and 1.

Such a driving method where a period where a signal is written to a pixel and a period where light is emitted are separated is preferably applied to a plasma display. Note that, in the case where the driving method is used for a plasma display, an initialization operation or the like are required, which are omitted here for simplicity.

Moreover, this driving method is also preferably applied to an organic EL display, a field emission display, a display using a Digital Micromirror Device (DMD), or the like.

Figure 14:
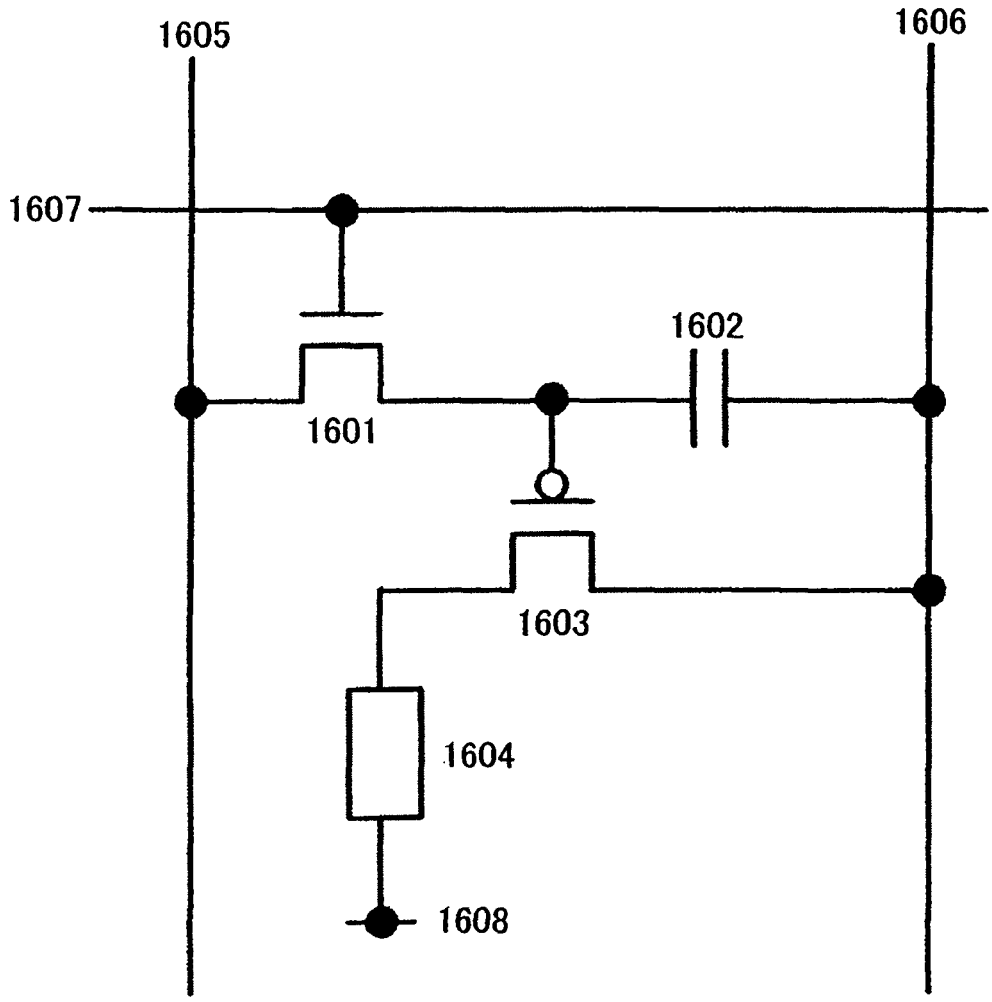
FIG. 14 is a diagram explaining a configuration of a display device of the present invention.

FIG. 14 shows a pixel configuration of this case. One of a source and drain of the selecting transistor 1601 is connected to a signal line 1605, and the other of the source and drain of the selecting transistor 1601 is connected to a gate of a driving transistor 1603. A gate of the selecting transistor 1601 is connected to a gate line 1607. The gate line 1607 is selected to turn the driving transistor 1603 on, and a signal is inputted from the signal line 1605 to a storage capacitor 1602. Then, a current flowing through the driving transistor 1603 is controlled depending on the signal, and a current flows from a first power supply line 1606 to a second power supply line 1608 through a display element 1604.

Note that, in a signal-writing period, each potential of the first power supply line 1606 and the second power supply line 1608 are controlled so that no voltage is applied to the display element 1604. Consequently, the display element 1604 can be prevented from emitting light in a signal-writing period.

Figure 15:
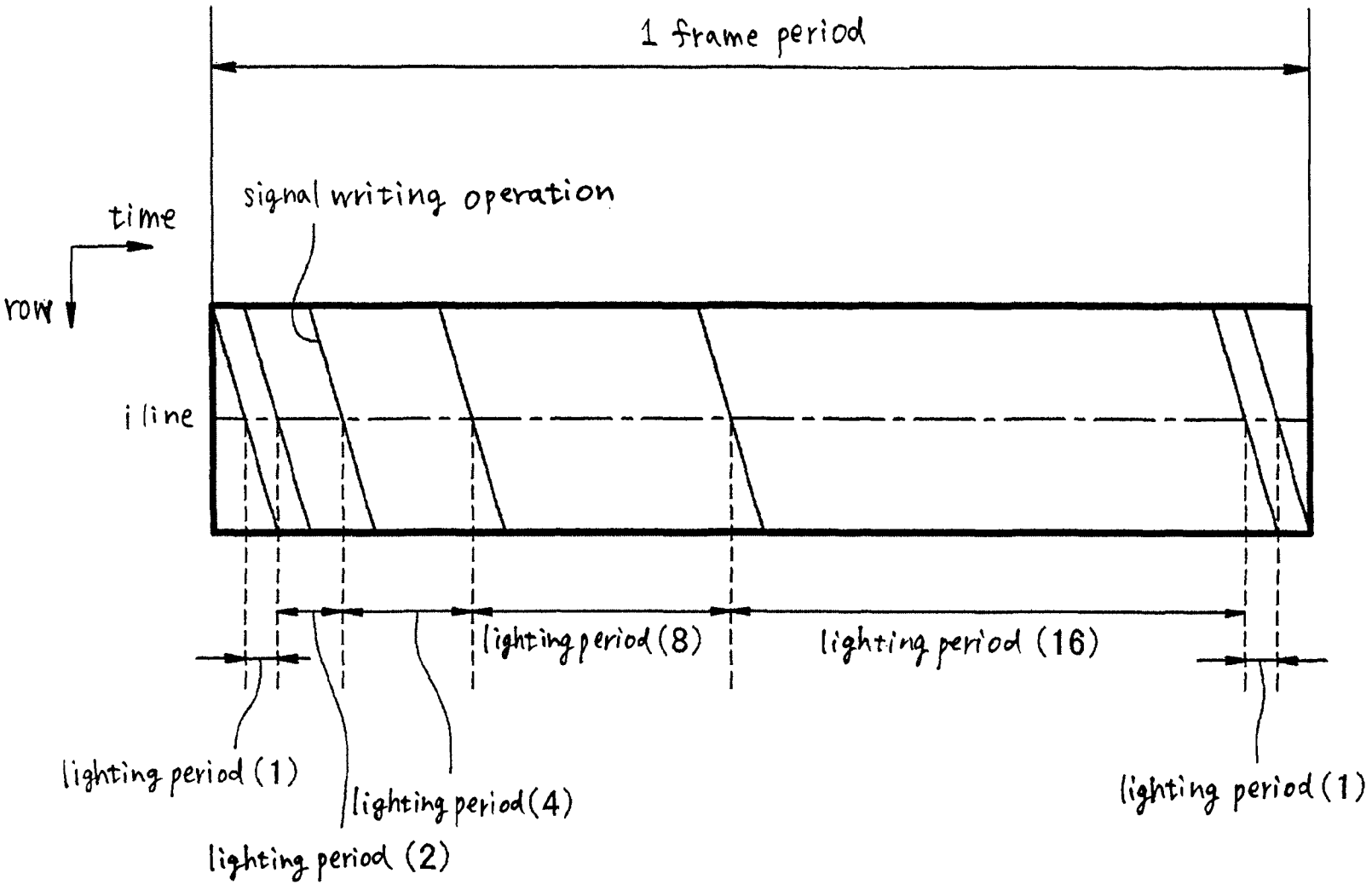
FIG. 15 is a diagram explaining a configuration of a driving method of a display device of the present invention.

Next, FIG. 15 shows a timing chart in a case where a period where a signal is written to a pixel and a period where light is emitted are not separated. Immediately after a signal is written to each row, a light-emitting period starts.

In a certain row, after writing of signals and a predetermined light-emitting period are completed, a signal writing operation starts in a subsequent sub-frame. By repeating such operations, the lengths of the light-emitting periods are arranged in the order of 1, 2, 4, 8, 16, and 1.

In such a manner, many sub-frames can be arranged in one frame even if signals are written slowly.

Such a driving method is preferably applied to a plasma display. Note that, in the case where the driving method is used for a plasma display, an initialization operation or the like are required, which are omitted here for simplicity.

In addition, this driving method is also preferably applied to an organic EL display, a field emission display, a display using a Digital Micromirror Device (DMD), or the like.

Figure 16:
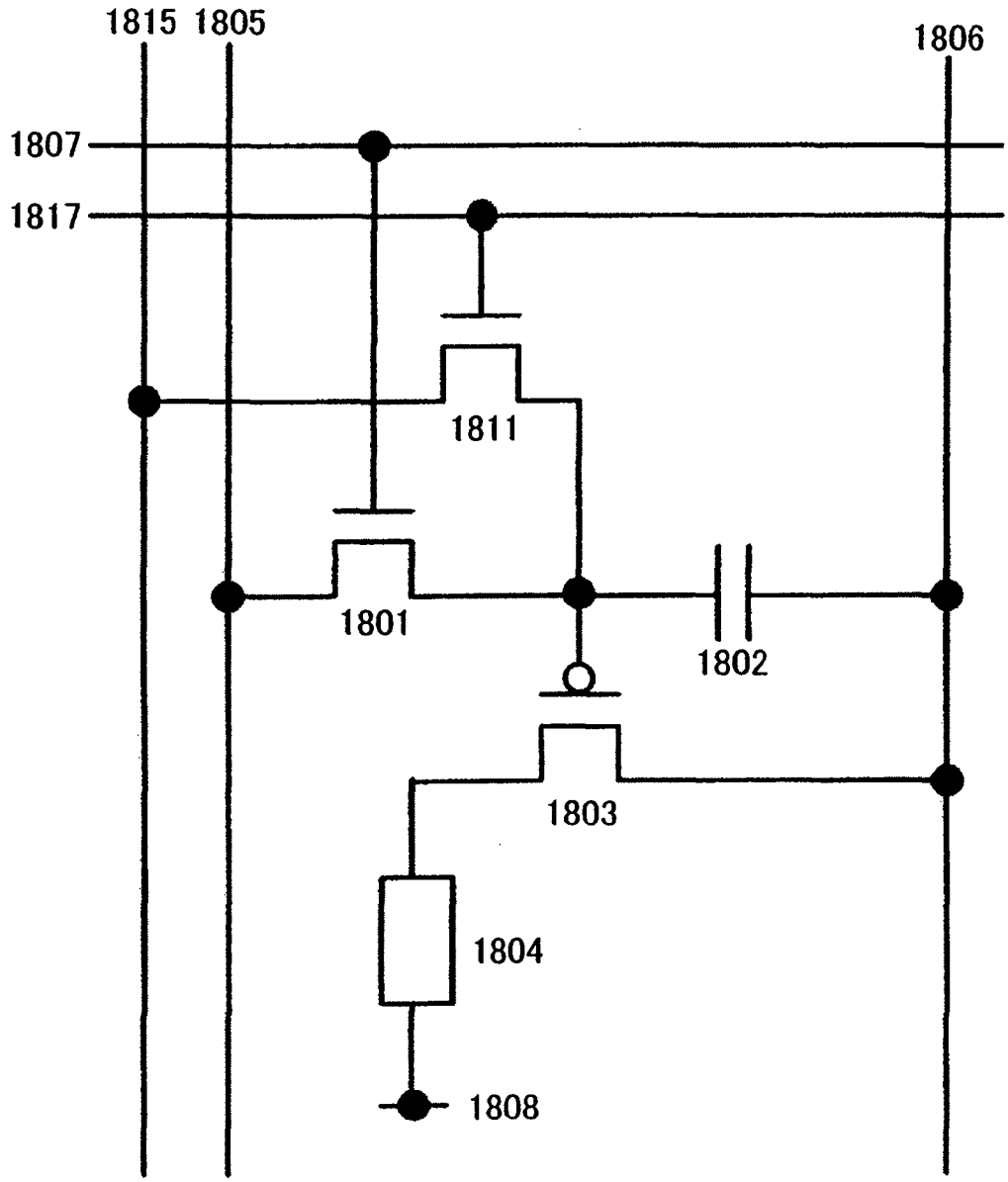
FIG. 16 is a diagram explaining a structure of a display device of the present invention.

FIG. 16 shows a pixel configuration of this case. A first gate line 1807 is selected to turn a first selecting transistor 1801 on, and a signal is inputted from a first signal line 1805 to a storage capacitor 1802. Then, a current flowing through a driving transistor 1803 is controlled depending on the signal, and a current flows from a first power supply line 1806 to a second power supply line 1808 through a display element 1804. In the same manner, a second gate line 1817 is selected to turn a second selecting transistor 1811 on, and a signal is inputted from a second signal line 1815 to the storage capacitor 1802. Then, a current flowing through the driving transistor 1803 is controlled depending on the signal, and a current flows from the first power supply line 1806 to the second power supply line 1808 through the display element 1804.

The first gate line 1807 and the second gate line 1817 can be controlled separately. In the same manner, the first signal line 1805 and the second signal line 1815 can be controlled separately. Accordingly, signals can be inputted to pixels of two rows at the same time; thus, the driving method as shown in FIG. 15 can be achieved.

Figure 17:
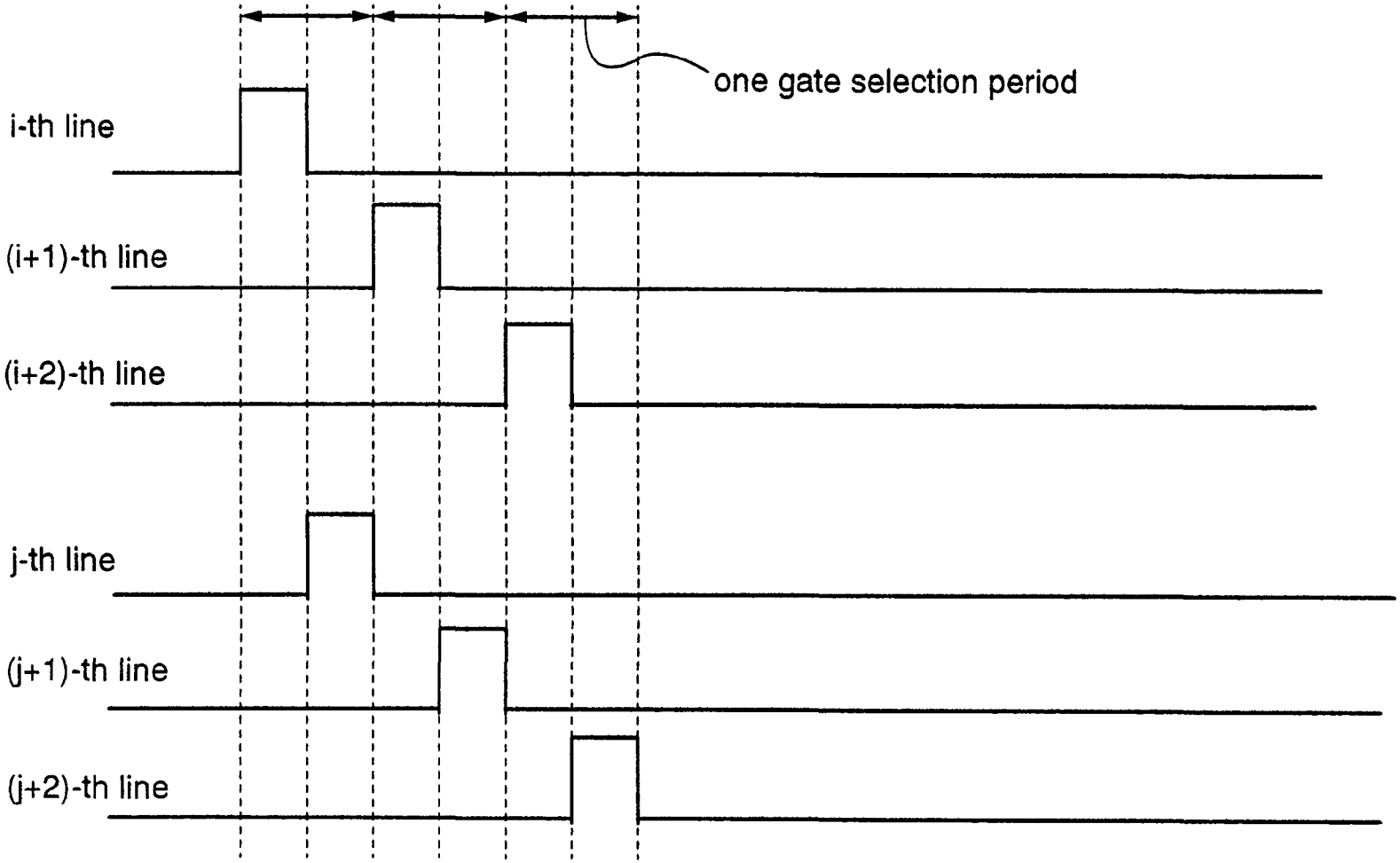
FIG. 17 is a diagram explaining a structure of a driving method of a display device of the present invention.

Note that the driving method as shown in FIG. 15 can also be achieved using the circuit of FIG. 14. FIG. 17 shows a timing chart of this case. As shown in FIG. 17, one gate selection period is divided into a plurality of periods (two in FIG. 17). Each gate line is selected in each of the divided selection periods and a corresponding signal is inputted to the signal line 1605. For example, in one gate selection period, the i-th row is selected in the first half of the period and the j-th row is selected in the latter half of the period. Accordingly, an operation can be performed as if the two rows are selected at the same time in the one gate selection period.

Note that such a driving method can be applied in combination with the present invention.

Figure 18:
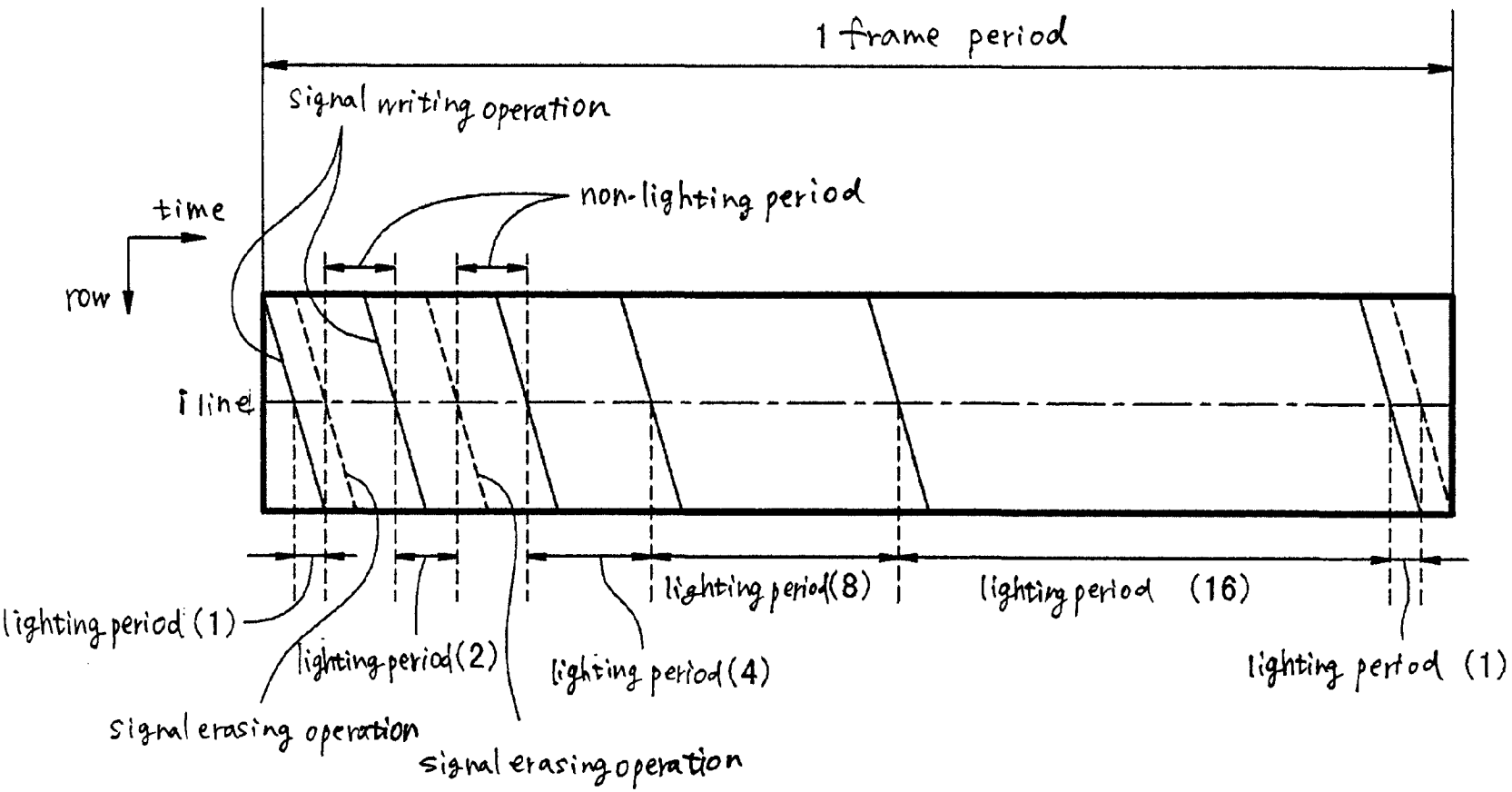
FIG. 18 is a diagram explaining a structure of a driving method of a display device of the present invention.

Then, FIG. 18 shows a timing chart in a case where signals in pixels are erased. In each row, a signal writing operation is performed and the signals in the pixels are erased before a subsequent signal writing operation. Accordingly, the length of a light-emitting period can easily be controlled.

In a certain row, after writing of signals and a predetermined light-emitting period are completed, a signal writing operation starts in a subsequent sub-frame. In the case where a light-emitting period is short, a signal erasing operation is performed to provide a non-light-emitting state. By repeating such operations, the lengths of the light-emitting periods are arranged in the order of 1, 2, 4, 8, 16, and 1.

Note that, although the signal erasing operation is performed in the case where the light-emitting periods are 1 and 2 in FIG. 18, the present invention is not limited thereto. The erasing operation may be performed in other light-emitting periods.

Accordingly, many sub-frames can be arranged in one frame even if signals are written slowly. In addition, in the case of performing the signal erasing operation, data for erasing is not required to be obtained as well as a video signal; therefore, the driving frequency of a source driver can also be reduced.

Such a driving method is preferably applied to a plasma display. Note that, in the case where the driving method is used for a plasma display, an initialization operation and the like are required, which are omitted here for simplicity.

In addition, this driving method is also preferably applied to an organic EL display, a field emission display, a display using a Digital Micromirror Device (DMD), or the like.

Figure 19:
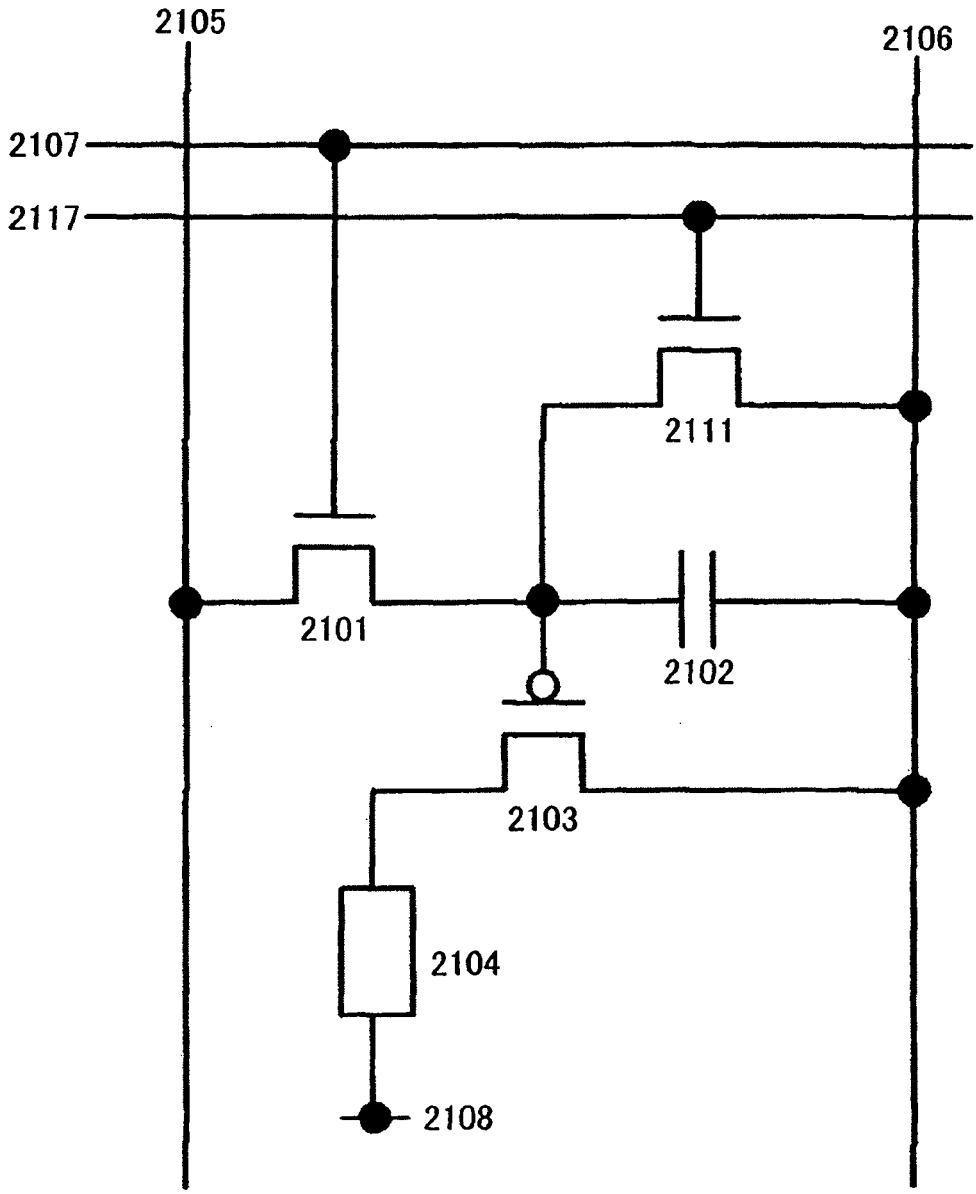
FIG. 19 is a diagram explaining a configuration of a display device of the present invention.

FIG. 19 shows a pixel configuration of this case. A first gate line 2107 is selected to turn a selecting transistor 2101 on, and a signal is inputted from a signal line 2105 to a storage capacitor 2102. Then, a current flowing through a driving transistor 2103 is controlled depending on the signal, and a current flows from a first power supply line 2106 to a second power supply line 2108 through a display element 2104.

In order to erase a signal, a second gate line 2117 is selected to turn an erasing transistor 2111 on, so that the driving transistor 2103 is turned off. Then, no current flows from the first power supply line 2106 to the second power supply line 2108 through the display element 2104. Consequently, a non-light-emitting period can be provided and the length of a light-emitting period can be freely controlled.

Although the erasing transistor 2111 is used in FIG. 19, another method can be used. This is because a non-light-emitting period may forcibly be provided so that no current is supplied to the display element 2104. Therefore, a non-light-emitting period may be provided by arranging a switch somewhere in a path where a current flows from the first power supply line 2106 to the second power supply line 2108 through the display element 2104 and controlling on/off of the switch. Alternatively, a gate-source voltage of the driving transistor 2103 may be controlled to forcibly turn the driving transistor off.

Figure 20:
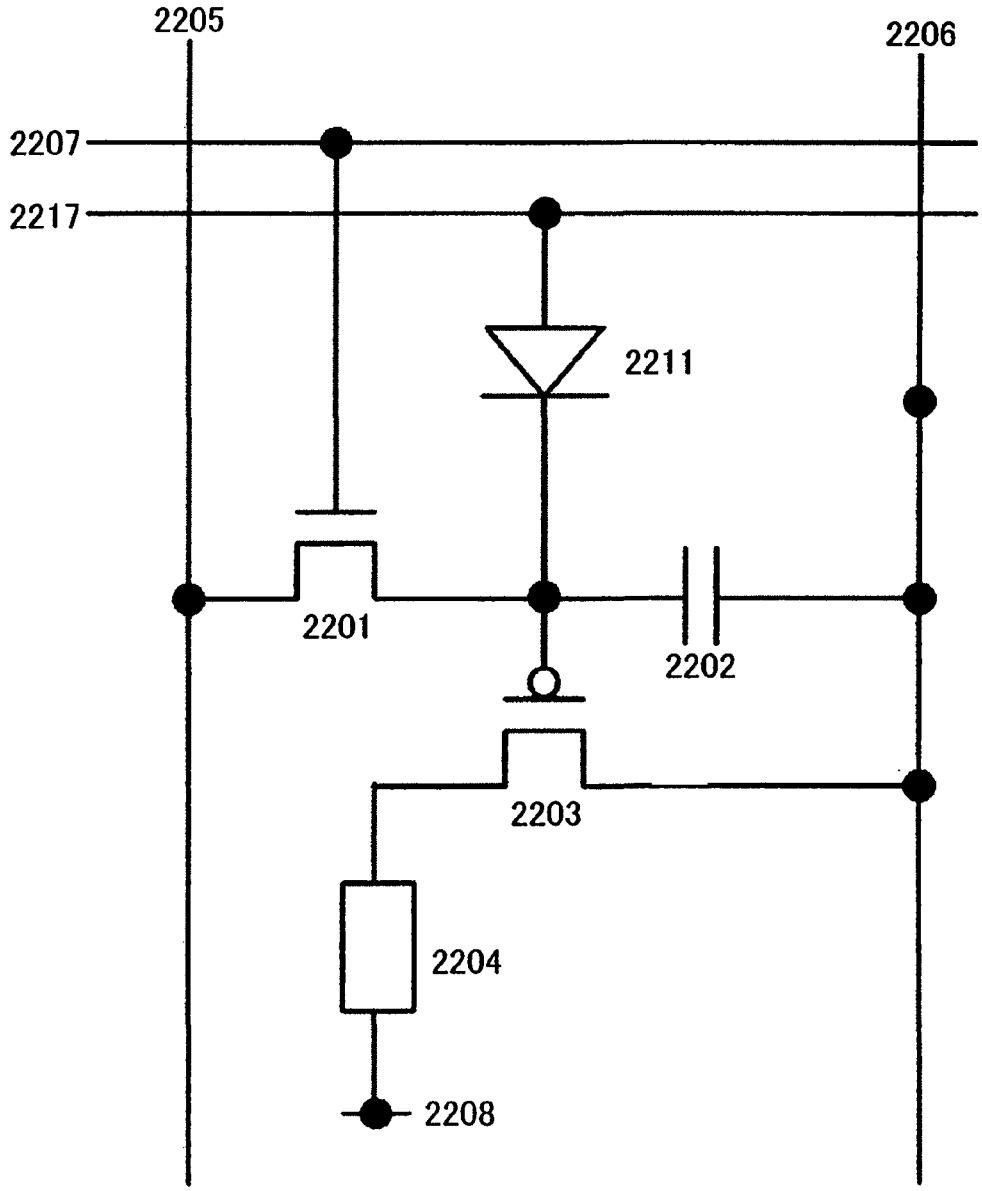
FIG. 20 is a diagram explaining a configuration of a display device of the present invention.

FIG. 20 shows an example of a pixel configuration in the case where a driving transistor is forcibly turned off. A selecting transistor 2201, a driving transistor 2203, an erasing diode 2211, and a display element 2204 are provided. One of a source and a drain of the selecting transistor 2201 is connected to a signal line 2205, and the other of the source and drain of the selecting transistor 2201 is connected to a gate of the driving transistor 2203. A gate of the selecting transistor 2201 is connected to the first gate line 2207. A source and a drain of the driving transistor 2203 are connected to a first power supply line 2206 and the display element 2204. The erasing diode 2211 is connected to the gate of the driving transistor 2203 and a second gate line 2217.

A storage capacitor 2202 has a function of holding gate potential of the driving transistor 2203. Thus, although the storage capacitor 2202 is connected between the gate of the driving transistor 2203 and the first power supply line 2206, the present invention is not limited thereto. The storage capacitor 2202 may be arranged to hold the gate potential of the driving transistor 2203. In addition, in the case where the gate potential of the driving transistor 2203 can be held using the gate capacitance of the driving transistor 2203, or the like, the storage capacitor 2202 may be omitted.

As an operating method, the first gate line 2207 is selected to turn the selecting transistor 2201 on, and a signal is inputted from the signal line 2205 to the storage capacitor 2202. Then, a current flowing through the driving transistor 2203 is controlled depending on the signal, and a current flows from the first power supply line 2106 to a second power supply line 2208 through the display element 2104.

In order to erase a signal, the second gate line 2217 is selected (supplied with high potential here) to turn the erasing diode 2211 on, so that a current flows from the second gate line 2217 to the gate of the driving transistor 2203. Consequently, the driving transistor 2203 is turned off. Then, no current flows from the first power supply line 2206 to the second power supply line 2208 through the display element 2204. Consequently, a non-light-emitting period can be provided and the length of a light-emitting period can be freely controlled.

In order to hold a signal, the second gate line 2217 is not selected (supplied with low potential here). Then, the erasing diode 2211 is turned off and the gate potential of the driving transistor 2203 is thus held.

Note that the erasing diode 2211 may be any element as far as it has rectifying properties. The erasing diode may be a PN diode, a PIN diode, a Schottky diode, or a zener diode.

Figure 21:
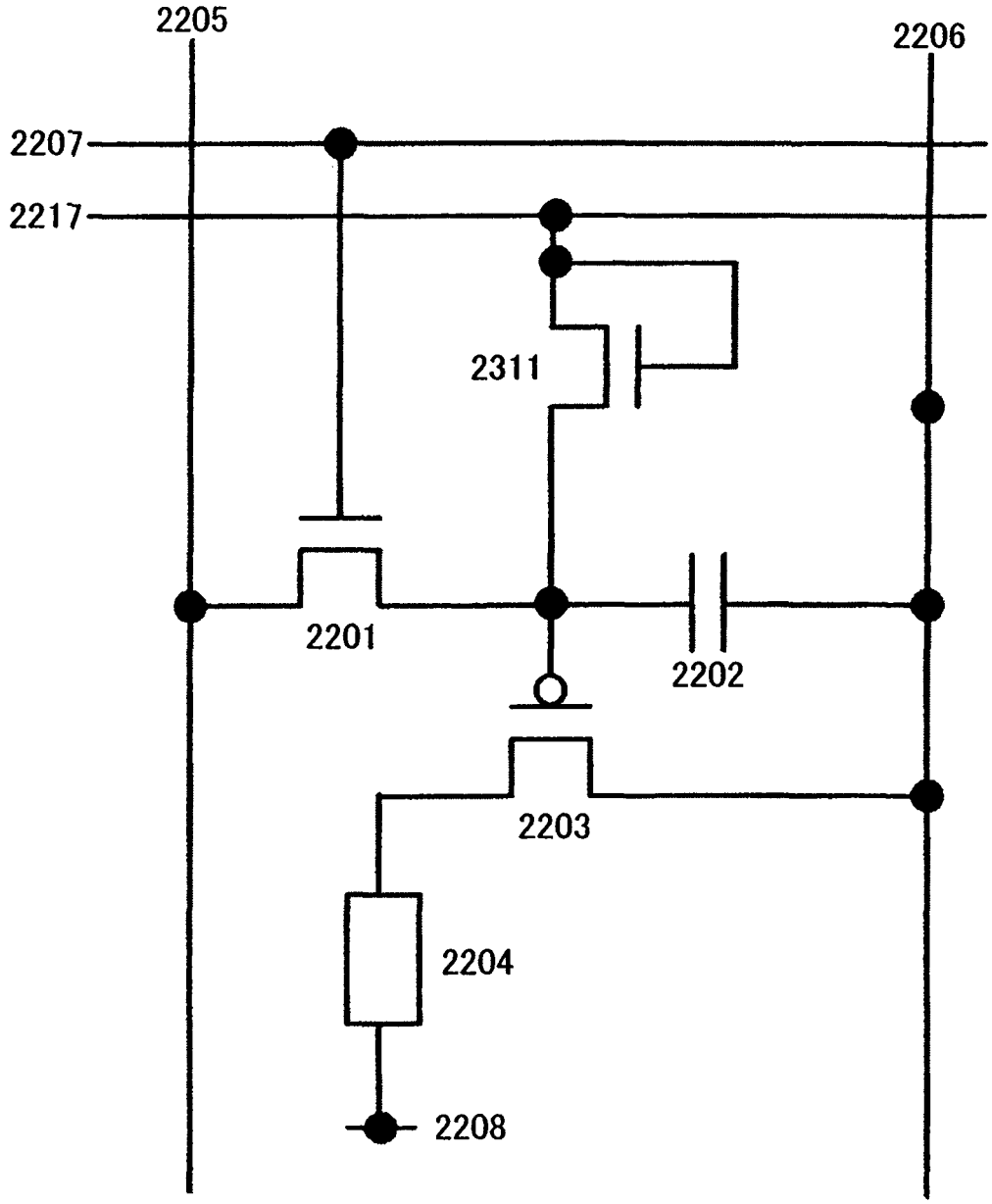
FIG. 21 is a diagram explaining a configuration of a display device of the present invention.

In addition, a diode-connected transistor (a gate and a drain thereof are connected) may be used as well by using a transistor. A circuit diagram of this case is shown in FIG. 21. As the erasing diode 2211, a diode-connected transistor 2311 is used. Although an N-channel transistor is used here, the present invention is not limited thereto and a P-channel transistor may also be used.

Note that a driving method as shown in FIG. 18 can be achieved using the circuit in FIG. 14 as still another circuit. FIG. 17 shows a timing chart of this case. As shown in FIG. 17, one gate selection period is divided into a plurality of periods (two in FIG. 17). Each gate line is selected in each of the divided selection periods and a corresponding signal (a video signal and an erasing signal) is inputted to the signal line 1605. For example, in certain one gate selection period, the i-th row is selected in the first half of the period and the j-th row is selected in the latter half of the period. Then, when the i-th row is selected, a video signal for it is inputted. On the other hand, when the j-th row is selected, a signal for turning the driving transistor off is inputted. Accordingly, an operation can be performed as if the two rows are selected at the same time in the one gate selection period.

Note that such a driving method can be applied in combination with the present invention.

Note that the timing charts, pixel configurations, and driving methods that are shown in this embodiment mode are examples and the present invention is not limited thereto. The present invention can be applied to various timing charts, pixel configurations, and driving methods.

Note that the order in which sub-frames appear may be changed depending on time. For example, the order in which sub-frames appear may be changed between the first frame and the second frame. Further, the order in which sub-frames appear may be changed depending on place. For example, the order in which sub-frames appear may be changed between the pixel A and the pixel B. Further, the order in which sub-frames appear may be changed depending on time and place by combining these.

Note that a light-emitting period, a signal writing period, and a non-light-emitting period are arranged in one frame period in this embodiment mode; however, the present invention is not limited thereto and other operation periods may also be arranged. For example, a period where a voltage of opposite polarity to normal polarity is applied to a display element, a so-called reverse bias period may be provided. By providing the reverse bias period, the reliability of the display element is improved in some cases.

Note that the present invention is not limited to the pixel configurations described in this embodiment mode. Other configurations having the same function can be applied as well.

Note that the details described in this embodiment mode can be implemented by freely combining with the details described in Embodiment Modes 1.

(Embodiment Mode 3)

In this embodiment mode, an example of a display device using a driving method of the present invention will be described.

As the most typical display device, a plasma display can be given. A pixel of a plasma display can be only in a light-emitting state or a non-light-emitting state. Accordingly, a time gray scale method is used as one of the means for achieving multiple gray scales. Therefore, the present invention can be applied thereto.

Note that, in a plasma display, initialization of a pixel is required as well as writing of a signal to a pixel. Therefore, it is desirable that sub-frames be arranged in order in the portion where the overlapping time gray scale method is used, and sub-frames using the binary code time gray scale method not be sandwiched therebetween. By thus arranging the sub-frames, the number of times of initialization of a pixel can be reduced. As a result, the contrast can be improved.

When sub-frames using the binary code time gray scale method are arranged together, however, this portion causes pseudo contours. Accordingly, sub-frames using the binary code time gray scale method are desirably arranged as separately as possible in one frame. In the case of using sub-frames using the binary code time gray scale method, initialization of a pixel is performed corresponding to each sub-frame. Therefore, it is not a major problem that sub-frames using the binary code time gray scale method are arranged separately. On the other hand, in the case of sub-frames using the overlapping time gray scale method, initialization of a pixel is not always required to be performed if sub-frames where light is emitted are arranged in series. Thus, the sub-frames are desirably arranged as sequentially as possible.

Accordingly, in a case of combining sub-frames using the overlapping time gray scale method and sub-frames using the binary code time gray scale method, as the order in which sub-frames appear, the sub-frames using the overlapping time gray scale method are desirably arranged so that sub-frames where light is emitted are arranged in series, and the sub-frames using the binary code time gray scale method are desirably arranged separately between the sub-frames using the overlapping time gray scale method. Accordingly, the number of times of initialization can be reduced, the contrast can be improved, and pseudo contours can be reduced.

As examples of a display device other than a plasma display, an organic EL display, a field emission display, a display using a Digital Micromirror Device (DMD), a ferroelectric liquid crystal display, a bistable liquid crystal display, or the like are given. All of them are display devices to which the time gray scale method can be applied. Pseudo contours can be reduced by applying the present invention to these display devices with the use of the time gray scale method.

For example, in the case of an organic EL display, initialization of a pixel is not required. Therefore, reduction in contrast, which is caused by light emission in initialization of a pixel, does not occur. Accordingly, the order in which sub-frames appear can be set arbitrarily. Sub-frames are desirably arranged at random so as to reduce pseudo contours as much as possible.

Therefore, sub-frames using the overlapping time gray scale method may be arranged so that sub-frames where light is emitted are arranged in series, and sub-frames using the binary code time gray scale method may be separately arranged between the sub-frames using the overlapping time gray scale method. Accordingly, the sub-frames using the overlapping time gray scale method are arranged together in one frame to some degree; therefore, pseudo contours are prevented from occurring in a boundary between the first frame and the second frame. So-called moving image pseudo contours can be reduced. In addition, since the sub-frames using the binary code time gray scale method are separately arranged, pseudo contours can be reduced.

Alternatively, sub-frames using the overlapping time gray scale method may be arranged at random, and sub-frames using the binary code time gray scale method may also be arranged at random. Consequently, pseudo contours caused by the portions using the binary code time gray scale method are mixed with the sub-frames using the overlapping gray scale method; therefore, the effect of reducing pseudo contours increases as a whole.

Note that the details described in this embodiment mode can be implemented by freely combining with the details described in Embodiment Modes 1 to 2.

(Embodiment Mode 4)

In this embodiment mode, a configuration and an operation of a display device, a signal line driver circuit, and a gate line driver circuit will be explained.

Figure 22:
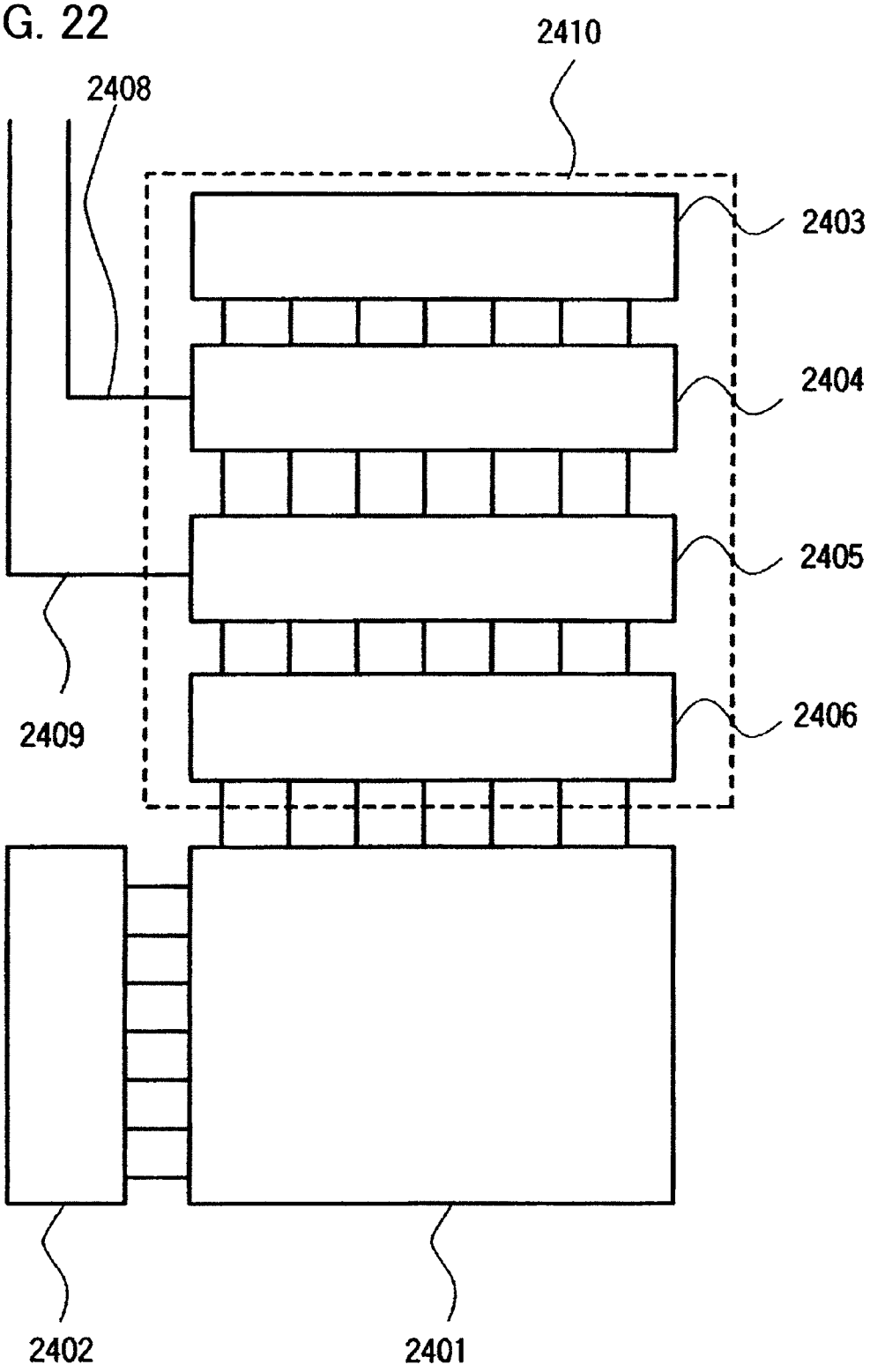
FIG. 22 is a diagram explaining a structure of a display device of the present invention.

As shown in FIG. 22, a display device has a pixel 2401, a gate line driver circuit 2402, and a signal line driver circuit 2410. The gate line driver circuit 2402 sequentially outputs a selection signal to the pixel 2401. The gate line driver circuit 2402 is constituted by a shift register, a buffer circuit, and the like.

Besides, the gate line driver circuit 2402 often includes a level shifter circuit, a pulse width controlling circuit, and the like. The shift resister outputs a pulse to select sequentially. The signal line driver circuit 2410 sequentially outputs a video signal to the pixel 2401. The shift resister 2403 outputs a pulse to select sequentially. In the pixel 2401, images are displayed by controlling a state of light in accordance with the video signal. The video signal inputted from the signal line driver circuit 2410 to the pixel 2401 is often a voltage. In other words, states of a display element arranged in each pixel and an element controlling the display element are changed by the video signal (voltage) inputted from the signal line driver circuit 2410. As examples of a display element arranged in a pixel, an EL element, an element used for an FED (Field Emission Display), a liquid crystal, a DMD (Digital Micromirror Device), or the like can be given.

Note that the gate line driver circuit 2402 and the signal line driver circuit 2410 may be arranged in plural.

The configuration of the signal line driver circuit 2410 can be divided into a plurality of portions. As an example, the signal line driver circuit 2410 can be roughly divided into a shift register 2403, a first latch circuit (LAT1) 2404, a second latch circuit (LAT2) 2405, and an amplifier circuit 2406. The amplifier circuit 2406 may have a function of converting a digital signal into an analog signal or a function of performing a gamma correction.

In addition, a pixel has a display element such as an EL element. A circuit for outputting current (a video signal) to the display element, that is, a current source circuit may be provided in some cases.

Thus, an operation of the signal line driver circuit 2410 will be briefly described. A clock signal (S-CLK), a start pulse (SP), and an inverted clock signal (S-CLKb) are inputted to the shift resister 2403, and a sampling pulse is sequentially outputted in accordance with the timing of these signals.

The sampling pulse outputted from the shift register 2403 is inputted to the first latch circuit (LAT1) 2404. A video signal is inputted from a video signal line 2408 to the first latch circuit (LAT1) 2404. The first latch circuit (LAT1) 2404 holds a video signal of each column in accordance with the timing at which the sampling pulse is inputted.

After holding of video signals is completed to the last column in the first latch circuit (LAT1) 2404, a latch pulse (Latch Pulse) is inputted from a latch control line 2409 during a horizontal retrace period, and the video signals held in the first latch circuit (LAT1) 2404 are transferred to the second latch circuit (LAT2) 2405 at once. After that, the video signals of one row, which are held in the second latch circuit (LAT2) 2405, are inputted to the amplifier circuit 2406 at once. A signal outputted from the amplifier circuit 2406 is inputted to the pixel 2401.

While the video signal held in the second latch circuit (LAT2) 2405 is inputted to the amplifier circuit 2406 and then inputted to the pixel 2401, a sampling pulse is outputted from the shift register 2403 again. In other words, two operations are performed at the same time. Accordingly, a line sequential driving can be enabled. These operations are repeated thereafter.

Note that the signal line driver circuit or part thereof (the current source circuit, the amplifier circuit, or the like) may be constituted using, for example, an external IC chip in some cases instead of being provided over the same substrate as the pixel 2401.

Figure 23:
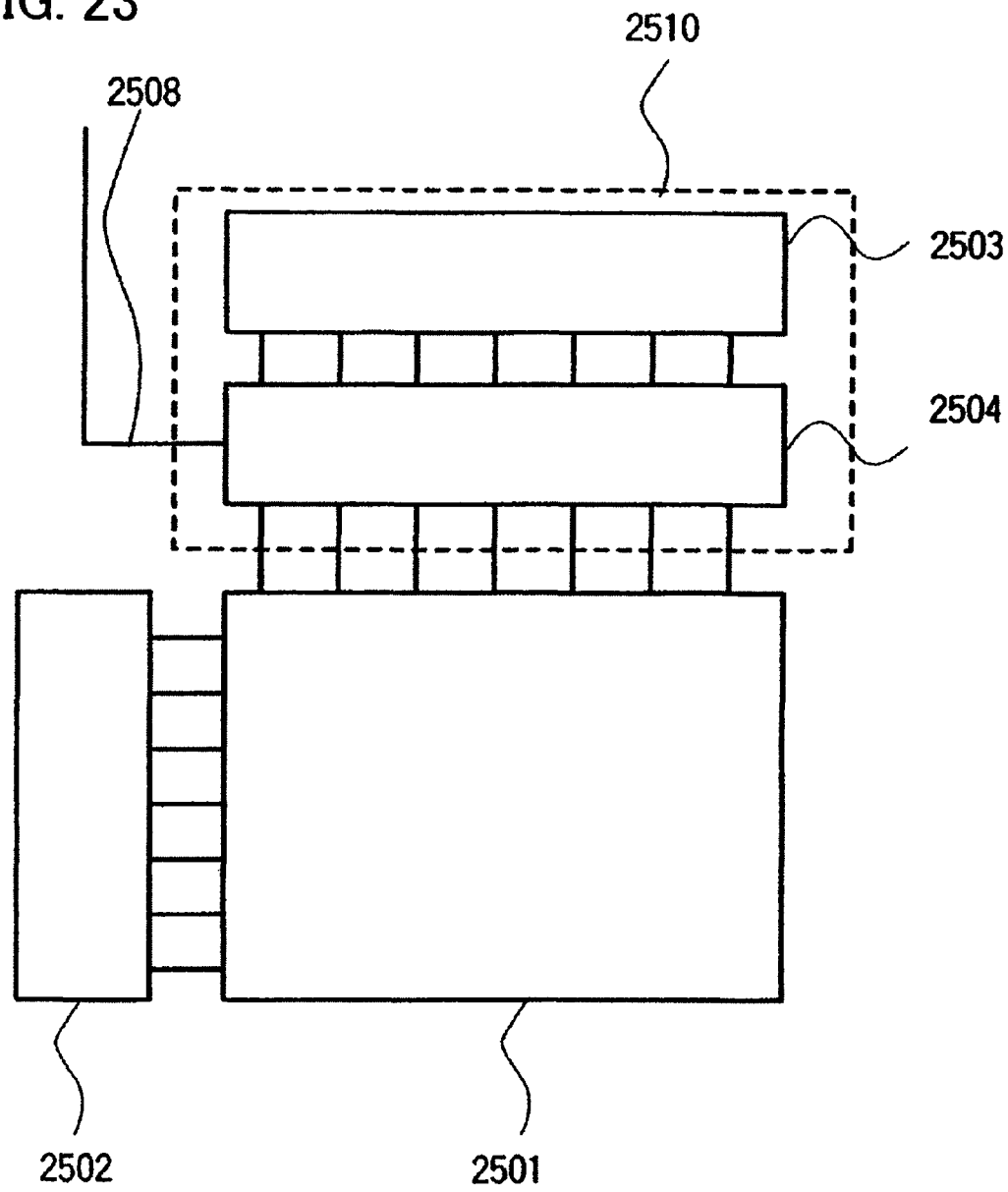
FIG. 23 is a diagram explaining a structure of a display device of the present invention.

Note that the configuration of the signal line driver circuit, the gate line driver circuit, and the like is not limited to that in FIG. 22. For example, a signal is supplied to a pixel by a dot sequential driving in some cases. FIG. 23 shows an example of a signal line driver circuit 2510 of that case. A sampling pulse is outputted from a shift resister 2503 to a sampling circuit 2504. A video signal is inputted from a video signal line 2508, and the video signal is outputted to a pixel 2501 depending on the sampling pulse. The gate line driver circuit 2502 sequentially outputs a selection signal to the pixel 2501.

Note that, as described above, a transistor of the present invention may be any type of transistor, and formed over any substrate. Therefore, the circuits shown in FIGS. 22 and 23 may all be formed over a glass substrate, a plastic substrate, a single crystalline substrate, an SOI substrate, or any substrate. Alternatively, part of the circuits in FIGS. 22 and 23 may be formed over one substrate, and the other part of the circuits in FIGS. 22 and 23 may be formed over another substrate. In other words, the whole circuits in FIGS. 22 and 23 are not necessarily formed over the same substrate. For example, in FIGS. 22 and 23, the pixel 2401 and the gate line driver circuit 2402 may be formed over a glass substrate using TFTs, and the signal line driver circuit 2410 (or part thereof) may be formed over a single crystalline substrate, and then an IC chip thereof may be connected by COG (Chip On Glass) to be provided over a glass substrate. Alternatively, the IC chip may be connected to the glass substrate by TAB (Tape Auto Bonding) or using a printed wiring board.

Note that the details described in this embodiment mode utilize the details described in Embodiment Modes 1 to 3. Therefore, the details described in Embodiment Modes 1 to 3 can also be applied to this embodiment mode.

(Embodiment Mode 5)

Figure 24:
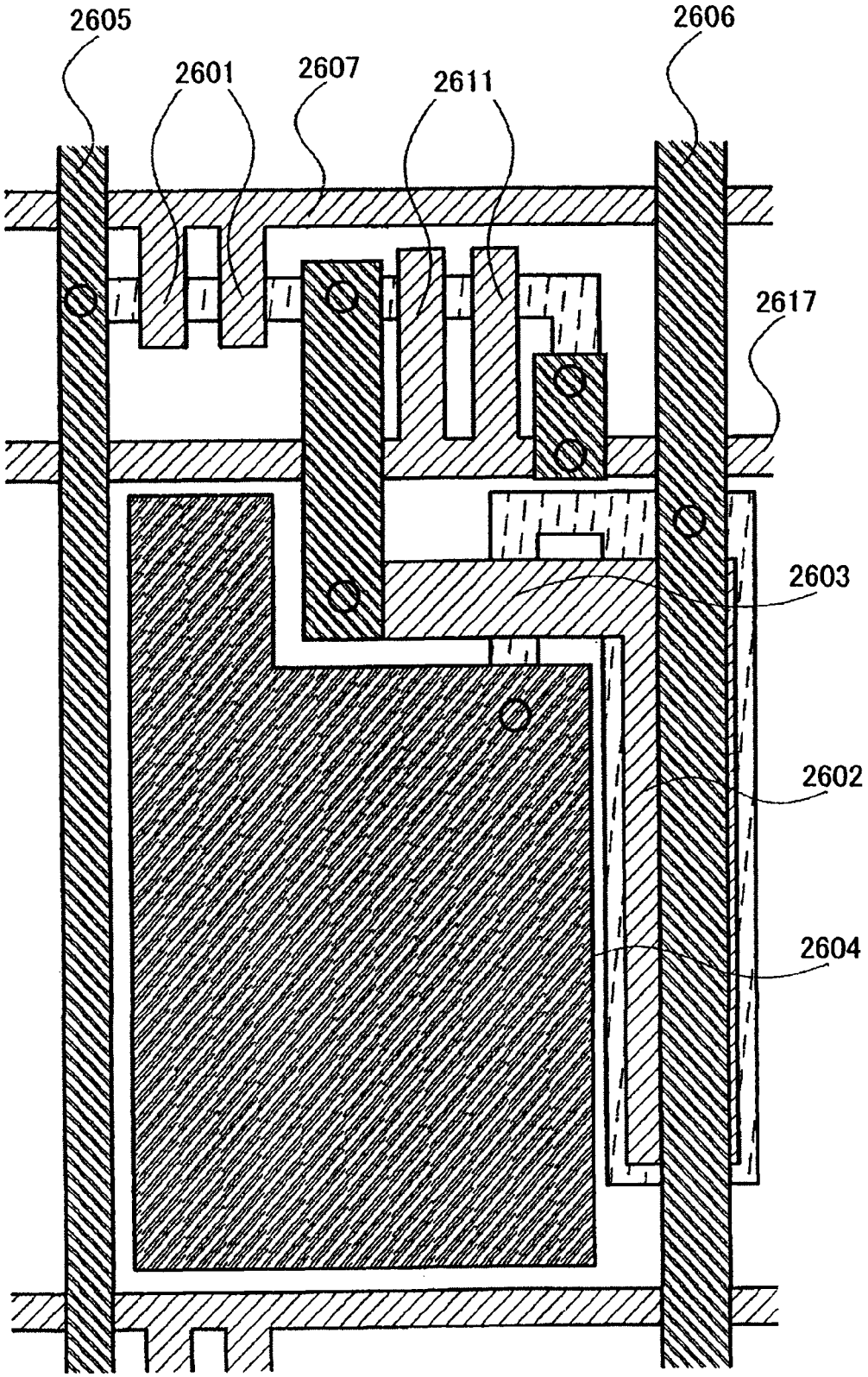
FIG. 24 is a diagram explaining a structure of a display device of the present invention.

Next, a layout of a pixel in a display device of the invention will be described. As an example, a layout diagram of the circuit diagram shown in FIG. 21 is shown in FIG. 21. Note that the circuit diagram and the layout diagram are not limited to FIGS. 21 and 24.

A selecting transistor 2601, a driving transistor 2603, a diode-connected transistor 2611, and a display element 2604 are provided. A source and a drain of the selecting transistor 2601 are connected to a signal line 2605 and a gate of the driving transistor 2603. A gate of the selecting transistor 2601 is connected to a first gate line 2607. A source and a drain of the driving transistor 2603 are connected to a power supply line 2606 and the display element 2604, respectively. The diode-connected transistor 2611 is connected to the gate of the driving transistor 2603 and a second gate line 2617. A storage capacitor 2602 is connected between the gate of the driving transistor 2603 and the power supply line 2606.

The signal line 2605 and the power supply line 2606 are each formed of a second wiring, whereas the first gate line 2607 and the second gate line 2617 are each formed of a first wiring.

In a case of a top gate structure, films are formed in the order of a substrate, a semiconductor layer, a gate insulating film, a first wiring, an interlayer insulating film, and a second wiring. In a case of a bottom gate structure, films are formed in the order of a substrate, a first wiring, a gate insulating film, a semiconductor layer, an interlayer insulating film, and a second wiring.

Note that the details described in this embodiment mode can be implemented by freely combining with the details described in Embodiment Modes 1 to 4.

(Embodiment Mode 6)

Hardware for controlling the driving method described in Embodiment Modes 1 to 5 will be described in this embodiment mode.

Figure 25:
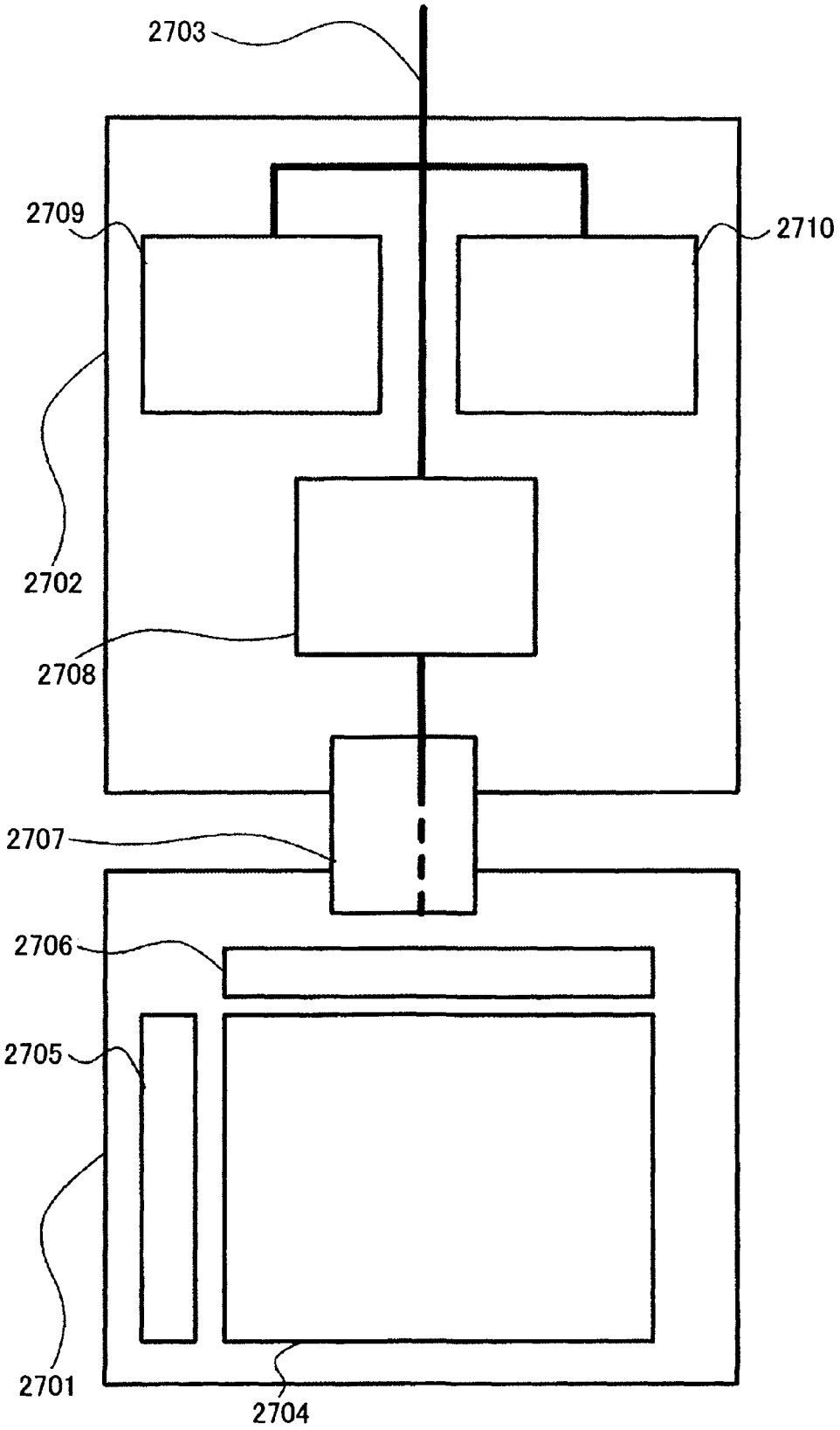
FIG. 25 is a diagram explaining a structure of a display device of the present invention.

A general configuration diagram is shown in FIG. 25. A pixel 2704 is provided over a substrate 2701. A signal line driver circuit 2706 and a gate line driver circuit 2705 are provided in many cases. Besides, a power supply circuit, a precharge circuit, a timing generating circuit, or the like may be provided. There are some cases where the signal line driver circuit 2706 or the gate line driver circuit 2705 are not provided. In that case, circuits that are not provided over the substrate 2701 are formed as an IC in many cases. The IC is provided over the substrate 2701 by COG (Chip On Glass) in many cases. Alternatively, the IC may be provided over a connecting substrate 2707 that connects the substrate 2701 to a peripheral circuit substrate 2702.

A signal 2703 is inputted to the peripheral circuit substrate 2702. Then, the signal is held in a memory 2709, a memory 2710, or the like by the control of a controller 2708. In a case where the signal 2703 is an analog signal, the signal 2703 is often analog-to-digital converted to be held in the memory 2709, the memory 2710, or the like. Then, the controller 2708 outputs a signal to the substrate 2701 by using the signal held in the memory 2709, the memory 2710, or the like.

In order to achieve the driving method described in Embodiment Mode 1 to Embodiment Mode 5, the controller 2708 outputs a signal to the substrate 2701 by controlling the order in which sub-frames appear, or the like.

Note that the details described in this embodiment mode can be implemented by freely combining with the details described in Embodiment Modes 1 to 5.

(Embodiment Mode 7)

Figure 26:
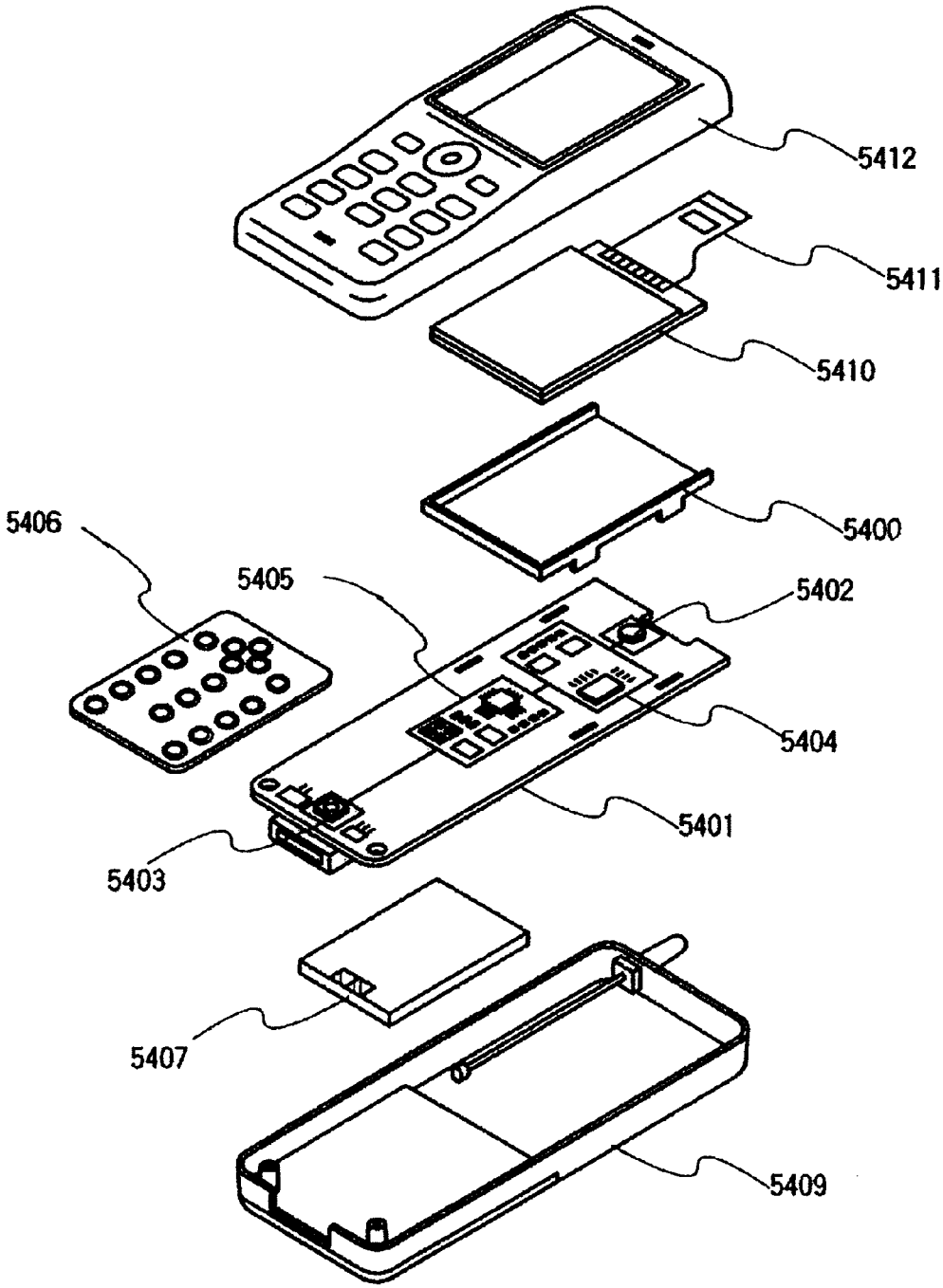
FIG. 26 is a view explaining an electronic device to which the present invention is applied.

A configuration example of a cellular phone having a display portion that is formed using a display device of the present invention or a display device using a driving method thereof will be explained with reference to FIG. 26.

A display panel 5410 is incorporated in a housing 5400 such that can be freely attached and detached. The shape and size of the housing 5400 can be changed appropriately in accordance with the size of the display panel 5410. The housing 5400 to which the display panel 5410 is fixed is fitted in a printed wiring board 5401 so as to be constructed as a module.

The display panel 5410 is connected to the printed wiring board 5401 through an FPC 5411. A signal processing circuit 5405 including a speaker 5402, a microphone 5403, a transmitting/receiving circuit 5404, a CPU, a controller, and the like is mounted on the printed wiring board 5401. Such a module, an input means 5406, and a battery 5407 are combined to be incorporated in housings 5409 and 5412. A pixel portion of the display panel 5410 is arranged to be seen from an opening window of the housing 5409.

In the display panel 5410, a pixel portion and part of peripheral driver circuits (a driver circuit with a lower operating frequency among a plurality of driver circuits) may be integrated over a substrate using TFTs, and another part of the peripheral driver circuits (a driver circuit with a higher operating frequency among the plurality of driver circuits) may be formed over an IC chip, and then the IC chip may be mounted on the display panel 5410 by COG (Chip On Glass). Alternatively, the IC chip may be connected to a glass substrate by TAB (Tape Auto Bonding) or using a printed wiring board. Note that FIG. 27A shows an example of a configuration of a display panel where part of peripheral driver circuits and a pixel portion are integrated over a substrate and an IC chip including the other peripheral driver circuits is mounted by COG or the like. Note that a configuration of the display panel in FIG. 27A has a substrate 5300, a signal line driver circuit 5301, a pixel portion 5302, a gate line driver circuit 5303, a gate line driver circuit 5304, an FPC 5305, an IC chip 5306, an IC chip 5307, a sealing substrate 5308, and a sealing member 5309. By employing such a configuration, the power consumption of a display device can be lowered and the operating time of a cellular phone by charging once can be extended. In addition, the cost of a cellular phone can be reduced.

Moreover, when a signal that is set for a gate line or a signal line is impedance-converted by a buffer, a writing period of one row of pixels can be reduced. Therefore, a display device with higher definition can be provided.

Figure 27B:
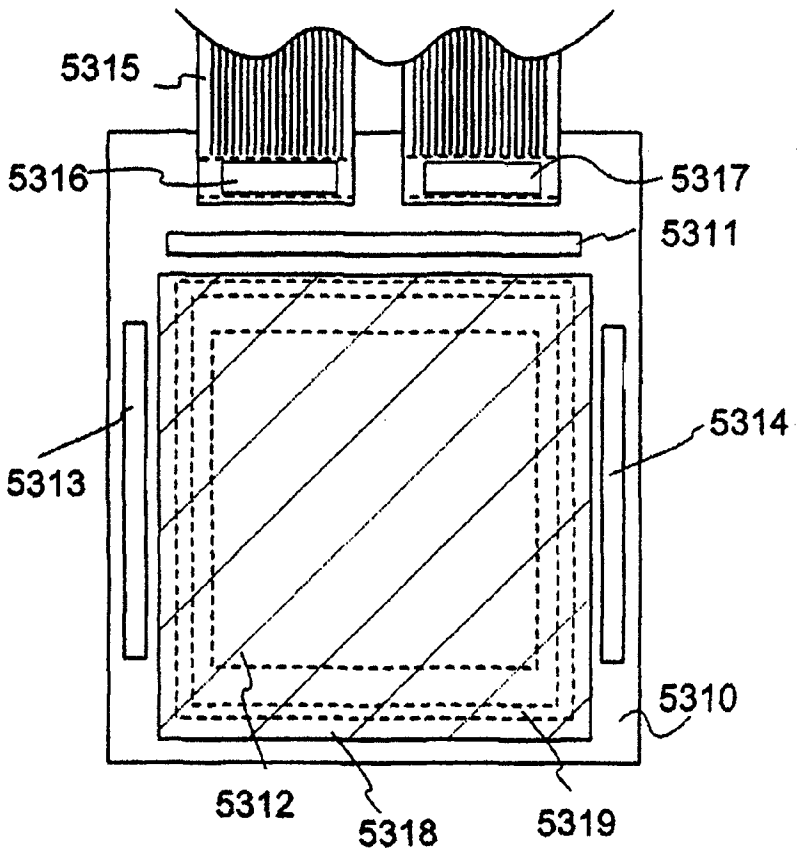
FIGS. 27A and 27B are diagrams each explaining a structure of a display device of the present invention.
Figure 27A:
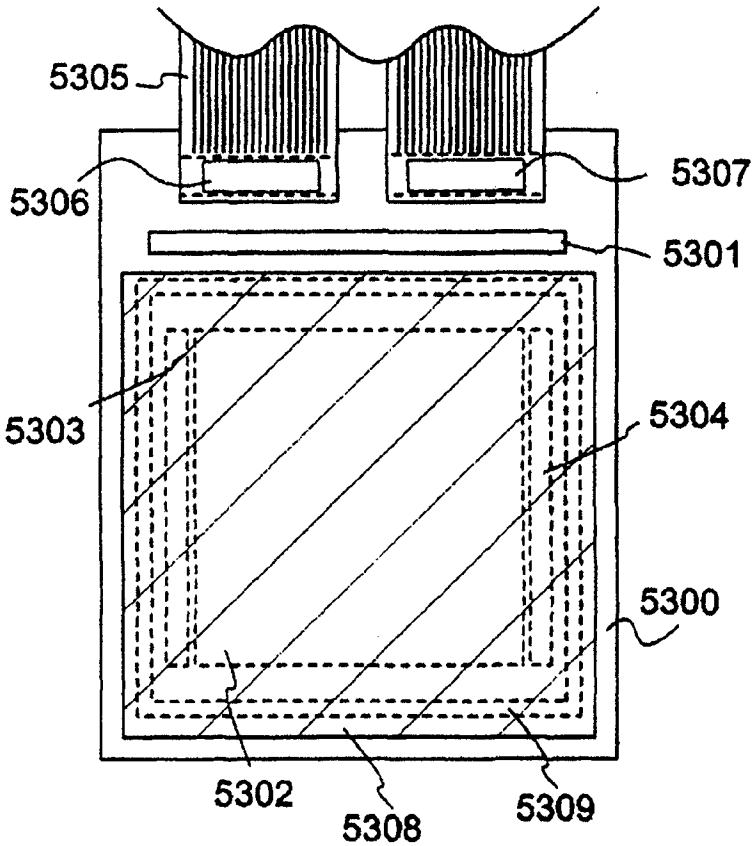

Further, in order to further reduce the power consumption, as shown in FIG. 27B, a pixel portion may be formed over a substrate by using TFTs, peripheral driver circuits may all be formed over an IC chip, and then the IC chip may be mounted on a display panel by COG (Chip On Glass) or the like. Note that a configuration of a display panel in FIG. 27B has a substrate 5310, a signal line driver circuit 5311, a pixel portion 5312, a gate line driver circuit 5313, a gate line driver circuit 5314, an FPC 5315, an IC chip 5316, an IC chip 5317, a sealing substrate 5318, and a sealing member 5319.

By using the display device of the present invention and the driving method thereof, a clear image where pseudo contours are reduced can be seen. Therefore, even in a case like human skin where gray scales subtly change, a clear image can be displayed.

Furthermore, the configuration shown in this embodiment is an example of the cellular phone, and the display device of the present invention is not limited to the cellular phone with such a configuration and can be applied to cellular phones with various configurations.

(Embodiment Mode 8)

Figure 28:
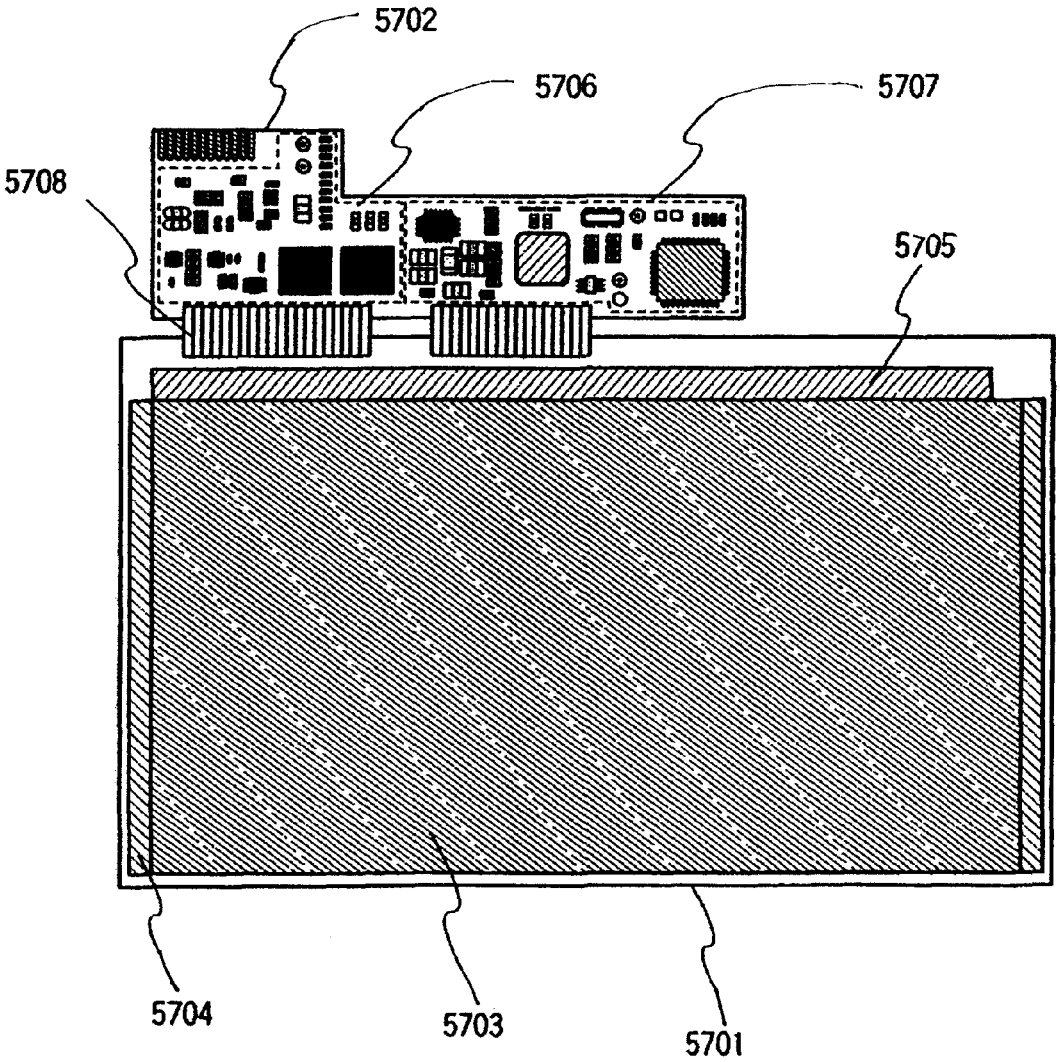
FIG. 28 is a view explaining an electronic device to which the present invention is applied.

FIG. 28 shows an EL module where a display panel 5701 and a circuit substrate 5702 are combined. The display panel 5701 has a pixel portion 5703, a gate line driver circuit 5704, and a signal line driver circuit 5705. The circuit substrate 5702 includes, for example, a control circuit 5706, a signal division circuit 5707, or the like. The display panel 5701 is connected to the circuit substrate 5702 with a connecting wiring 5708. As the connecting wiring, an FPC or the like may be employed.

The control circuit 5706 corresponds to the controller 2708, the memory 2709, the memory 2710, or the like, which are shown in Embodiment Mode 6. The order in which subframes appear, or the like are controlled mainly by the control circuit 5706.

In the display panel 5701, a pixel portion and part of peripheral driver circuits (a driver circuit with a lower operating frequency among a plurality of driver circuits) may be integrated over a substrate using TFTs, and another part of the peripheral driver circuits (a driver circuit with a higher operating frequency among the plurality of driver circuits) may be formed over an IC chip, and then the IC chip may be mounted on the display panel 5701 by COG (Chip On Glass) or the like. Alternatively, the IC chip may be mounted on the display panel 5701 by TAB (Tape Auto Bonding) or using a printed wiring board. Note that FIG. 27A shows a configuration example where part of peripheral driver circuits and a pixel portion are integrated over a substrate and an IC chip including the other peripheral driver circuits is mounted by COG or the like. By employing such a configuration, the power consumption of a display device can be lowered and the operating time of a cellular phone by charging once can be extended. In addition, the cost of a cellular phone can be reduced.

In addition, when a signal that is set for a gate line or a signal line is impedance-converted by a buffer, a writing period of one row of pixels can be reduced. Therefore, a display device with higher definition can be provided.

Moreover, in order to further reduce the power consumption, a pixel portion may be formed over a glass substrate using TFTs, signal line driver circuits may all be formed over an IC chip, and then the IC chip may be mounted on a display panel by COG (Chip On Glass).

Note that a pixel portion may be formed over a substrate using TFTs, peripheral driver circuits may all be formed over an IC chip, and then the IC chip may be mounted on a display panel by COG (Chip On Glass). Note that FIG. 27B shows a configuration example where a pixel portion is formed over a substrate and an IC chip including a signal line driver circuit is formed over the same substrate by COG or the like.

Figure 29:
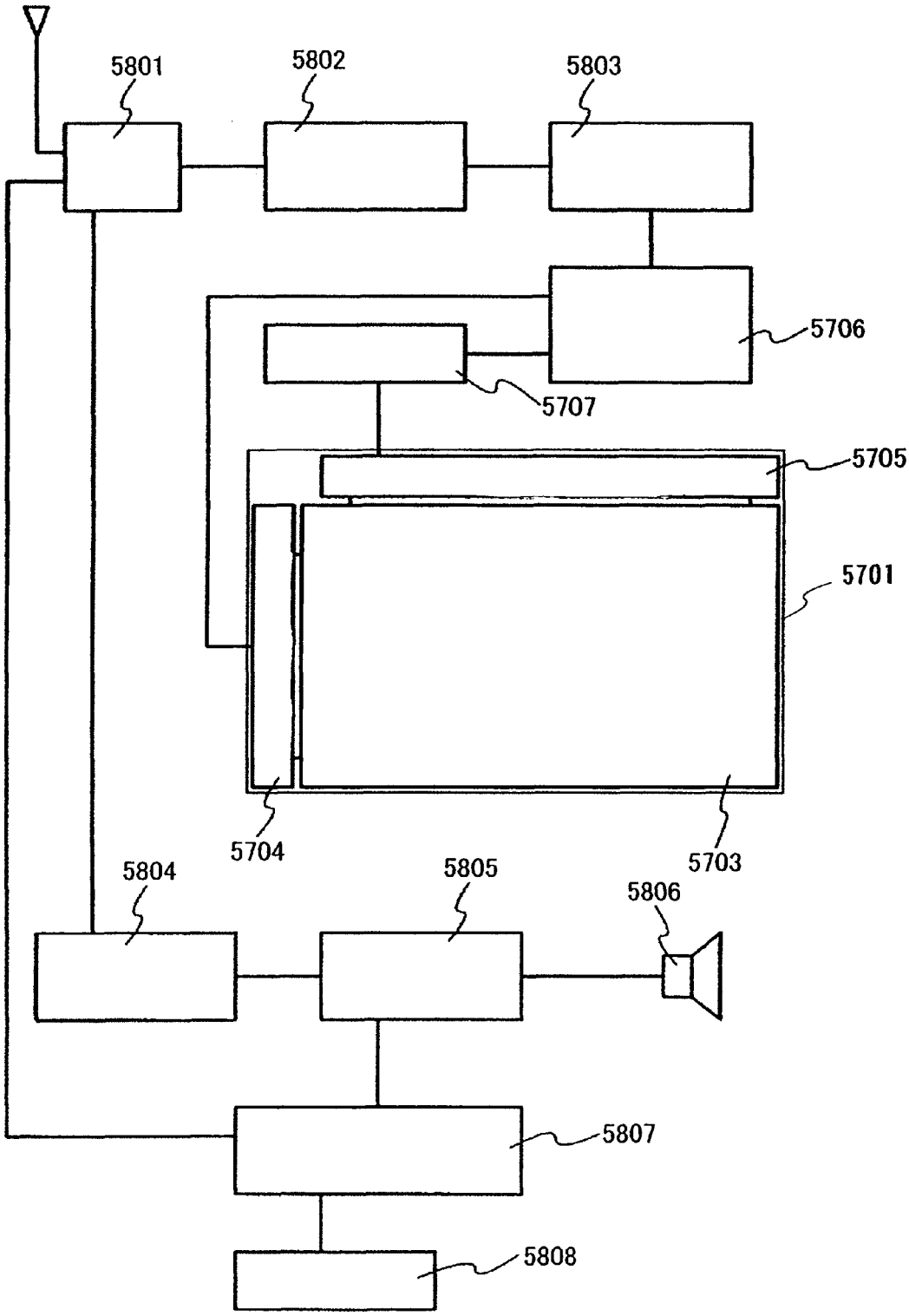
FIG. 29 is a diagram explaining a structure of a display device of the present invention.

An EL television receiver can be completed using this EL module. FIG. 29 is a block diagram showing a main configuration of an EL television receiver. The display panel 5701 has a pixel portion 5703, a gate line driver circuit 5704, and a signal line driver circuit 5705. A tuner 5801 receives a video signal and an audio signal. The video signal is processed by a video signal amplifier circuit 5802, a video signal processing circuit 5803 for converting the signal outputted from the video signal amplifier circuit 5802 into a color signal corresponding to each of red, green, and blue, and the control circuit 5706 for converting the video signal into input specifications to a driver circuit. The control circuit 5706 outputs a signal to each of a gate line side and a signal line side. In a case of a digital driving, the signal division circuit 5707 may be provided on the signal line side so that an input digital signal is divided into m signals to be supplied.

The audio signal among the signals received by the tuner 5801 is transmitted to an audio signal amplifier circuit 5804 and the output thereof is supplied to a speaker 5806 through an audio signal processing circuit 5805. A control circuit 5807 receives control data such as a receiving station (reception frequency) and a volume from an input portion 5808, and sends out a signal to the tuner 5801 and the audio signal processing circuit 5805.

A television receiver can be completed by incorporating the EL module in a housing. The EL module constitutes a display portion. In addition, a speaker, a video input terminal, or the like are provided appropriately.

It is needless to say that the present invention can be applied not only to a television receiver but to various applications such as a monitor of a computer and particularly large area display media typified by an information display panel at train stations, airports or the like, and an advertising display panel on the streets.

In this manner, by using the display device of the present invention and the driving method thereof, a clear image where pseudo contours are reduced can be seen. Therefore, even in a case like human skin where gray scales subtly change, a clear image can be displayed.

(Embodiment Mode 9)

As examples of an electronic device to which the present invention can be applied, a display of a desktop, floor-stand or wall-hung type; a camera such as a video camera or a digital camera; a goggle display (e.g., a head mounted display); a navigation system; an audio reproducing device (e.g., a car audio or an audio component stereo); a computer; a game machine; a portable information terminal (e.g., a mobile computer, a cellular phone, a portable game machine, or an electronic book); an image reproducing device provided with a recording medium (specifically, a device for reproducing video or still images recorded in a recording medium such as a Digital Versatile Disc (DVD) and having a display portion for displaying the reproduced image); or the like can be given. FIGS. 30A to 30H show specific examples of such electronic devices.

Figure 30A:
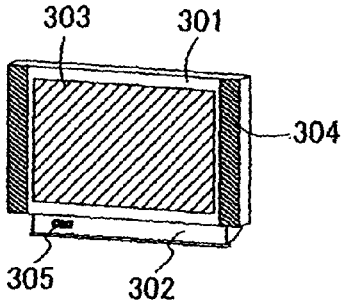
FIGS. 30A to 30H are views each explaining an electronic device to which the present invention is applied.

FIG. 30A is a display of a desktop, floor-stand or wall-hung type, which includes a housing 301, a supporting base 302, a display portion 303, a speaker portion 304, a video input terminal 305, and the like. The present invention can be used for a display device including the display portion 303. Such a display can be used as a display device used for displaying information, for example, for a personal computer, for TV broadcast reception, or for advertisement display. Consequently, the display capable of performing clear display without a pseudo contour can be provided.

Figure 30B:
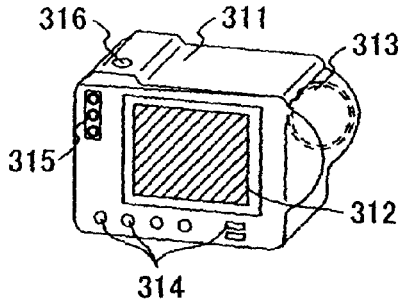

FIG. 30B is a digital camera, which includes a main body 311, a display portion 312, an image receiving portion 313, operating keys 314, an external connection port 315, a shutter 316, and the like. The present invention can be used for a display device including the display portion 312. Consequently, the digital camera capable of performing clear display without a pseudo contour can be provided.

Figure 30C:
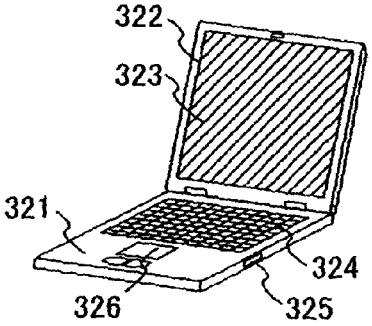

FIG. 30C is a computer, which includes a main body 321, a housing 322, a display portion 323, a keyboard 324, an external connection port 325, a pointing mouse 326, and the like. The present invention can be used for a display device including the display portion 323. Consequently, the computer capable of performing clear display without a pseudo contour can be provided. Note that the computer includes a so-called laptop computer where a central processing unit (CPU), a recording medium, and the like are integrated, and a so-called desktop computer where they are provided separately.

Figure 30D:
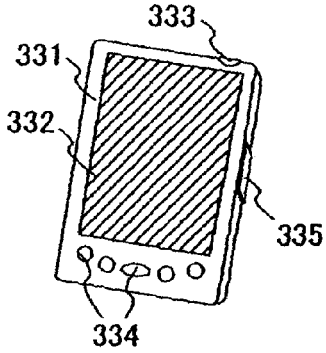

FIG. 30D is a mobile computer, which includes a main body 331, a display portion 332, a switch 333, operating keys 334, an infrared port 335, and the like. The present invention can be used for a display device including the display portion 332. Consequently, the mobile computer capable of performing clear display without a pseudo contour can be provided.

Figure 30E:
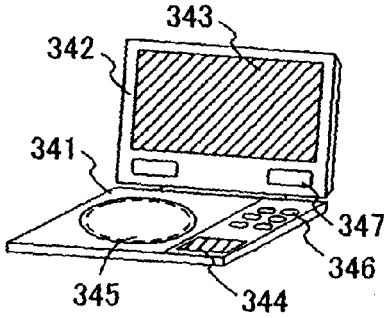

FIG. 30E is a portable image reproducing device provided with a recording medium (specifically, a DVD reproducing device), which includes a main body 341, a housing 342, a first display portion 343, a second display portion 344, a recording medium (DVD or the like) reading portion 345, operating keys 346, a speaker portion 347, and the like. The first display portion 343 mainly displays image data, and the second display portion 344 mainly displays text data. The present invention can be used for a display device including the first and second display portions 343 and 344. Consequently, the image reproducing device capable of performing clear display without a pseudo contour can be provided. Note that an image reproducing device provided with a recording medium includes a home-use game machine and the like.

Figure 30F:
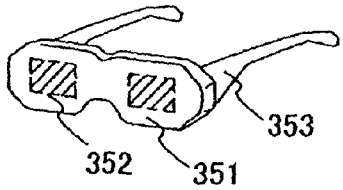

FIG. 30F is a goggle type display (a head mounted display), which includes a main body 351, a display portion 352, an arm portion 353, and the like. The present invention can be used for a display device including the display portion 352. Consequently, the goggle type display capable of performing clear display without a pseudo contour can be provided.

Figure 30G:
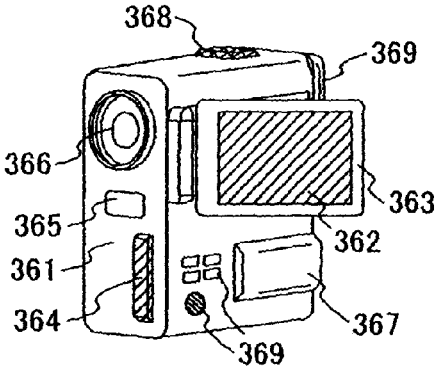

FIG. 30G is a video camera, which includes a main body 361, a display portion 362, a housing 363, an external connection port 364, a remote control receiving portion 365, an image receiving portion 366, a battery 367, an audio input portion 368, operating keys 369, and the like. The present invention can be used for a display device including the display portion 362. Consequently, the video camera capable of performing clear display without a pseudo contour can be provided.

Figure 30H:
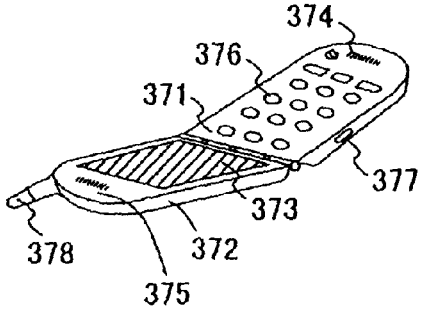
Figure 31:
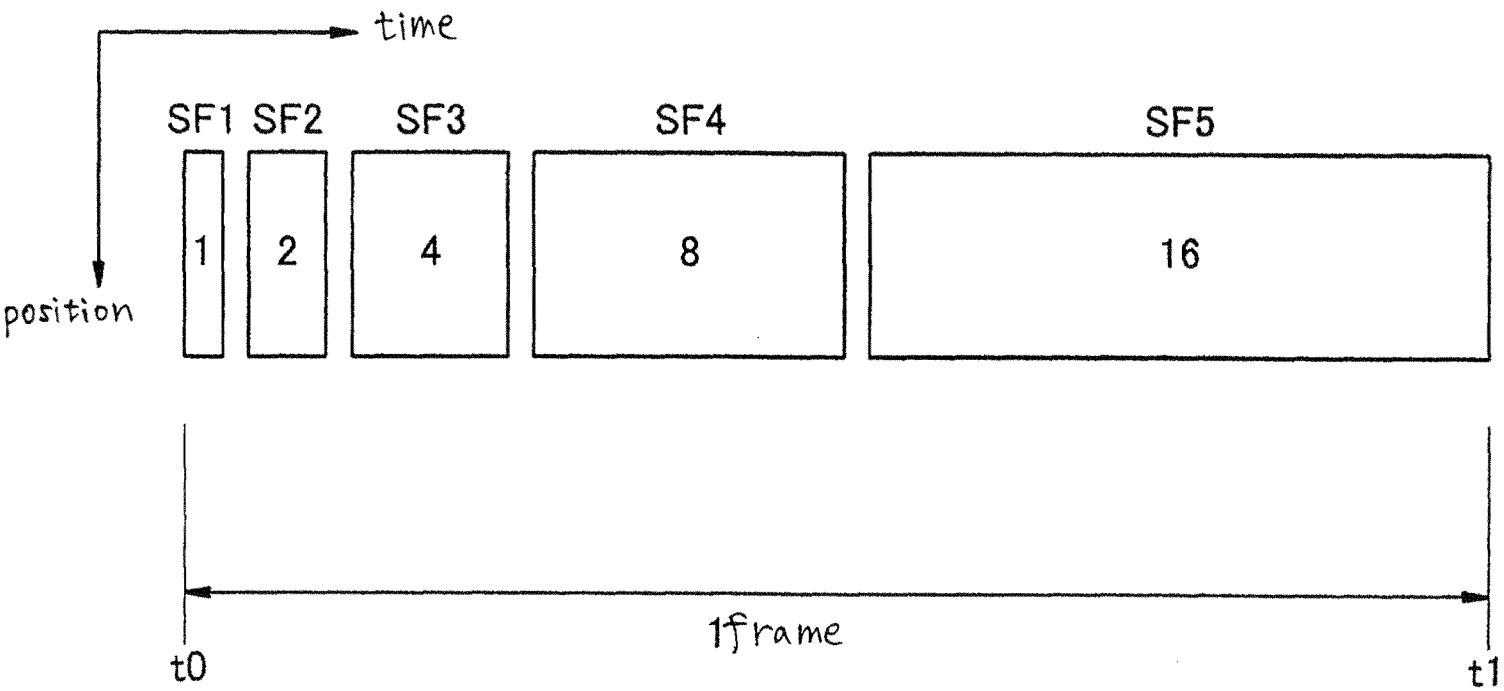
FIG. 31 (PRIOR ART)
FIG. 31 is a diagram explaining a structure of a driving method of a conventional display device.
Figure 33:
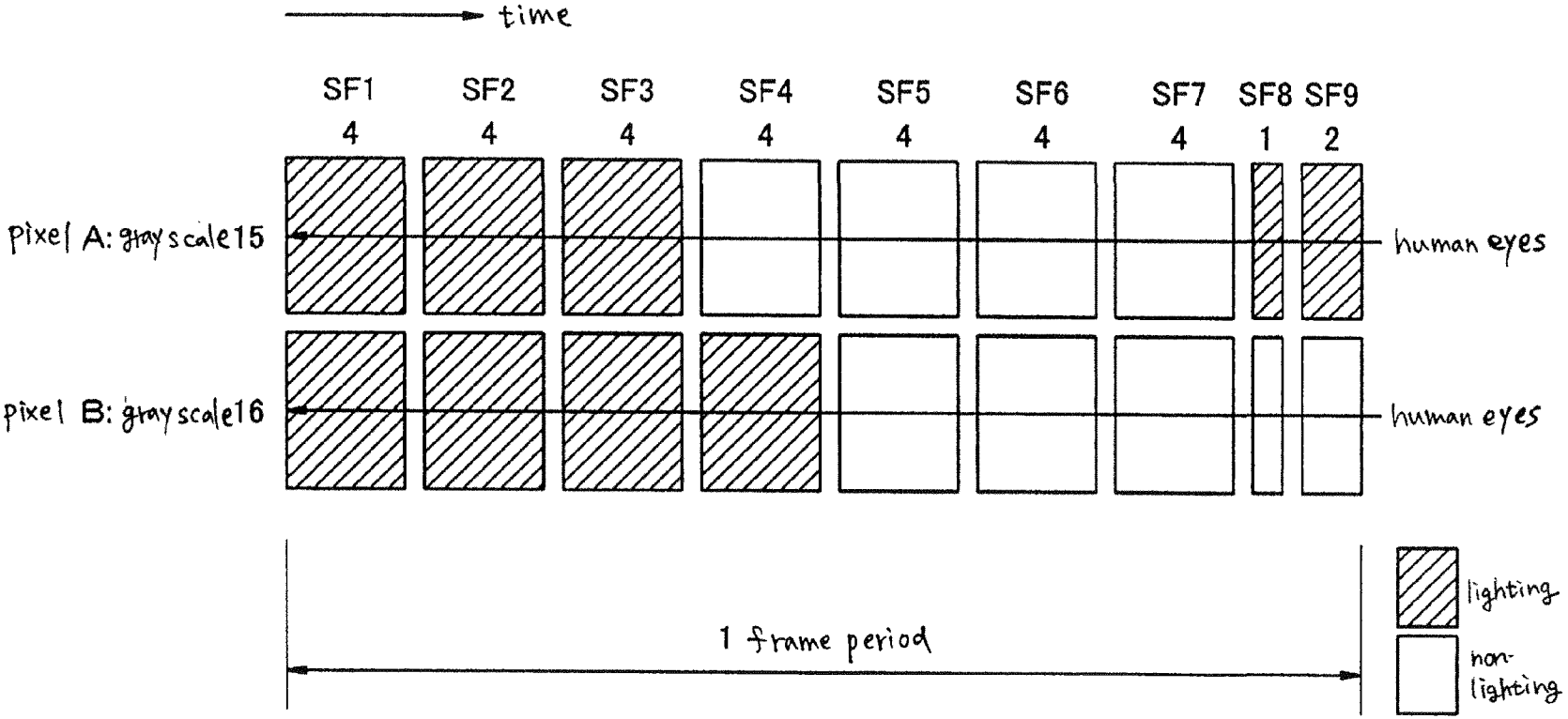
FIG. 33 (PRIOR ART)
FIG. 33 is a diagram explaining another example of a driving method of a conventional display device.
Figure 34:
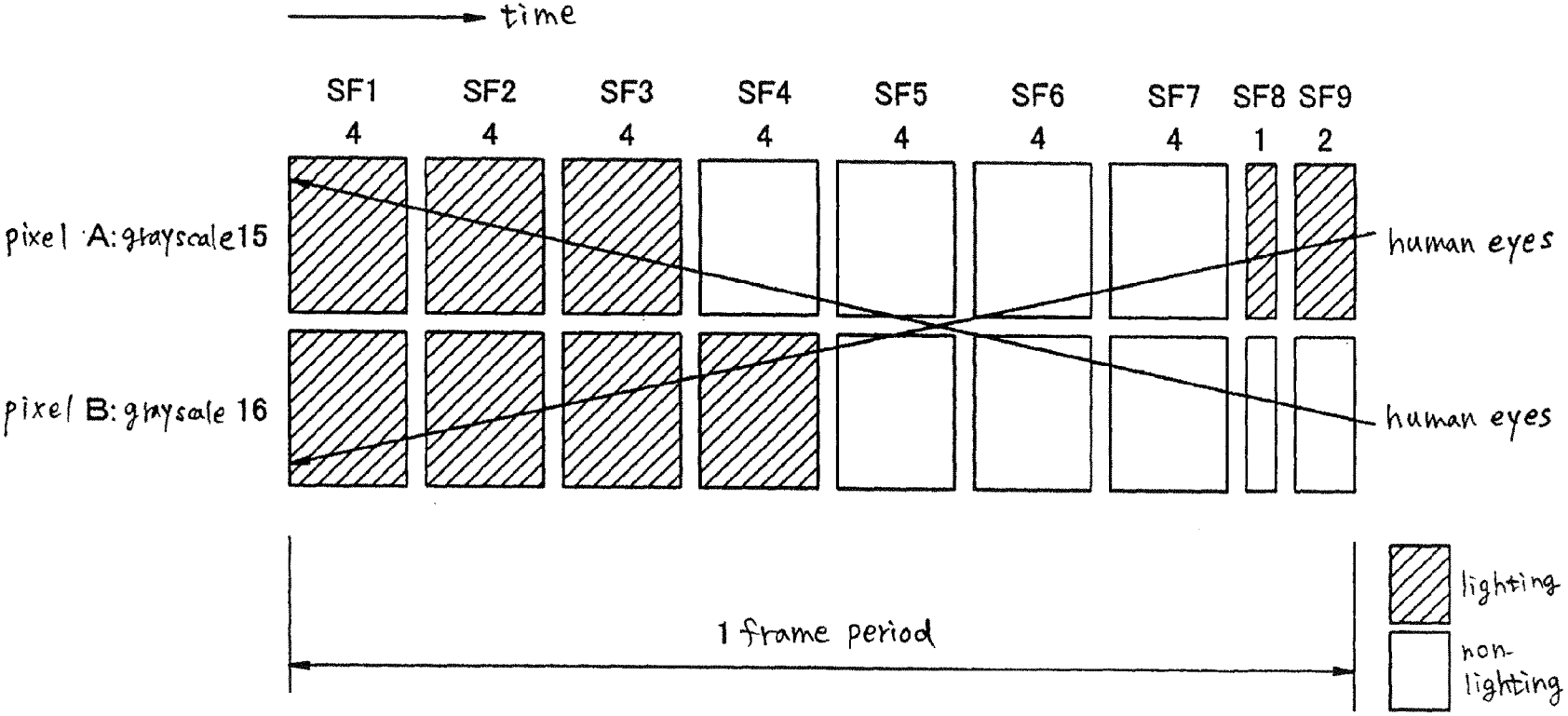
FIG. 34 (PRIOR ART)
FIG. 34 is a diagram explaining another example of a driving method of a conventional display device.

FIG. 30H is a cellular phone, which includes a main body 371, a housing 372, a display portion 373, an audio input portion 374, an audio output portion 375, operating keys 376, an external connection port 377, an antenna 378, and the like. The present invention can be used for a display device including the display portion 373. Consequently, the cellular phone capable of performing clear display without a pseudo contour can be provided.

The display portions of the electronic devices as described above may be formed as a self-light-emitting type in which a light-emitting element such as an LED or an organic EL is used in each pixel, or may be formed as another type in which a light source such as a backlight is used like a liquid crystal display. In the case of a self-light-emitting type, no backlight is required and a display portion can be thinner than a liquid crystal display.

Moreover, the above electronic devices have been increasingly used for displaying information distributed through an electronic communication line such as the Internet and a CATV (cable television) or as TV receptors. In particular, an opportunity for displaying moving image information is increasing. A display device of a self-light-emitting type is suitable for such a moving image display since a light-emitting material such as an organic EL responses much faster than that of a liquid crystal. In addition, it is also suitable for performing time division driving. When the luminance of a light-emitting material is increased in the future, the light-emitting material can be used for a front or rear projector by magnifying and projecting outputted light containing image information by a lens or the like.

Since a light-emitting portion of a self-light-emitting display portion consumes power, it is desirable to display information using a light-emitting portion so as to be decreased as much as possible. Therefore, in the case where a display portion of a portable information terminal, in particular, of a cellular phone, a sound reproduction apparatus or the like which mainly displays character information is of a self-light-emitting type, it is desirable to perform driving so that light-emitting portions display character information while non-light-emitting portions serve as the background.

As described through the above, the application range of the present invention is so wide that the present invention can be applied to electronic devices of all fields.

The present application is based on Japanese Patent Application serial No. 2005-356277 filed on Dec. 9, 2005 in Japanese Patent Office, the entire contents of which are hereby incorporated by reference.

What is claimed is:

1. A display device, where one frame is divided into a plurality of sub-frames to display a gray scale, wherein the plurality of sub-frames consist of M (M is an integer number of greater than or equal to 2) regular sub-frames which is necessary for displaying a maximum of $2^M$ predetermined gray scales and N (N is a natural number) additive sub-frames that are necessary for displaying an alternative lighting pattern for selected gray scales, wherein weightings of the M regular sub-frames sum to $2^M-1$, wherein weightings of the N additive sub-frames are all less than a maximum weighting of the M regular sub-frames, wherein at least two sub-frame lighting patterns of a first sub-frame lighting pattern and a second sub-frame lighting pattern are provided at least for one gray scale of the predetermined gray scales, wherein the first sub-frame lighting pattern uses only the regular sub-frames, wherein the second sub-frame lighting pattern uses the additive sub-frames and the regular sub-frames, wherein at least one sub-frame having a minimum weighting in the N additive sub-frames has a same weighting as at least one sub-frame having a minimum weighting in the M regular sub-frames, wherein all gray scales greater than a certain gray scale and including the certain gray scale are displayed by at least two sub-frame lighting patterns having different combinations of weights, the different combinations of weights having at least one different weight value, and wherein a sub-frame lighting pattern of a first pixel is selected based on a gray scale or a corresponding sub-frame lighting pattern of a second pixel, wherein the second pixel is positioned immediately preceding or following the first pixel with no intervening pixel therebetween.

2. A display device according to claim 1, wherein the M regular sub-frames include r (r is an integer number that satisfies $2 \leq r \leq M$) binary code sub-frames which have a different weighting with each other and are used for a binary code time gray scale method, and the gray scale where the at least two sub-frame lighting patterns are provided includes a gray scale which is displayed only by a sub-frame of a largest weighting in a case where the additive sub-frames are not used.

3. A display device according to claim 1, wherein the M regular sub-frames include three sub-frames having weightings of 1, 2, and 4, and the gray scale where the at least two sub-frame lighting patterns are provided includes a gray scale of multiples of 4.

4. A display device according to claim 3, wherein the gray scale where the at least two sub-frame lighting patterns are provided further includes a gray scale of multiples of 4 to which 1 is added.

5. A display device according to claim 4, wherein the gray scale where the at least two sub-frame lighting patterns are provided further includes a gray scale of multiples of 4 to which 2 is added.

6. A display device according to claim 1, wherein the gray scale where the at least two sub-frame lighting patterns are provided includes all gray scales of greater than or equal to 4.

7. A display device according to claim 1, wherein the N is greater than or equal to 2.

8. A display device according to claim 7, wherein the two or more additive sub-frames include sub-frames of different weightings.

9. A display device according to any one claim 1, wherein the display device is an EL display, a plasma display, a digital micromirror device, a field emission display, a surface-conduction electron-emitter display, or a ferroelectric liquid crystal display.

10. A method of driving a display device comprising:

dividing one frame into a plurality of sub-frames, the plurality of sub-frames consisting of a plurality of M (M is an integer number of greater than or equal to 2) regular sub-frames which is necessary for displaying a maximum of $2^M$ predetermined gray scales and N (N is a natural number) additive sub-frames that are necessary for displaying an alternative lighting pattern for selected gray scales, wherein weightings of the M regular sub-frames sum to $2^M-1$, and wherein weightings of the N additive sub-frames are all less than a maximum weighting of the M regular sub-frames and performing at least two sub-frames lighting patterns of a first sub-frame lighting pattern and a second sub-frame lighting pattern, which are provided at least for one gray scale of a predetermined gray scale, wherein the first sub-frame lighting pattern uses only the regular sub-frames, and the second sub-frame lighting pattern uses the additive sub-frames and the regular sub-frames, wherein at least one sub-frame having a minimum weighting in the N additive sub-frames has a same weighting as at least one sub-frame having a minimum weighting in the M regular sub-frames, wherein all gray scales greater than a certain gray scale and including the certain gray scale are displayed by at least two sub-frame lighting patterns having different combinations of weights, the different combinations of weights having at least one different weight value, and wherein a sub-frame lighting pattern of a first pixel is selected based on a gray scale or a corresponding sub-frame lighting pattern of a second pixel, wherein the second pixel is positioned immediately preceding or following the first pixel with no intervening pixel therebetween.

11. A method of driving a display device according to claim 10, wherein the display device is an EL display, a plasma display, a digital micromirror device, a field emission display, a surface-conduction electron-emitter display, or a ferroelectric liquid crystal display.

12. A display device according to claim 1, wherein the one frame consists of only the regular sub-frames and the additive sub-frames.

13. A method of driving a display device according to claim 10, wherein the one frame consists of only the regular sub-frames and the additive sub-frames.

14. A display device according to claim 1, wherein the N additive sub-frames includes an additive sub-frame of having a weight of 1, an additive sub-frame of having a weight of 2, and an additive sub-frame of having a weight of 3.

* * * * *

UNITED STATES PATENT AND TRADEMARK OFFICE

CERTIFICATE OF CORRECTION

PATENT NO. : 8,564,625 B2
APPLICATION NO. : 11/567033
DATED : October 22, 2013
INVENTOR(S) : Kimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 947 days.

Signed and Sealed this
Seventh Day of April, 2015

Michelle K. Lee

Michelle K. Lee
*Director of the United States Patent and Trademark Office*